US009039119B2

(12) United States Patent
Okada et al.

(10) Patent No.: US 9,039,119 B2
(45) **Date of Patent: *May 26, 2015**

(54) METHOD OF DETECTING A PATTERN POSITION IN AN IMAGE FORMING APPARATUS WHICH READS A TEST PATTERN FORMED ONTO A RECORDING MEDIUM TO ADJUST AN EJECTION TIMING OF LIQUID DROPLETS, IMAGE FORMING APPARATUS AND IMAGE FORMING SYSTEM

(75) Inventors: Tatsuhiko Okada, Saitama (JP); Mamoru Yorimoto, Kanagawa (JP); Daisaku Horikawa, Saitama (JP); Makoto Moriwaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 559 days.

This patent is subject to a terminal disclaimer.

(21) Appl. No.: 13/413,706

(22) Filed: Mar. 7, 2012

(65) Prior Publication Data

US 2012/0229546 A1 Sep. 13, 2012

(30) Foreign Application Priority Data

Mar. 11, 2011 (JP) ..... 2011-054443
Dec. 16, 2011 (JP) ..... 2011-276401

(51) Int. Cl.
*B41J 29/38* (2006.01)
*B41J 29/393* (2006.01)
*B41J 2/21* (2006.01)

(52) U.S. Cl.
CPC ..... *B41J 2/2142* (2013.01); *B41J 2/2135* (2013.01)

(58) Field of Classification Search
CPC ..... B41J 2/2135; B41J 2/2142
USPC ..... 347/14, 19; 399/49
See application file for complete search history.

(56) References Cited

U.S. PATENT DOCUMENTS

| | | | | |
|---|---|---|---|---|
| 7,367,646 | B2 * | 5/2008 | Cordery et al. | 347/19 |
| 7,992,953 | B2 | 8/2011 | Yorimoto et al. | |
| 2004/0141765 | A1 * | 7/2004 | Shimura et al. | 399/49 |
| 2008/0225066 | A1 * | 9/2008 | Yorimoto et al. | 347/14 |
| 2013/0027457 | A1 * | 1/2013 | Yamazaki et al. | 347/14 |

FOREIGN PATENT DOCUMENTS

| | | | |
|---|---|---|---|
| JP | 2001-129980 | A | 5/2001 |
| JP | 2005-148299 | A | 6/2005 |
| JP | 2008-229915 | A | 10/2008 |

OTHER PUBLICATIONS

English language abstract for US 7,992,953 corresponds to JP 2008-229915.

* cited by examiner

*Primary Examiner* — Julian Huffman
*Assistant Examiner* — Carlos A Martinez
(74) *Attorney, Agent, or Firm* — Harness, Dickey & Pierce, P.L.C.

(57) ABSTRACT

An image forming apparatus which reads a test pattern formed onto a recording medium to adjust an ejection timing of liquid droplets is disclosed. The apparatus includes a reading unit; a pattern data storage unit; an image forming unit; a relative movement unit; an intensity data obtaining unit which obtains intensity data on a reflected light which is received by a light receiving unit from a scanning position of a light while the light moves over the test pattern; and a position detecting unit which applies a line position determining operation on the intensity data and detects a line position.

12 Claims, 45 Drawing Sheets

METHOD OF DETECTING A PATTERN POSITION IN AN IMAGE FORMING APPARATUS WHICH READS A TEST PATTERN FORMED ONTO A RECORDING MEDIUM TO ADJUST AN EJECTION TIMING OF LIQUID DROPLETS, IMAGE FORMING APPARATUS AND IMAGE FORMING SYSTEM

TECHNICAL FIELD

The present invention generally relates to liquid-ejecting image forming apparatuses and more specifically relates to an image forming apparatus which can correct an offset of an impacting position of liquid droplets.

BACKGROUND ART

Image forming apparatuses (below called liquid ejecting image forming apparatuses) are known which eject liquid droplets onto a sheet material such as a sheet of paper to form an image. The liquid ejecting image forming apparatuses may generally be divided into a serial-type image forming apparatus and a line-head type image forming apparatus. In the serial-type image forming apparatus, a recording head moves in both main scanning directions perpendicular to a direction of sheet conveying while the sheet conveying is repeated to form an image over the sheet of paper. In the line head-type image forming apparatus with nozzles being aligned in a length which is almost the same length as a maximum width of the sheet of paper, when a timing arrives at which the sheet of paper is conveyed and the liquid droplet is ejected, nozzles within the line head eject the liquid droplets to form the image.

However, it is known that, in the serial-type image forming apparatus, when one ruled line is printed in both directions of an outward path and a return path, an offset of the ruled lines is likely to occur between the outward path and the return path. Moreover, it is known that, in the line head-type image forming apparatus, parallel lines are likely to appear in the sheet-conveying direction when there is a nozzle whose position of impacting is constantly offset due to a mounting error, finishing accuracy of the nozzle, etc.

Therefore, in the liquid-ejecting image forming apparatus, it is often the case that a test pattern for self-adjustment to adjust the position of impacting the liquid droplets is printed on the sheet material, the test pattern is optically read, and an ejection timing is adjusted based on the read results (see Patent document 1, for example.)

Patent document 1 discloses an image forming apparatus which includes a pattern forming unit that forms, on a water-repellent member, a reference pattern including multiple independent liquid droplets and a pattern to be measured that includes multiple independent liquid droplets ejected under an ejection condition different from the reference pattern such that they are aligned in a scanning direction of a recording head; a reading unit including a light emitting unit which irradiates a light onto the respective patterns and a light receiving unit which receives a regular reflected light from the respective patterns; and a correction unit which measures a distance between the respective patterns based on read results of the reading unit for correcting of a liquid droplet ejection timing of the recording head based on the measurement results.

PATENT DOCUMENTS

Patent Document 1 JP2008-229915A

While the ejection timing needs to be adjusted for each color of ink (or for each nozzle), intensity of a reflected light differs from color to color, so that there are problems as follows.

FIG. 1A is an exemplary diagram which schematically describes a light receiving element which reads a black test pattern. When a spotlight which is irradiated by an LED scans the test pattern in an arrow direction, a reflected light in accordance with a density of a scanning position of the spotlight is detected at the light receiving element. As is well known, a light is absorbed well by a black object, so that it is difficult for the spotlight to be reflected when the test pattern is scanned if a sheet material is white and the test pattern is black. If the reflected light received by the light receiving element is shown in voltage, a voltage when the spotlight overlaps the test pattern is substantially lower than a voltage when somewhere other than the test pattern is scanned as shown.

FIG. 1B is an exemplary exploded view showing a voltage change obtained from the black test pattern. A horizontal axis is time or the scanning position of the spotlight. An elongated circle shows a region at which the voltage sharply changes. It is inferred that an edge of the test pattern is within the region; for example, a regression line is calculated from a detected voltage between upper and lower thresholds predetermined, and a cross point between the regression line and the upper and lower thresholds is calculated; then it is determined that, at the cross point, a centroid of the spotlight scans the edge of the test pattern when a detected voltage shows a point of inflection.

FIG. 1C is an exemplary diagram which schematically describes a light receiving element which reads test patterns of black and magenta. FIG. 1D is an exemplary exploded view showing a voltage change obtained from the test patterns of black and magenta. A local minimum value of a detected voltage reflected from the magenta test pattern is arranged to be higher relative to the black test pattern.

In other words, when colors of the test patterns differ while the light emitting element has a single wavelength, an intensity of a reflected light when the spotlight passes over the test pattern differs from color to color, so that it becomes difficult to accurately determine a distance between the test patterns of the colors from a signal wavelength of the reflected light. More specifically, even though an edge position of the detected voltage obtained from the black test pattern is determined correctly, it becomes difficult to correctly determine an edge position of the detected voltage obtained from the magenta test pattern.

Installing a light emitting element corresponding to each color such as to cause signal waveforms at the time of passing over the test patterns to be at approximately the same level leads to an increased cost and causes inconveniences that a space for installing the light emitting elements needs to be provided.

DISCLOSURE OF THE INVENTION

In light of the problems as described above, an object of embodiments of the present invention is to provide an image forming apparatus which reads test patterns to adjust an ejection timing of liquid droplets, which image forming apparatus accurately detect an offset even when ink colors of the test patterns differ.

According to an embodiment of the present invention, an image forming apparatus is provided which reads a test pattern formed onto a recording medium to adjust an ejection timing of liquid droplets, the test pattern including multiple lines, the image forming apparatus including a reading unit including a light emitting unit which irradiates a light onto the recording medium, and a light receiving unit which receives a reflected light from the recording medium; a pattern data storage unit which stores pattern data of the test pattern, wherein a drawing density is adjusted for each color of the liquid droplets such that a difference between local minimum values of reflected lights reflected by at least two colors of the test pattern becomes small relative to when the drawing density is the same for each color of the liquid droplets; an image forming unit which reads the pattern data to form the at least two colors of the test pattern onto the recording medium, each color of the test pattern having a different drawing density; a relative movement unit which relatively moves the recording medium or the reading unit at a constant speed; an intensity data obtaining unit which obtains intensity data on the reflected light which is received by the light receiving unit from a scanning position of the light while the light moves over the test pattern; and a position detecting unit which applies a line position determining operation on the intensity data and detects the line position.

Embodiments of the present invention makes it possible to provide an image forming apparatus which reads test patterns to adjust an ejection timing of liquid droplets, which image forming apparatus causes signal waveforms to be at approximately the same level even when ink colors of the test patterns differ.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

A description is given below with regard to embodiments of the present invention with reference to the drawings.

Embodiment 1

Figure 1A:
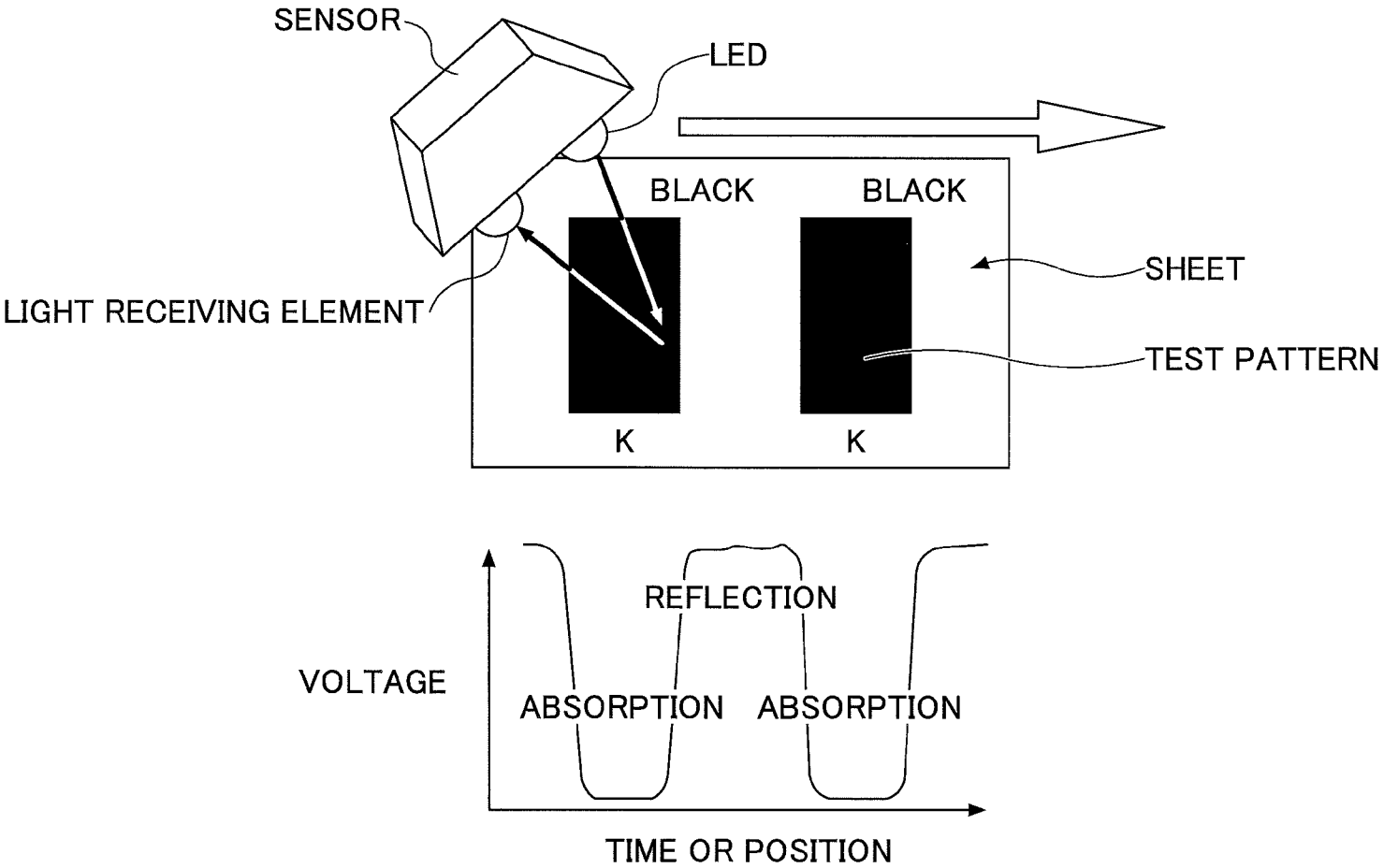
FIG. 1A is an exemplary diagram which schematically describes a light receiving element which reads a black test pattern.
Figure 1B:
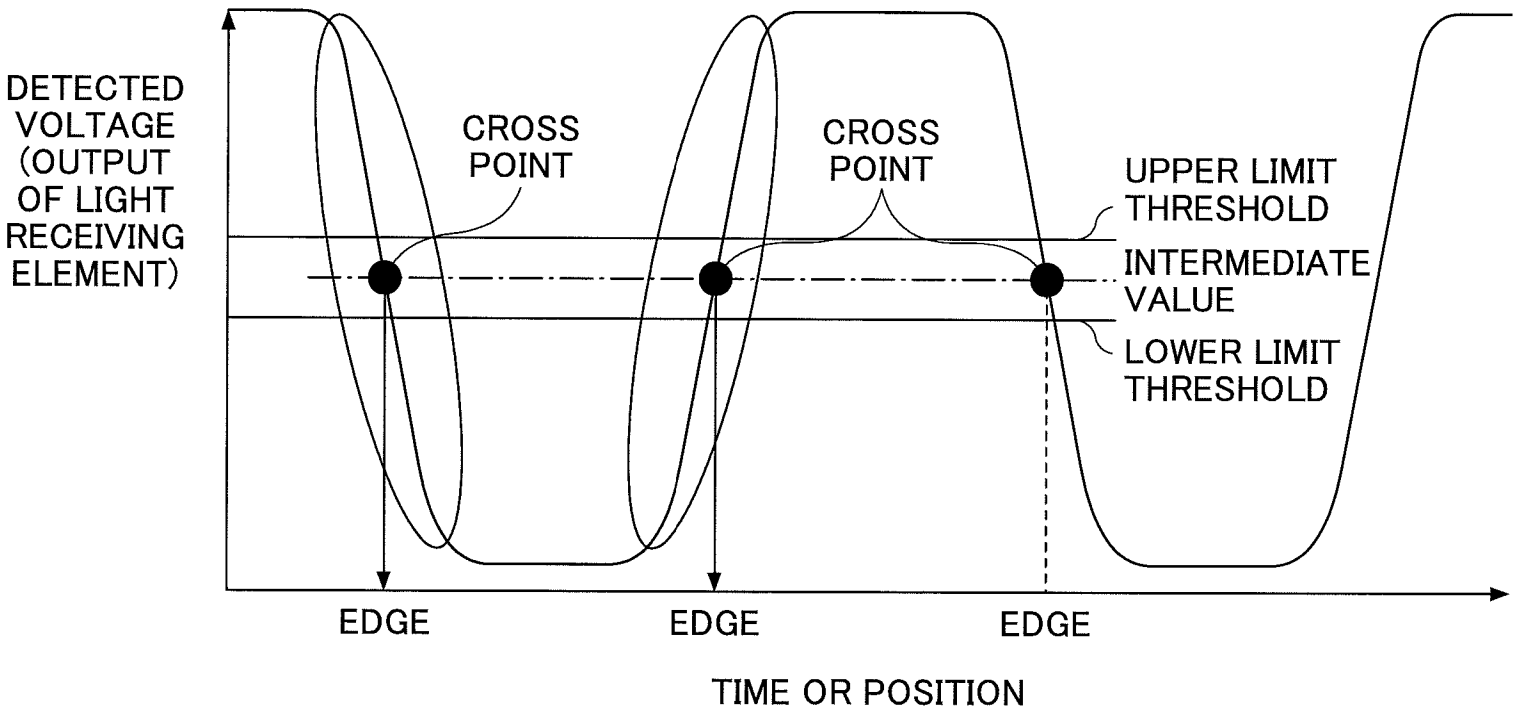
FIG. 1B is an exemplary exploded view showing a voltage change obtained from the black test pattern.
Figure 1C:
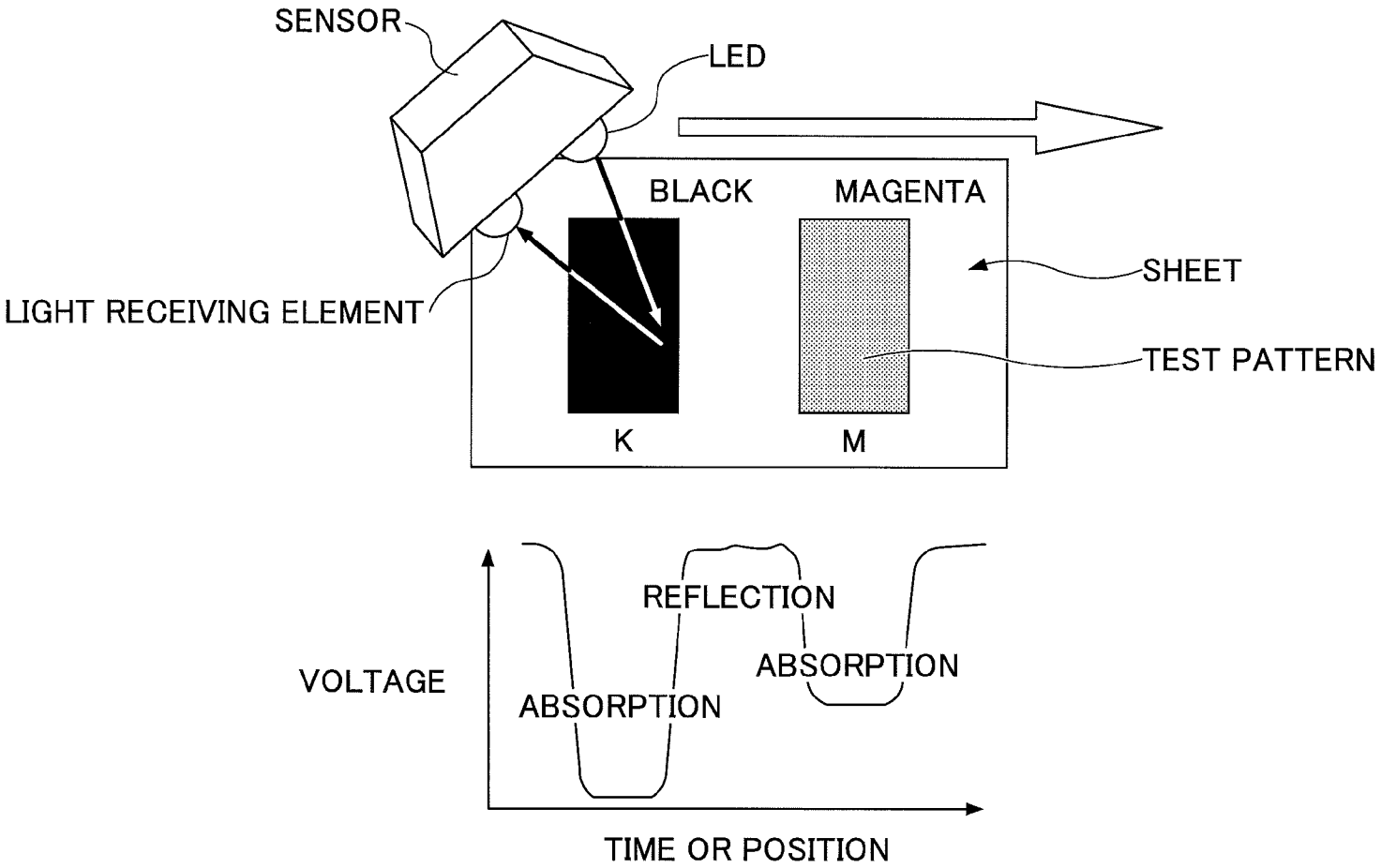
FIG. 1C is an exemplary diagram which schematically describes a light receiving element which reads test patterns of black and magenta.
Figure 1D:
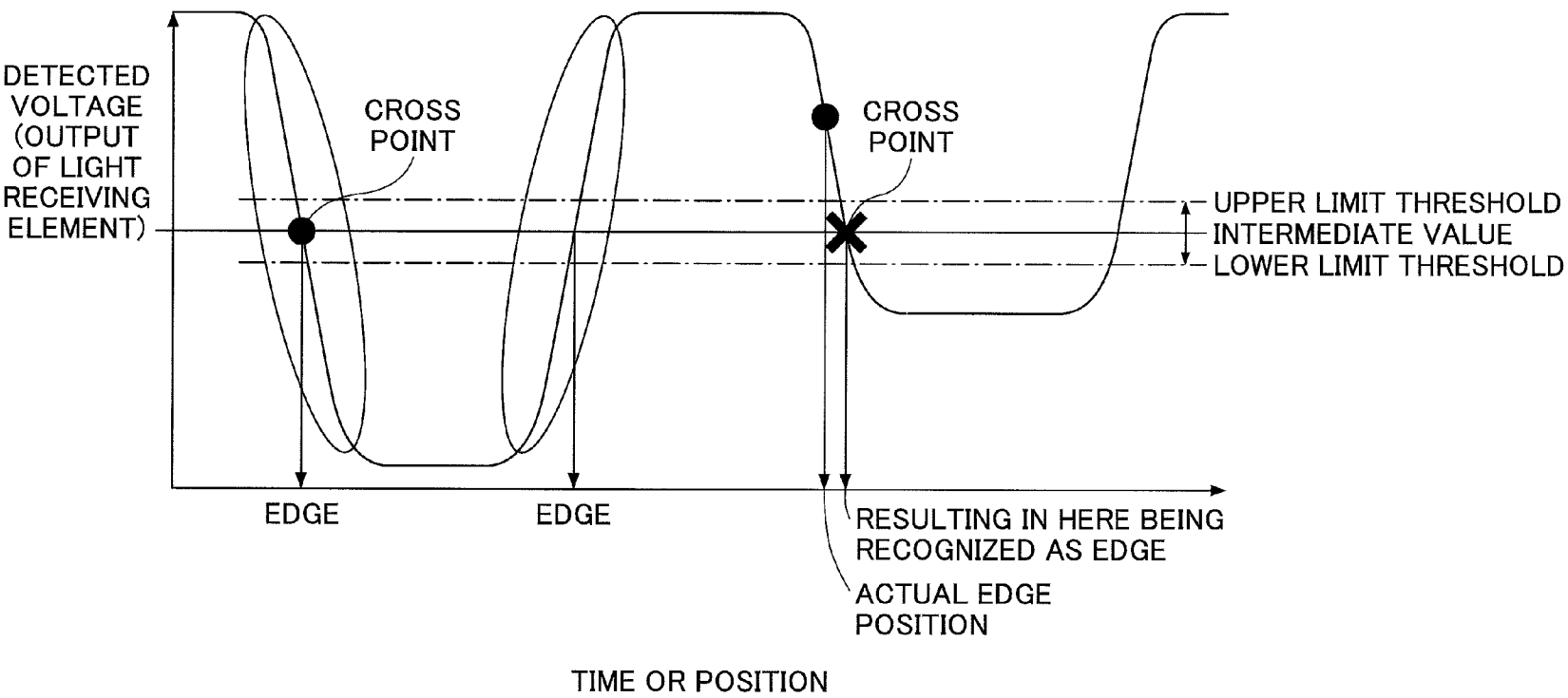
FIG. 1D is an exemplary exploded view showing a voltage change obtained from the test patterns of black and magenta.
Figure 2A:
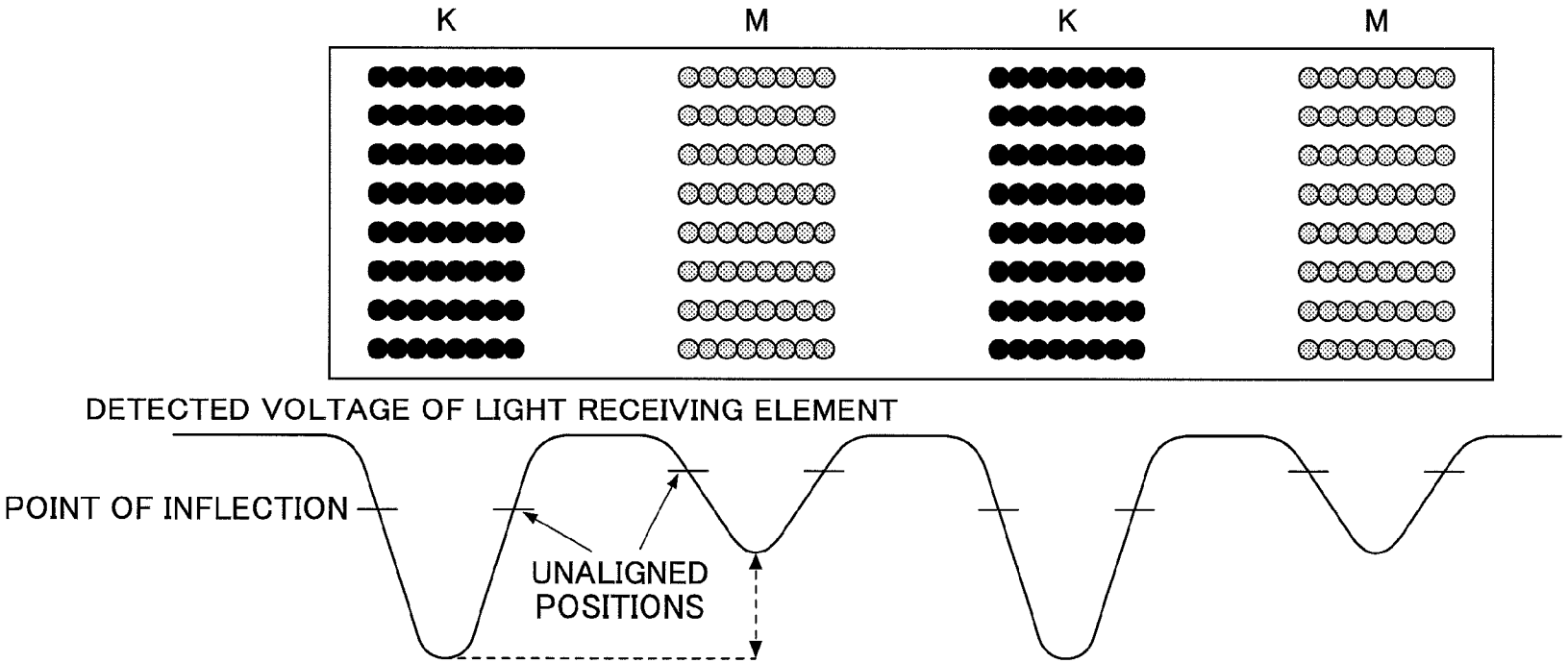
FIGS. 2A, 2B, and 2C are exemplary diagrams which schematically describe a test pattern printing method.
Figure 2B:
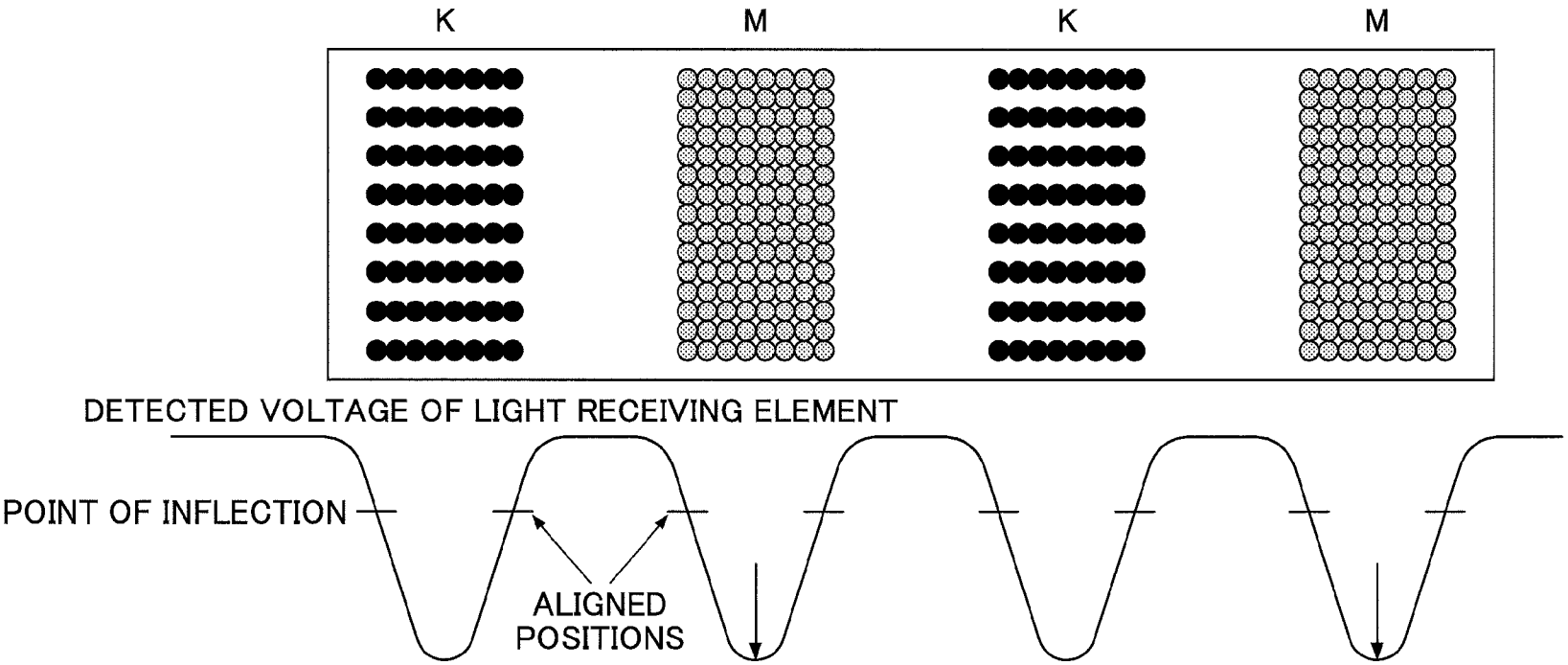
Figure 2C:
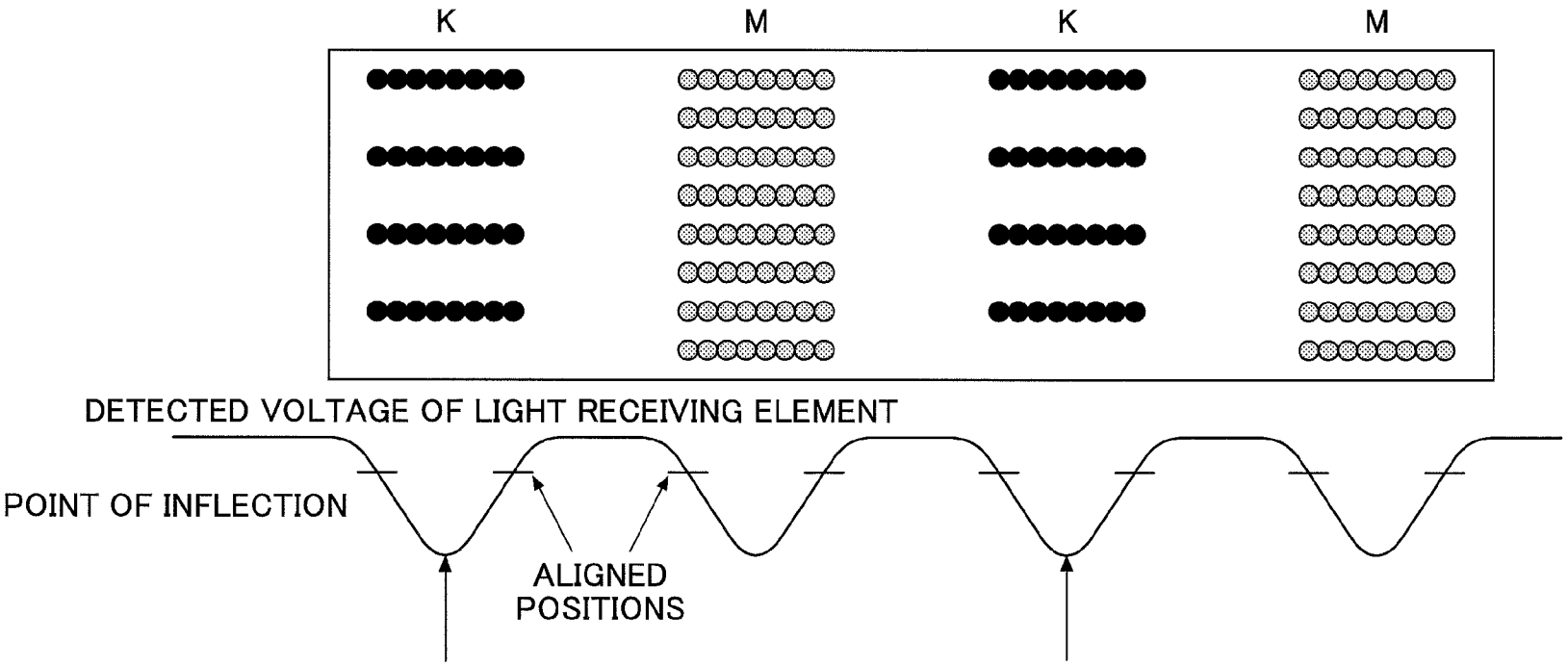

FIGS. 2A, 2B, and 2C are exemplary diagrams which schematically describe a test pattern printing method of the present embodiment. FIG. 2A shows an example of a detected voltage whose local minimum values differ due to differing ink colors. Therefore, a position (a voltage value) of a point of inflection greatly differs from color to color.

An image forming apparatus of the present embodiment changes a drawing density for each ink color to change a print concentration at the time of forming a test pattern such that positions of the inflection points are at approximately the same level even when the color differs. In this way, the positions of the inflection points of the detected voltage obtained from the respective color test patterns may be arranged to be close to one another. Below, explanations are given with no distinctions made between the test pattern and lines which make up the test pattern.

FIG. 2B shows a test pattern and the detected voltage when a drawing density of magenta is made higher, while FIG. 2C shows a test pattern and the detected voltage when a drawing density of black is made lower. The drawing density of magenta is made higher, so that the spotlight is absorbed more, so that the local minimum values of the detected voltages of black and magenta take approximately the same value, making it possible to cause the positions of the inflection points of the detected voltage to be closer. Similarly, the drawing density of black is made lower, so that the spotlight is absorbed less, so that the local minimum values of the detected voltages of black and magenta take approximately the same value, making it possible to cause the positions of the inflection points of the detected voltage to be closer. Preferably, the drawing density is set such that the local minimum values of the detected voltages of black and magenta take approximately the same value; the local minimum values taking approximately the same value causes the positions of the inflection points to be close. However, a difference in the local minimum values of the detected voltages is smaller in a case such that at least the drawing density is changed relative to a case otherwise, so that closer positions of the points of inflection make it possible to accurately detect the edge position of the test pattern.

(Configuration)

Figure 3:
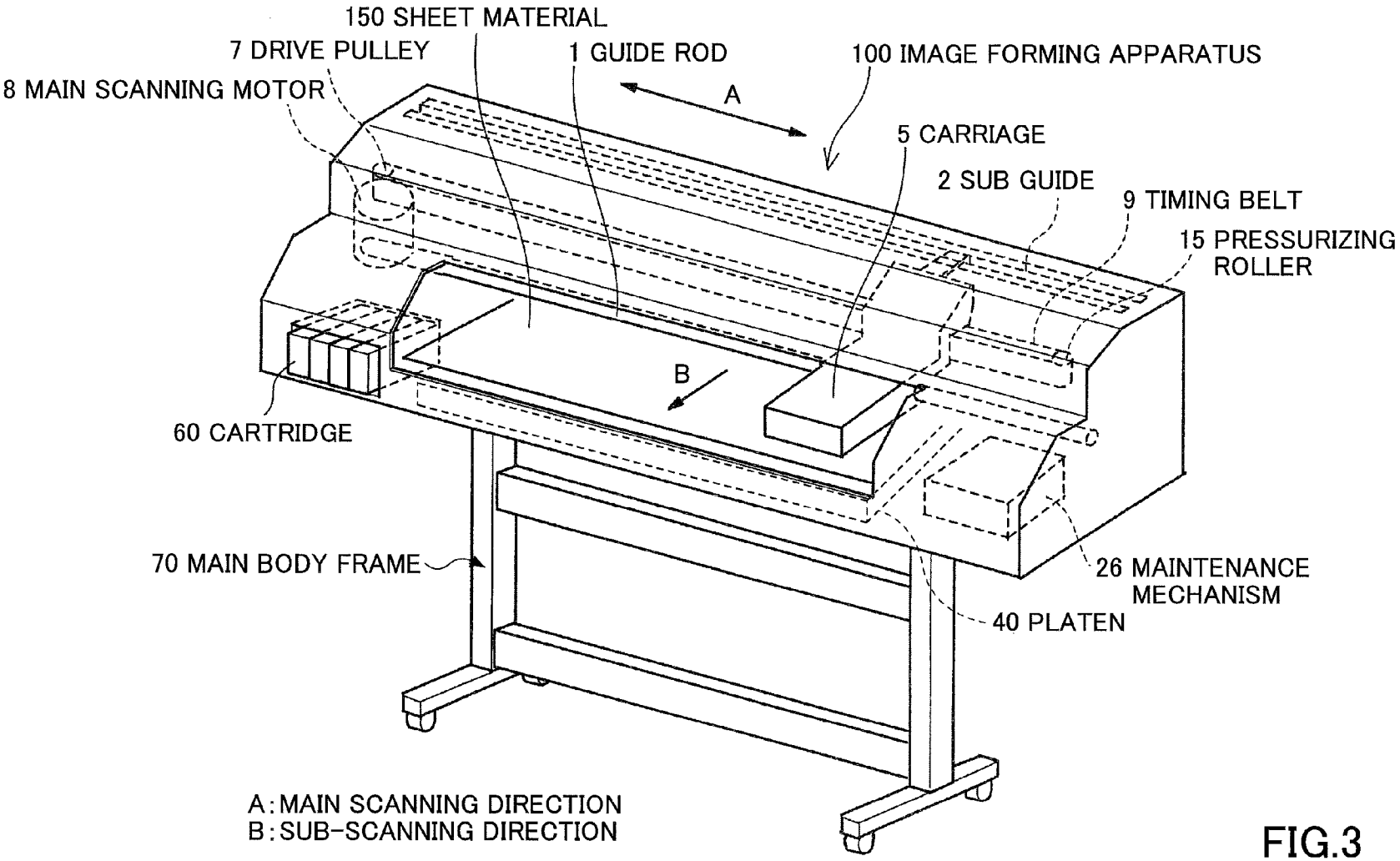
FIG. 3 is an exemplary schematic perspective view of a serial-type image forming apparatus.

FIG. 3 illustrates an exemplary schematic perspective view of a serial-type image forming apparatus 100. The image forming apparatus 100 is supported by a main body frame 70. A guide rod 1 and a sub guide 2 are bridged across in a longitudinal direction of the image forming apparatus 100, and a carriage 5 is held in arrow A directions (main scanning directions) by the guide rod 1 and the sub guide 2 such that it can move in both directions.

Moreover, an endless belt-shaped timing belt 9 is stretched by a drive pulley 7 and a pressurizing roller 15 in the main scanning directions, and a part of the timing belt 9 is fixed to the carriage 5. Moreover, the drive pulley 7 is rotationally driven by a main scanning motor 8, thereby moving the timing belt 9 in the main scanning directions and also moving the carriage 5 in both directions. With the tension being applied to the timing belt 9 by the pressurizing roller 15, the timing belt 9 may drive the carriage 5 without slack.

Moreover, the image forming apparatus 100 includes a cartridge 60 which supplies ink and a maintenance mechanism 26 which maintains and cleans a recording head.

A sheet material 150 is intermittently conveyed on a platen 40 on the lower side of the carriage 5 in an arrow B direction (a sub-scanning direction) by a roller (not shown). The sheet material 150 may be a recording medium onto which liquid droplets can be attached, such as an electronic substrate, a film, a glossy paper, a plain paper such as a sheet of paper, etc. For each conveying position of the sheet material 150, the carriage 5 moves in the main scanning directions and the recording head mounted on the carriage 5 ejects the liquid droplets. When the ejecting is finished, the sheet material 150 is again conveyed and the carriage 5 moves in the main scanning directions to eject the liquid droplets. The above process is repeated to form an image on the whole face of the sheet material 150.

Figure 4:
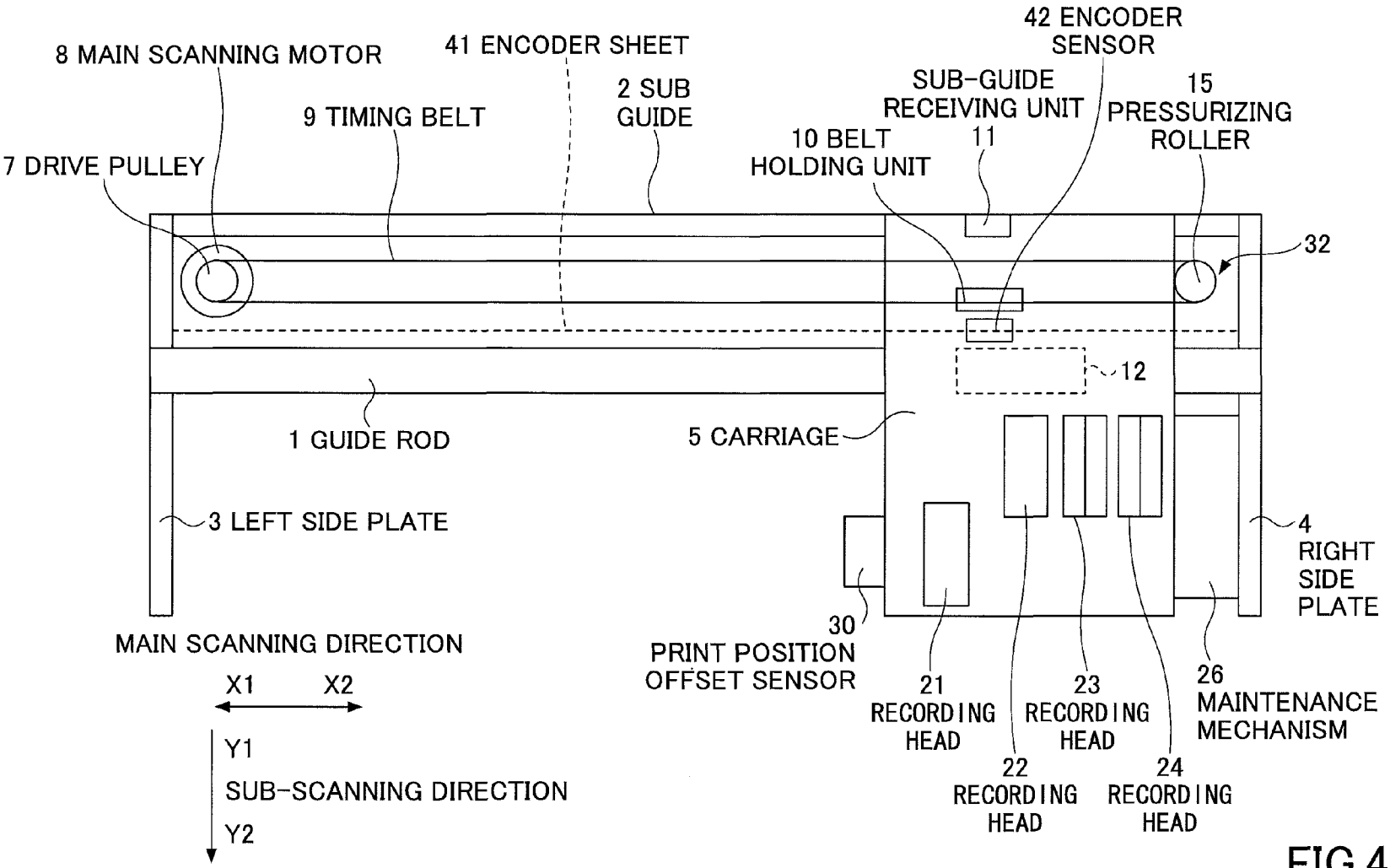
FIG. 4 is an exemplary diagram which describes in more detail an operation of a carriage.

FIG. 4 is an exemplary diagram which describes in more detail operations of the carriage 5. The above-described guide rod 1 and the sub rod 2 are bridged across a left side plate 3 and a right side plate 4, and the carriage 5 is held by bearings 12 and a sub-guide receiving unit 11 to be able to freely slide on the guide rod 1 and the sub-guide 2, so that it can move in arrows X1 and X2 directions (main scanning directions).

On the carriage 5 are mounted recording heads 21 and 22 which eject black (K) liquid droplets, and recording heads 23 and 24 which eject ink droplets of cyan (C), magenta (M), and yellow (Y). The recording head 21 is so arranged since the black is often used alone, so that it may be omitted.

As the recording heads 21-24, a so-called piezo-type recording head is employed in which piezoelectric elements are used as pressure generating units (an actuator unit). Each of the elements pressurizes ink within an ink flow path (a pressure generating chamber) by deforming a vibrating plate. The plate forms a wall face of the ink flow path to change a volume within the ink flow path to cause an ink droplet to be ejected. Alternatively, a so-called thermal-type recording head is employed which ejects ink droplets with pressure due to using a heat generating resistive body to heat ink within each of the ink channel paths to generate foam. As another alternative, an electrostatic-type recording head is employed in which sets of a vibrating plate and an electrode, which form a wall face of the ink flow path, are arranged so that they oppose each other, and the vibrating plate is deformed due to an electrostatic force generated between the vibrating plate and the electrode, etc., to change a volume within the ink flow path to cause an ink droplet to be ejected.

A main scanning mechanism 32 which moves the carriage 5 to scan includes the main scanning motor 8 which is arranged on one side in the main scanning directions, the drive pulley 7 which is rotationally driven by the main scanning motor 8, the pressurizing roller 15 which is arranged on the other side in the main scanning directions, and the timing belt 9 which is bridged across the drive pulley 7 and the pressurizing roller 15. The pressurizing roller 15 has tension acting outward (in a direction away from the drive pulley 7) by a tension spring (not shown).

The timing belt 9 has a portion fixed to and held by a belt holding unit 10 which is provided on a back face side of the carriage 5, so that it pulls the carriage 5 in the main scanning directions with an endless movement of the timing belt 9.

Moreover, with an encoder sheet 41 arranged such that it follows the main scanning directions of the carriage 5, an encoder sensor 42 the carriage 5 is provided with may read slits of the encoder sheet 41 to detect a position of the carriage 5 in the main scanning directions. When the carriage 5 is in a recording area of a main scanning area, the sheet material 150 is intermittently conveyed in an arrow-indicated Y1 to Y2 direction (a sub-scanning direction) which is orthogonal to the main scanning directions of the carriage 5 by a paper-conveying mechanism (not shown).

The above-described image forming apparatus 100 according to the present embodiment may drive the recording heads 21-24 according to image information to eject liquid droplets while moving the carriage 5 in the main scanning directions and intermittently convey the sheet material 150 to form a required image on the sheet material 150.

On one side face of the carriage 5 is mounted a print position offset sensor 30 for detecting an offset of an ink impacting position (reading the test pattern). The print position offset sensor 30 reads the test pattern for detecting the impacting position that is formed on the sheet material 150 with a light receiving element which includes a reflective-type photosensor and a light-emitting element such as an LED, etc.

As the print position offset sensor 30 is for the recording head 21, a liquid droplet ejection timing of the recording heads 22-24 is adjusted, so it is preferable to mount a separate print position offset sensor 30 parallel to the recording heads 22-24. Moreover, the carriage 5 may have mounted a mechanism which slides the print position offset sensor 30 such that it becomes in parallel with the recording heads 22-24 to adjust a liquid droplet ejection timing of the recording heads 22-24 with one print position offset sensor 30. Alternatively, the liquid droplet ejection timing of the recording heads 22-24 may be adjusted with the one print position offset sensor 30 even when the image forming apparatus 100 conveys the sheet material 150 in a reverse direction.

Figure 5:
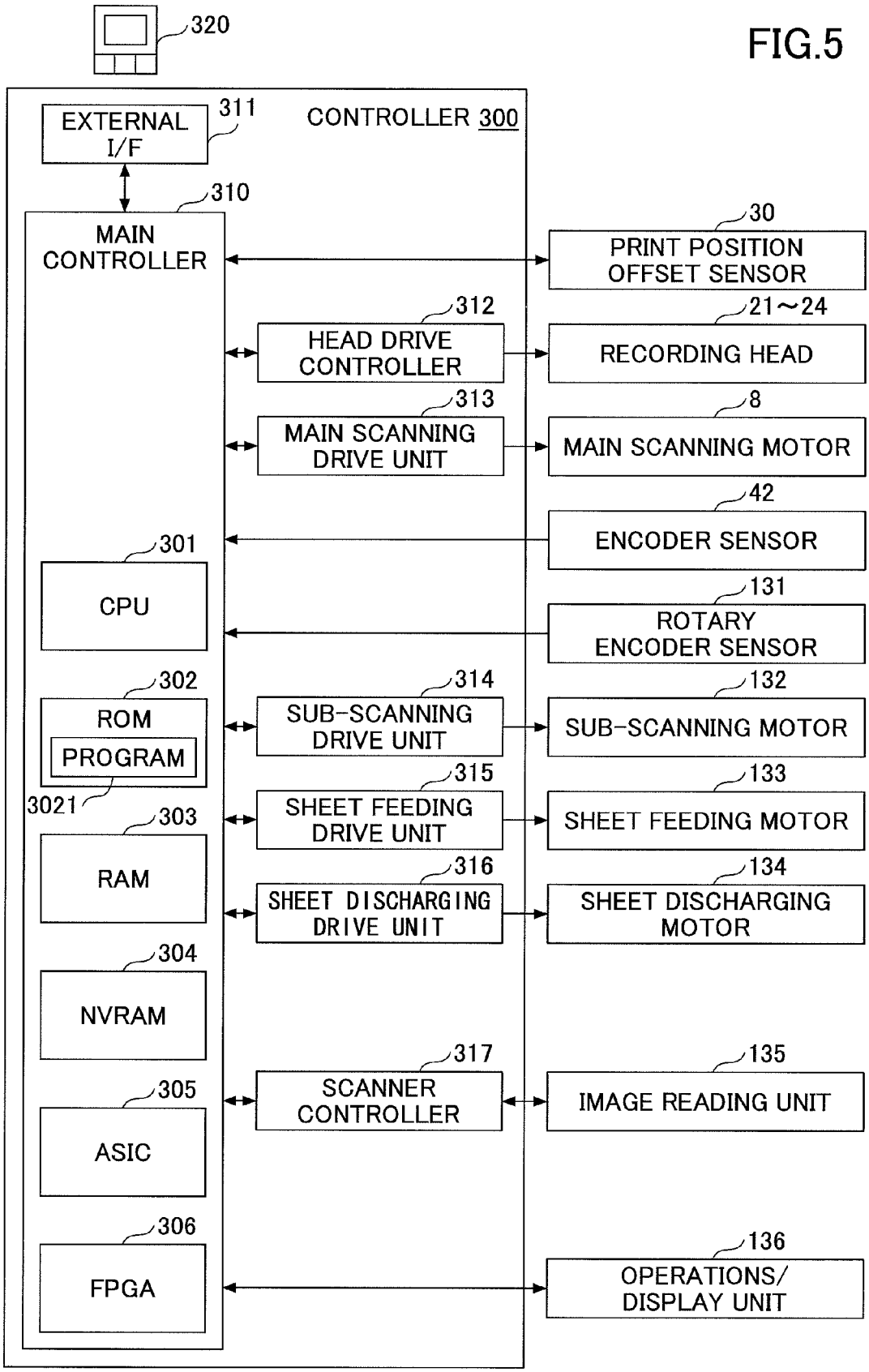
FIG. 5 is an exemplary block diagram of a controller of an image forming apparatus.

FIG. 5 is an exemplary block diagram of a controller 300 of the image forming apparatus 100. The controller 300 includes a main controller 310 and an external I/F 311. The main controller 310 includes a CPU 301, a ROM 302, a RAM 303, a NVRAM 304, an ASIC 305, and a FPGA (Field programmable gate array) 306. The CPU 301 executes a program 3021 which is stored in the ROM 302 to control the whole of the image forming apparatus 100. In the ROM 302 is stored, besides the program 3021, fixed data such as a parameter for control, an initial value, etc. The RAM 303 is a working memory which temporarily stores a program, image data, etc., while the NVRAM 304 is a non-volatile memory for storing data such as a setting condition, etc., even during a time a power supply of the apparatus is being blocked. The ASIC 305 performs various signal processing, sorting, etc., on the image data and controls various engines. The FPGA 306 processes input and output signals for controlling the whole apparatus.

The main controller 310 manages control with respect to forming a test pattern, detecting the test pattern, adjusting (correcting) an impacting position, etc., as well as control of the whole apparatus. As described below, in the present embodiment, while mainly the CPU 301 executes the program 3021 stored in the ROM 302 to detect an edge position, some or all thereof may be performed by an LSI, such as the FPGA 306, the ASIC 305, etc.

The external I/F 311, which is a bus or a bridge for connecting to an IEEE 1394 port, a USB, and a communications apparatus for communicating with other equipment units connected to a network. Moreover, the external I/F 311 externally outputs data generated by the main controller 310. To the external I/F 311 can be connected a detachable storage medium 320, and the program 3021 may be stored in the recording medium 320 or distributed via an external communications apparatus.

Moreover, the controller 300 includes a head drive controller 312, a main scanning drive unit 313, a sub-scanning drive unit 314, a sheet feeding drive unit 315, a sheet discharging drive unit 316, and a scanner controller 317. The head drive controller 312 controls for each of the recording heads 21-24 whether an ejection is made, and a liquid droplet ejection timing and an ejection amount in case the ejection is made. The head drive controller 312, which includes an ASIC (a head driver) for generating, aligning, and converting head data for driving and controlling the recording heads 21-24, generates, based on printing data (dot data to which a dithering process, etc., is applied), a drive signal which indicates the presence/absence of the liquid droplets and sizes of the liquid droplets to supply the generated drive signal to the recording heads 21-24. With the recording heads 21-24 including a switch for each nozzle and being turned on and off based on the drive signal, the recording heads 21-23 eject liquid droplets of specified sizes to impact at positions on the sheet material 150 specified by the printing data. The head driver of the head drive controller 312 may be provided on the recording heads 21-24 side or the head drive controller 312 and the recording heads 21-24 may be integrated. The configuration shown is an example.

The main scanning drive unit (a motor driver) 313 drives the main scanning motor 8 which moves the carriage 5 to scan. To the main controller 310 is connected an encoder sensor 42 which detects the above-described carriage position, and the main controller 310 detects a position in the main scanning directions of the carriage 5 based on this output signal. Then, the main scanning motor 8 is driven and controlled via the main scanning drive unit 313 to move the carriage 5 in both of the main scanning directions.

The sub-scanning drive unit (motor driver) 314 drives a sub-scanning motor 132 for conveying the sheet of paper. To the main controller 310 is input an output signal (a pulse) from a rotary encoder sensor 131 which detects an amount of movement in the sub-scanning direction, and the main controller 310, based on this output signal, detects an amount of sheet conveying, and drives and controls the sub-scanning motor 132 via the sub-scanning drive unit 314 to convey the sheet material via a conveying roller (not shown).

The sheet feeding drive unit 315 drives a sheet feeding motor 133 which feeds the sheet material from a sheet feeding tray. The sheet discharging drive unit 316 drives a sheet discharging motor 134 which drives a roller for discharging a printed sheet material 150 onto the platen. The sheet discharging drive unit 316 may be replaced with the sub-scanning drive unit 314.

The scanner controller 317 controls an image reading unit 135. The image reading unit 135 optically reads a manuscript and generates image data.

Moreover, to the main controller 310 is connected an operations/display unit 136 which includes various displays and various keys such as ten keys, a print start key, etc. The main controller 310 accepts a key input which is operated by a user via the operations/display unit 136, displays a menu, etc.

In addition, although not shown, it may also include a recovery drive unit for driving a maintenance and recovery motor which drives the maintenance mechanism 26, a solenoid drive unit (driver) which drives various solenoids (SOLS), and a clutch drive unit which drives electromagnetic cracks, etc. Moreover, a detected signal of various other sensors (not shown) is also input to the main controller 310, but illustrations thereof are omitted.

The main controller 310 performs a process of forming the test pattern on the sheet material and performs light emission drive control on the formed test pattern, which causes a light emitting element of the print position offset sensor 30 mounted on the carriage 5 to emit a light. Then, an output signal of the light receiving element is obtained, the reflected light of the test pattern is electrically read, an impacting position offset amount is detected from the read results, and, furthermore, a control process is performed in which a liquid droplet ejection timing of recording heads 21-24 is corrected based on the impacting position offset amount such that there would be no impacting position offset.

(Correction of Impacting Position Offset)

Figure 6:
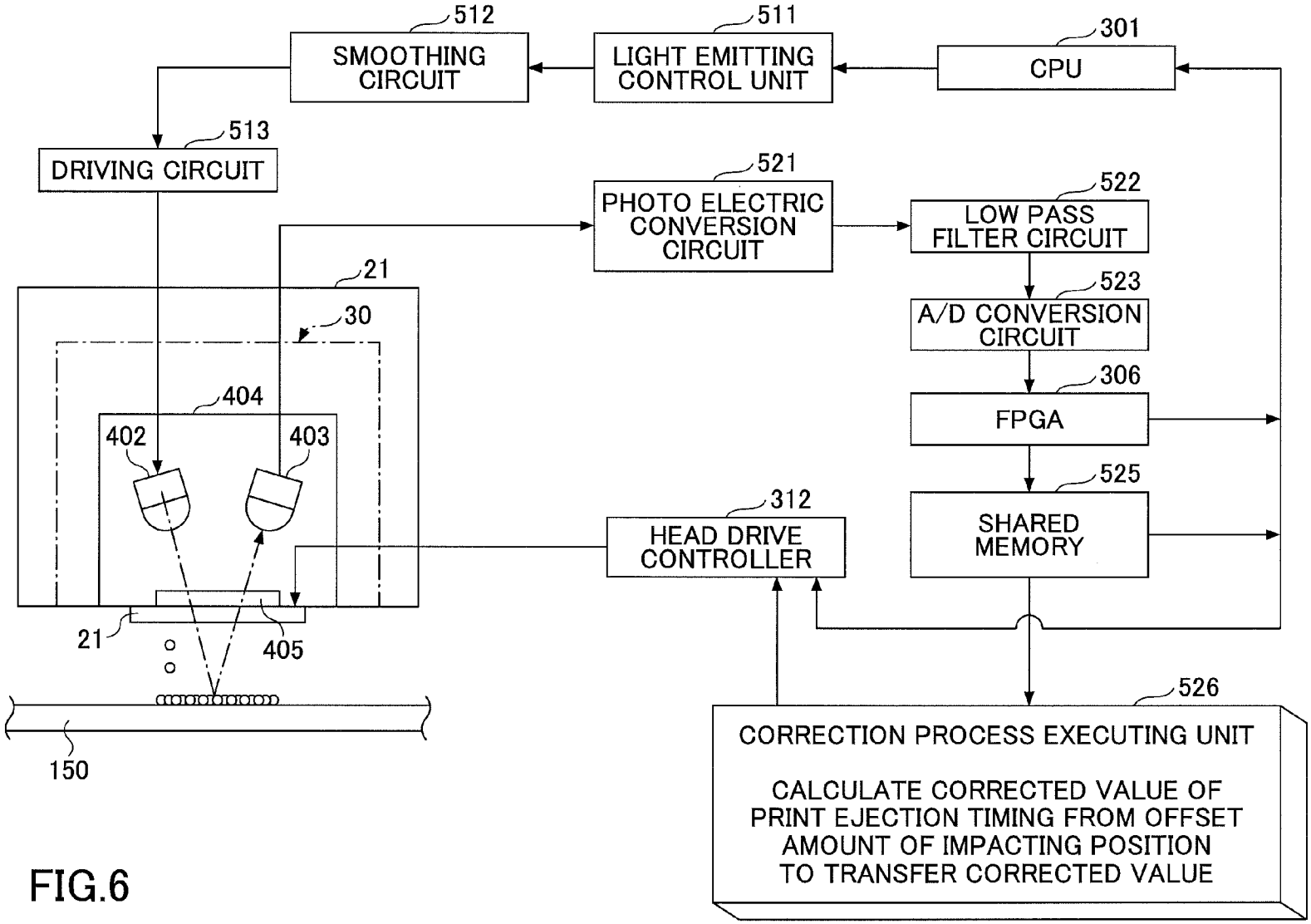
FIG. 6 is an exemplary diagram which schematically shows a configuration for a print position offset sensor to detect an edge of the test pattern.

FIG. 6 is an exemplary diagram which schematically shows a configuration for the print position offset sensor 30 to detect an edge position of a test pattern. FIG. 6 shows the recording head 21 and the print position offset sensor 30 in FIG. 4 that are viewed from the right side face plate 4.

The print position offset sensor 30 includes a light emitting element 402 and a light receiving element 403 which are aligned in a direction orthogonal to the main scanning directions. Arrangements of the light emitting element 402 and the light receiving element 403 may be reversed. The light emitting element 402 projects a below-described spotlight onto a test pattern, so that the light receiving element 403 receives a light reflected to the sheet material 150, a reflected light from the platen 40, other scattered lights, etc. The light emitting element 402 and the light receiving element 403 are fixed to inside a housing and a face, which opposes the platen 40, of the print position offset sensor 30 is shielded from outside with a lens 405. In this way, the print position offset sensor 30 is packaged, so that it may be distributed as a unit.

Within the print position offset sensor 30, the light emitting element 402 and the light receiving element 403 are arranged in a direction which is orthogonal to a scanning direction of the carriage 5 (are arranged in a direction parallel to the sub-scanning direction). This makes it possible to reduce an impact, on detected results, of a moving speed change of the carriage 5.

The light emitting element 402 may be an LED, for example, with a light-emitting wavelength of a peak being 563 nm, which correspond to a green color. Moreover, the light receiving element 403 has a peak light receiving sensitivity wavelength of 560 nm to align with the light emitting element. The reason such wavelengths are adopted is that, for ink colors of the test patterns of K, M, and C, a wavelength at which reflectances of both M and C ink colors become low (M and C ink colors tend to absorb) is around 560 nm. Therefore, when the ink color is other than the above-listed colors of K, M, and C, the wavelength of the light emitting element 402 may also be designed as needed.

Moreover, a diameter of a spot formed by the light emitting element 402 is in the order of several mm for using an inexpensive lens without using a high accuracy lens. For this spot diameter, which is related to accuracy of detecting an edge of a test pattern, even when it is in the order of several mm, an edge position may be detected with sufficiently high accuracy as long as the edge position is determined according to the present embodiment. The spot diameter can also be made smaller.

When a certain timing is reached, the CPU 301 starts an impacting position offset correction. The above-mentioned timing includes, for example, a timing at which an impacting position offset correction is issued from the operations/display unit 136 by the user; a timing at which a material is determined by the CPU 301 to be made of a certain sheet material 150 as an intensity of a light reflected at the time the light emitting element 402 emits a light before ink is ejected is no more than a predetermined value; or a timing at which either temperature or humidity, a value of which is stored when an impacting position offset correction is performed, is offset by at least a threshold value, a periodic (daily, weekly, monthly, etc.) timing, etc.

Now, forming the test pattern is described. The CPU 301 instructs the main scanning controller 313 to move the carriage 5 in both directions and instructs the head drive controller 312 to eject liquid droplets with a predetermined test pattern as printing data. While the main scanning controller 313 moves the carriage 5 in both of the main scanning directions relative to the sheet material 150, the head drive controller 312 causes liquid droplets to be ejected from the recording head 21 to form a test pattern which includes at least two independent lines.

Moreover, the CPU 301 performs control for reading, by the print position offset sensor 30, the test pattern formed on the sheet material 150. More specifically, a PWM value for driving the light emitting element 402 of the print position offset sensor 30 is set in a light-emitting controller 511 by the CPU 301, and an output of the light-emitting controller 511 is smoothed at a smoothing circuit 512, so that the smoothed result is provided to a driving circuit 513. The driving circuit 513 drives the light emitting element 402 to emit a light, so that the spotlight is irradiated from the light emitting element 402 onto the test pattern of the sheet material 150. The light emitting controller 511, the smoothing circuit 512, the driving circuit 513, a photoelectric conversion circuit 521, a low-pass filter 522, an A/D conversion circuit 523, and a correction process executing unit 526 are installed in the main controller 310 or the controller 300. The shared memory 525 is the RAM 303, for example.

The spotlight from the light emitting element 402 is irradiated onto the test pattern on the sheet material, so that a reflected light which is reflected from the test pattern is incident on the light receiving element 403. The light receiving element 403 outputs an intensity signal of the reflected light to the photoelectric conversion circuit 521. More specifically, the photoelectric conversion circuit 521 photoelectrically converts the intensity signal so as to output the photoelectrically converted signal to the low-pass filter circuit 522. The low-pass filter circuit 522 removes a high-frequency noise portion and then outputs the photoelectrically converted signal to the A/D conversion circuit 523. The A/D conversion circuit 523 A/D converts the photoelectrically converted signal and outputs the A/D converted signal to the signal processing circuit (FPGA) 306. The signal processing circuit (FPGA) 306 stores the detected voltage data sets which are digital values of the A/D converted detected voltage into the shared memory 525.

The correction process executing unit 526 reads the detected voltage data sets stored in the shared memory 525, performs an impacting position offset correction, and sets them in the head drive controller 312. In other words, the correction process executing unit 526 detects an edge position of the test pattern to compare it with an optimal distance between two lines to calculate the impacting position offset amount.

The correction process executing unit 526 calculates a correction value of a liquid droplet ejection timing at which the recording head 21 is driven such that the impacting position offset is removed to set the calculated correction value of the liquid droplet ejection timing in the head drive controller 312. In this way, when driving the recording head 21, the head drive controller 312 corrects the liquid droplet ejection timing based on the correction value to drive the recording head 21, making it possible to reduce the impacting position offset of the liquid droplets.

Figure 7:
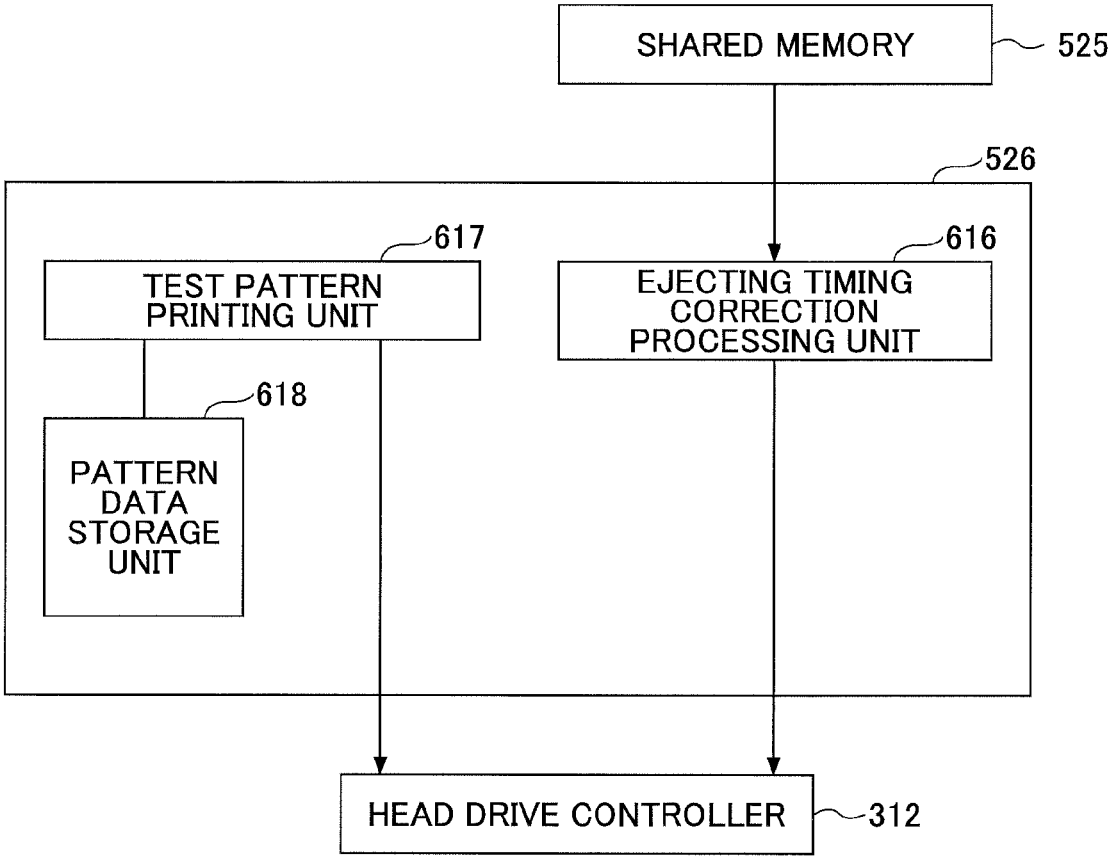
FIG. 7 is an exemplary functional block diagram of a correction process executing unit.

FIG. 7 is an exemplary functional block diagram of the correction process executing unit 526. The correction process executing unit 526 includes a test pattern printing unit 617 and an ejection timing correction processing unit 616. The test pattern printing unit 617 reads pattern data of the test pattern for each ink color from a test pattern storage unit 618, and drives the head drive controller 312. In this way, the drawing density of liquid droplets of ink ejected by recording heads 22-24 is changed for each ink color. The ejection timing correction processing unit 616 corrects the liquid droplet ejection timing based on the impacting position offset amount which is determined from the edge position of the test pattern. These processes will be described below in detail.

(Spotlight Position and Edge Position)

Next, a relationship between the spotlight and the edge position is described using FIGS. 8, 9A, 9B, 9C, and 9D.

Figure 8:
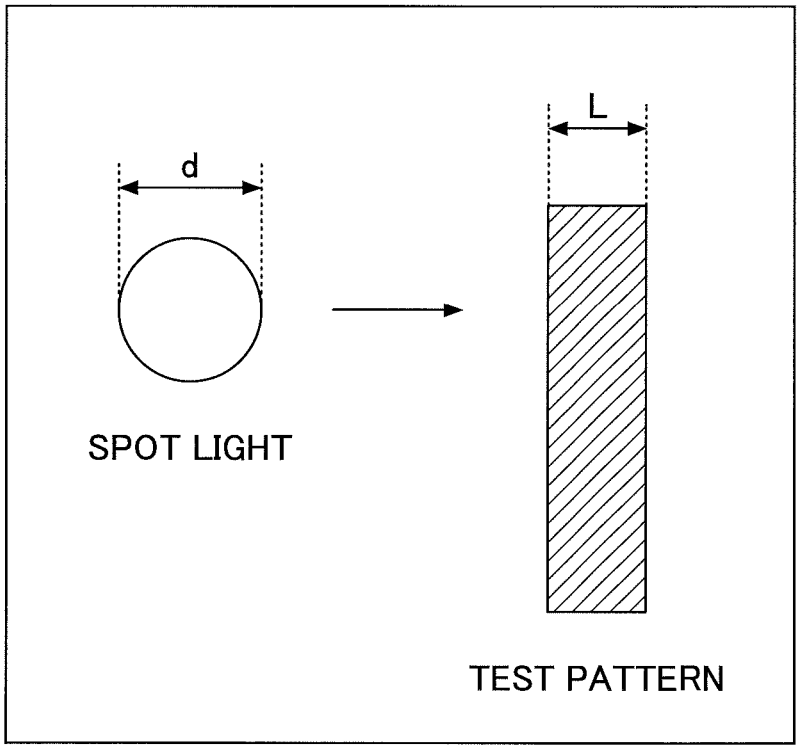
FIG. 8 is a diagram illustrating an example of a spotlight and the test pattern.

FIG. 8 is a diagram illustrating an example of the spotlight and the test pattern. The spotlight moves such that it crosses multiple lines (one line shown) which make up a test pattern at a constant speed (equal speeds) in the same direction as a moving direction of the carriage 5; however, the speed of the crossing may be arranged to be variable in the image forming apparatus according to the present embodiment. As a sheet material such as a sheet of paper moves in a longer direction of the line through sheet feeding, the spotlight moves in a direction oblique to an edge of the line; however, even when the sheet material stops, the method of specifying the edge position is the same. With the sheet material and the spotlight of a common wavelength, it can be said that a reflected light of the spotlight decreases the larger an overlapping area of the test pattern becomes.

In FIGS. 8, 9A, 9B, 9C, and 9D, it is assumed that Spot diameter d=Line width L of a test pattern. In actuality, while a spotlight becomes somewhat elliptical, it has a long axis parallel to the test pattern, so that the shape of the spotlight has almost no impact on detection accuracy of the edge position.

Figure 9A:
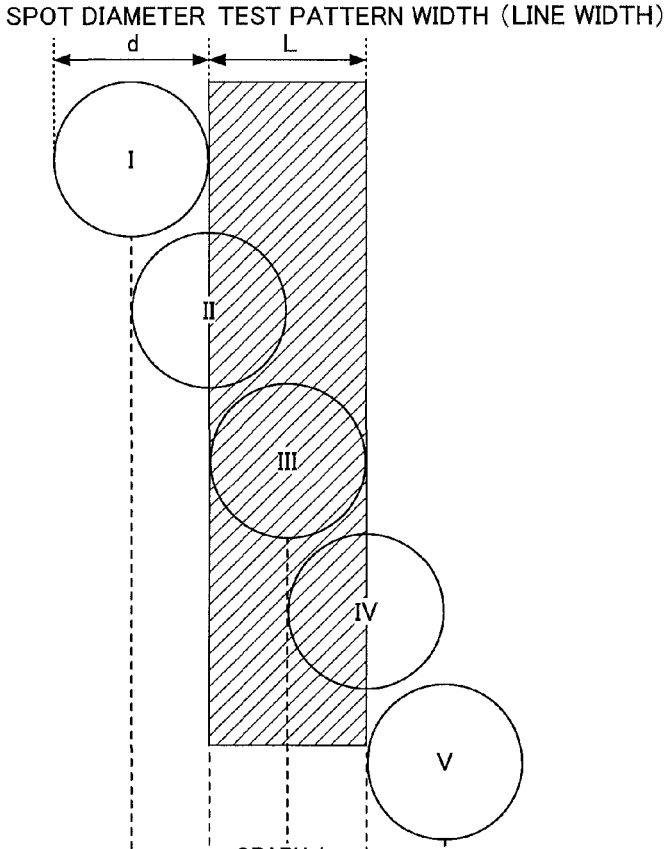
FIGS. 9A, 9B, 9C, and 9D are diagrams illustrating an example of the spotlight and the test pattern.

FIGS. 9A, 9B, 9C, and 9D are exemplary diagrams which describe an outline for specifying the edge position of the present embodiment. Letters I-V in FIG. 9A show a time lapse, where an elapsed time is longer for the lower spotlight:

Time I: The spotlight and the test pattern do not overlap;

Time II: A half of the spotlight overlaps the test pattern. At this moment, a rate of decrease of the reflected light becomes the largest. (An overlapping area positively changes most in a unit time);

Time III: The whole of the spotlight overlaps the test pattern. At this moment, an intensity of the reflected light becomes the smallest; and Time IV: A half of the spotlight overlaps the test pattern. At this moment, a rate of increase of the reflected light becomes the largest (The overlapping area negatively changes most in the unit time.)

Time V: The spotlight passes through the test pattern, so that the spotlight does not overlap the test pattern.

A centroid of the spotlight matches the edge position of the line of the test pattern at the Times II and IV. Therefore, if the relationship between the spotlight and the line at the Times II and IV can be detected from the reflected light, the edge position may be specified accurately.

Figure 9B:
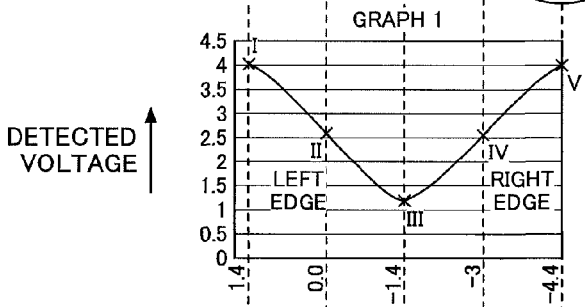
Figure 9C:
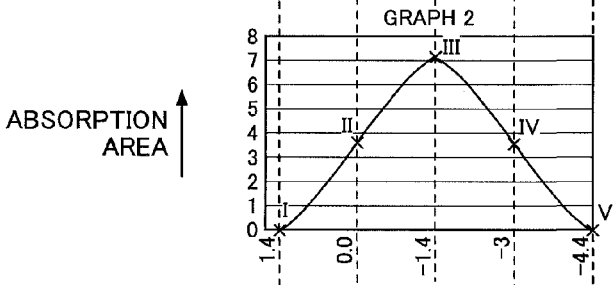
Figure 9D:
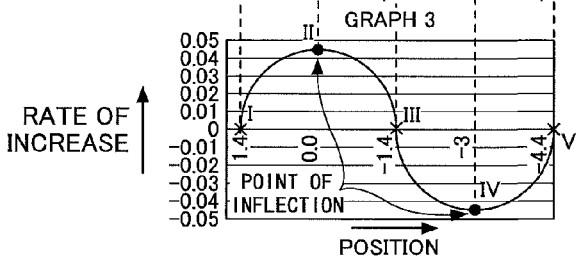

FIG. 9B shows an exemplary detected voltage of a light receiving element, FIG. 9C shows an exemplary absorption area (an overlapping area of the spotlight and the test pattern), and FIG. 9D shows an exemplary rate of increase of the absorption area, which rate of increase is a derivative of the absorption area. For FIG. 9D, equivalent information may be obtained even when a derivative of an output waveform of FIG. 9B is taken. Moreover, the absorption area may be calculated from the detected voltage, for example, but it does not have to be an absolute value, so that, for the absorption area of FIG. 9C, the same waveform as the absorption area may be obtained by subtracting the detected voltage of FIG. 9B from a predetermined value.

As described above, the rate of decrease of the reflected light in the Time II becomes the largest (the overlapping area positively changes most in a unit time), and the rate of increase of the reflected light in the Time IV becomes the largest (the overlapping area negatively changes most in the unit time). Then, as shown in FIG. 9D, a point at which the rate of increase changes from an increasing trend to a decreasing trend matches the Time II and a point at which the rate of increase changes from the decreasing trend to the increasing trend matches the Time IV.

The point at which a change from the positive trend to the negative trend occurs or the reverse occurs is a point at which a turning direction changes in a curved line on a plane, or a point of inflection. In light of the above, when an output signal demonstrates the point of inflection, it means that the spotlight matches the edge position of the test pattern. Therefore, when the point of inflection is accurately detected, the position of the edge may also be accurately specified.

(Specification of Edge Position)

Figure 10A:
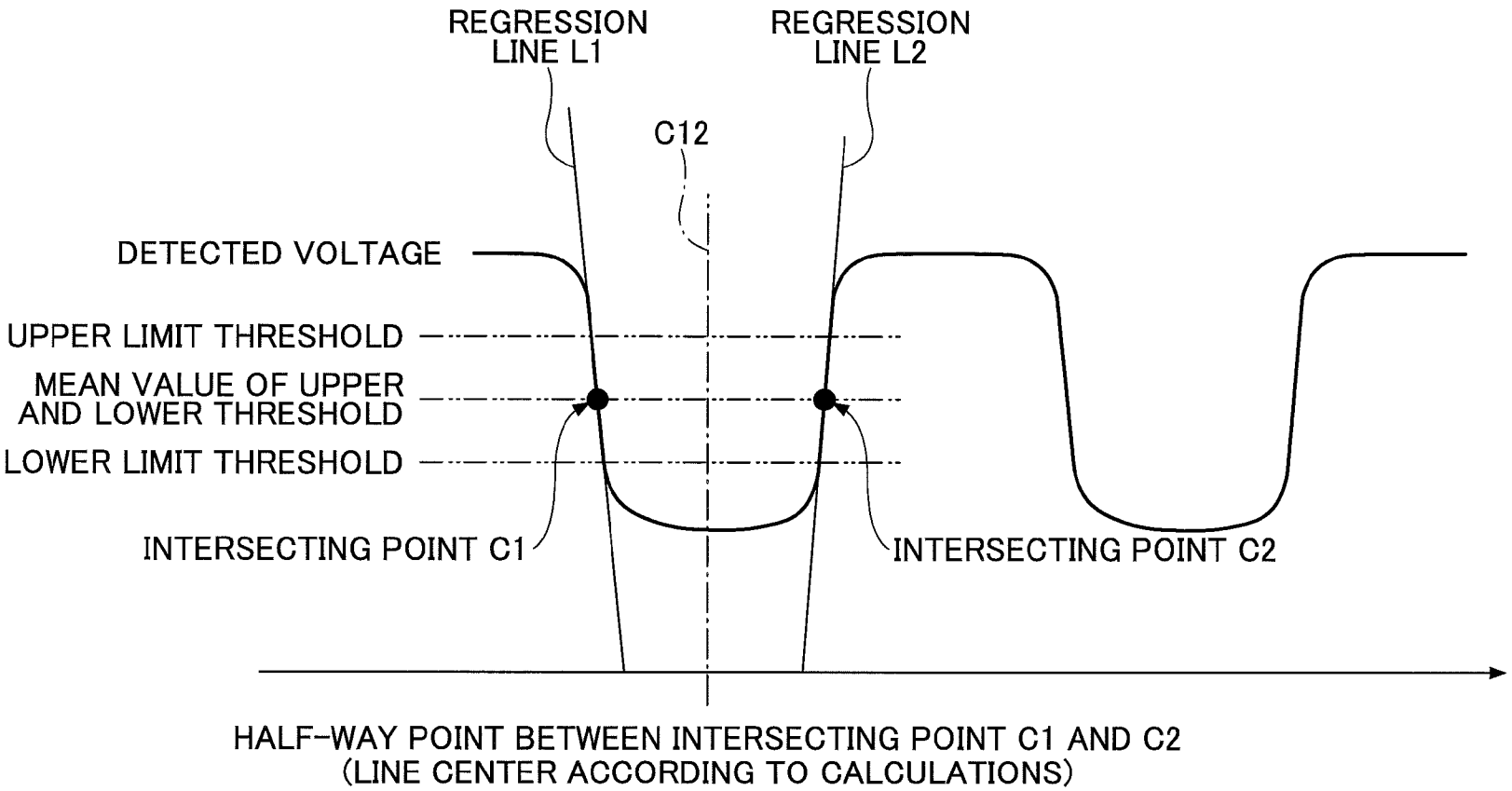
FIGS. 10A and 10B are exemplary diagrams which describe a method of specifying an edge position.
Figure 10B:
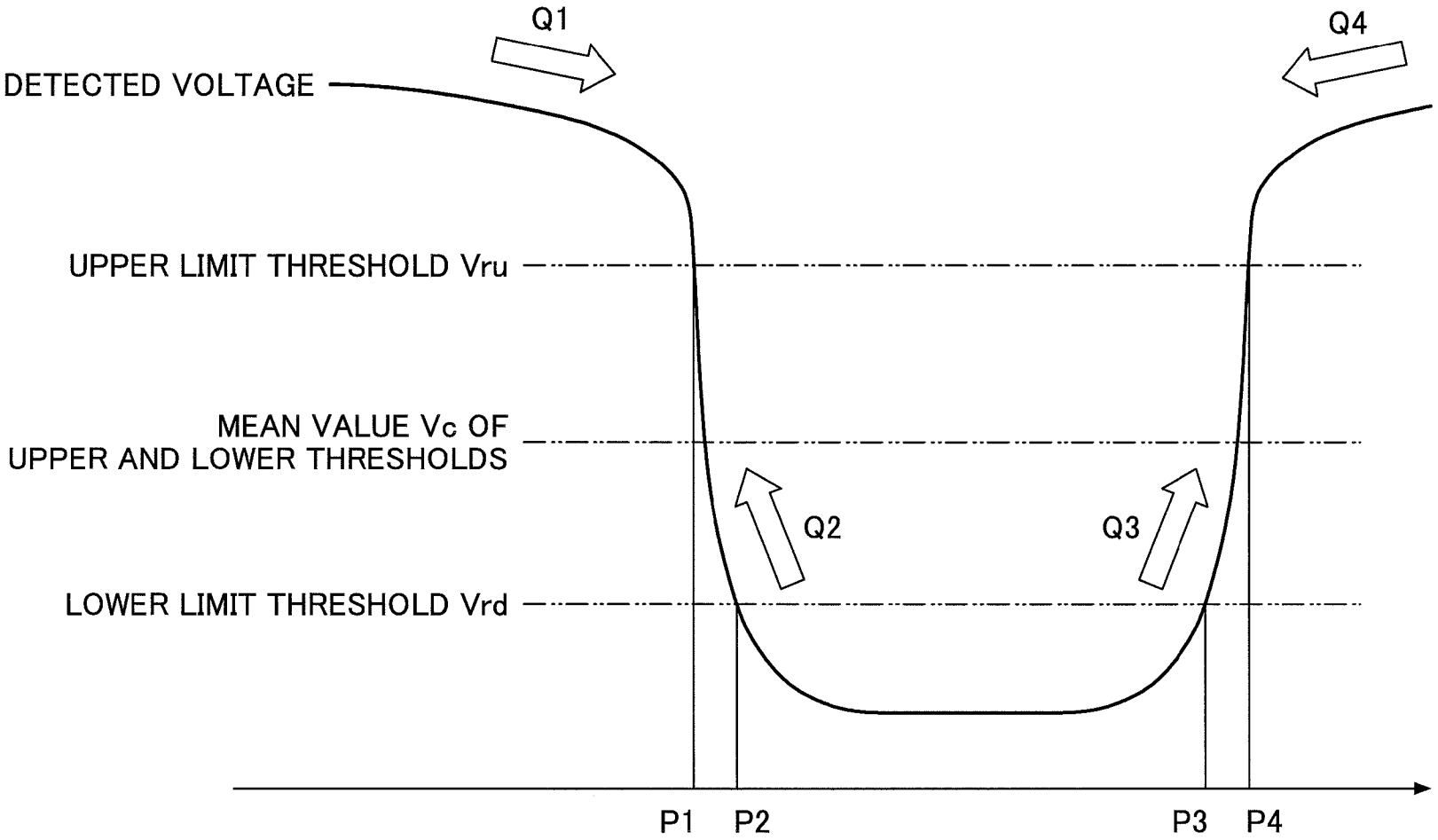

FIGS. 10A and 10B are exemplary diagrams which describe a method of specifying an edge position. FIG. 10A shows a schematic diagram of a detected voltage, while FIG. 10B shows an expanded view of the detected voltage. An approximate value of a point of inflection may be experimentally determined by the ejection timing correction process executing unit 526 or a developer. As described above, it is a position at which a slope is closest to zero when a derivative of the detected voltage or the absorption area is taken, for example.

An upper limit threshold Vru and a lower limit threshold Vrd of the detected voltage are predetermined such that this point of inflection is included. As described below, the CPU 301 calibrates an output of the light emitting element 402 and a sensitivity of the light receiving element 403 such that the detected voltage takes almost the same specific value (below-described 4 V) for a region without a test pattern. A correction of the drawing density of the present embodiment may cause local maximum values of the detected voltage to take almost the same constant value, so that the point of inflection is included between the upper limit threshold Vru and the lower limit threshold Vrd.

The ejection timing correction unit 616 searches a falling portion of the detected voltage in an arrow-indicated Q1 direction to store a point at which the detected voltage is no less than the lower limit threshold Vrd as a point P2. Next, it searches the same in an arrow-indicated direction Q2 from the point P2 to store a point at which the detected voltage is no greater than the upper limit threshold Vru as a point P1.

Then, using multiple detected voltage data sets between the point P1 and the point P2, a regression line L1 is calculated and an intersecting point of the regression line L1 and a mean value Vc of the upper and lower thresholds is calculated and is set as an intersecting point C1.

Similarly, the ejection timing correction unit 616 searches a rising portion of the detected voltage in an arrow-indicated Q3 direction to store a point at which the detected voltage is no greater than the upper limit threshold Vru as a point P4. Next, it searches the same in an arrow-indicated direction Q4 from the point P4 to store a point at which the detected voltage is no less than the lower limit threshold Vrd as a point P3.

Then, using multiple detected voltage data sets between the point P3 and the point P4, a regression line L2 is calculated and an intersecting point of the regression line L2 and a mean value Vc of the upper and lower thresholds is calculated and is set as an intersecting point C2. The intersecting points C1 and C2 are edge positions of two lines, so that a midpoint between the intersecting points C1 and C2 is a line center.

Thereafter, the ejection timing correction unit 616 determines the line center of multiple lines and calculates a difference between an ideal distance between the two lines of the test pattern and a distance between the line centers. This difference is the impacting position offset amount since it is an offset of a position of an actual line relative to a position of an ideal line. Based on the calculated impacting position offset amount, the ejection timing correction unit 616 calculates a correction value for correcting a timing for causing liquid droplets to be ejected from the recording head 21 (a liquid droplet ejection timing) and sets the correction value in the head drive controller 312. In this way, the head drive controller 312 drives the recording head 21 with the corrected liquid droplet ejection timing, so that the impacting position offset is reduced.

(Accuracy Decreasing Factor)

In this way, for detecting an edge using detected voltage data between an upper limit threshold and a lower limit threshold, the edge cannot be detected unless a point of inflection is included between the upper limit threshold and the lower limit threshold. A width formed by the upper limit threshold and the lower limit threshold (two thresholds) is called a "threshold area". The threshold area, which has the detected voltage as a unit, may also be defined as an absorption area which corresponds to the detected voltage.

Figure 11:
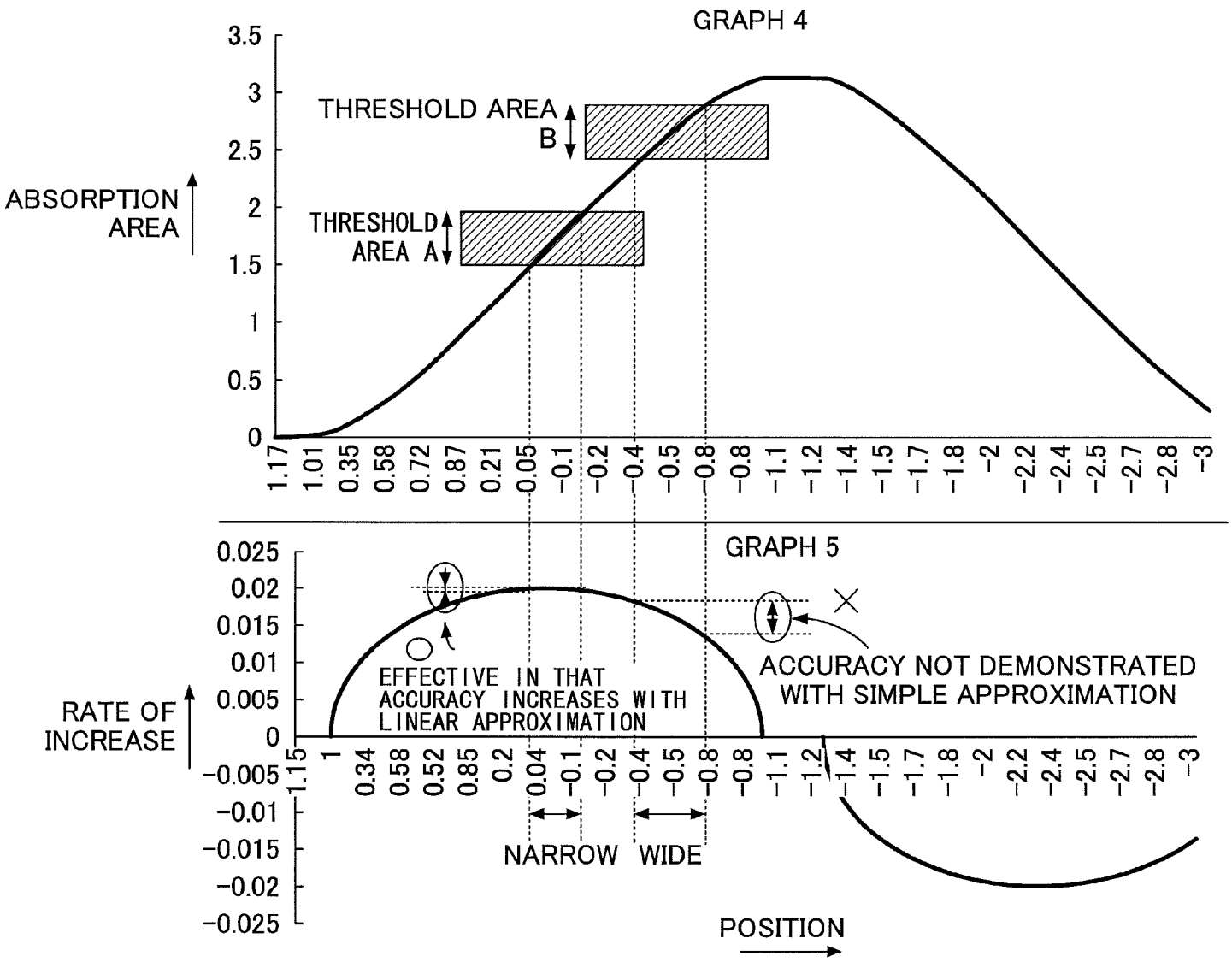
FIG. 11 is a diagram illustrating examples of an absorption area and an increase rate of the absorption area.

FIG. 11 is a diagram illustrating examples of an absorption area and an increase rate of the absorption area. As described in FIG. 8, when there is a point of inflection in a threshold area A in FIG. 11, the ejection timing correction unit 616 may accurately detect an edge position.

On the other hand, when there is a point of inflection in a threshold area B in FIG. 11, the ejection timing correction unit 616 may not detect an accurate edge position even though a regression line is determined from the threshold area A. Moreover, if it is known that a point of inflection is in the threshold area B, the threshold area may be moved from A to B in order for the ejection timing correction unit 616 to determine the regression line; however, a position of the point of inflection being greatly offset means that curves of the absorption area and the detected voltage could be deformed. For example, when the ejection timing correction unit 616 determines a regression line from a threshold area with a large slope of the curve, the intersecting points C1 and C2 may also be greatly offset. This is indicated by a lower portion of FIG. 11 showing that, while a width of a position which includes the vicinity of an apex may be estimated in a sufficiently narrow range in the threshold area A, it is difficult to estimate a width of a position which includes the vicinity of a point of inflection (which is not within a threshold area B in FIG. 11).

Therefore, it is seen that, when an amplitude of the detected voltage changes such that a point of inflection is not in the threshold area A, it is not preferable to specify an edge position from the threshold area A or to move a threshold area such that a point of inflection is included therein to determine an edge position.

Thus, the correction process executing unit 526 according to the present embodiment corrects the drawing density of liquid droplets such that the light receiving element 403 detects approximately the same level of detected voltage even for different colors to cause the point of inflection (the voltage value) to be included in the threshold area, thereby accurately detecting the edge position.

(Diameter of Spotlight and Line Width of Test Pattern)

While it is arranged that Spot diameter d=Line width L of a test pattern in FIG. 8, an edge position can be detected even with "Spot diameter d>Line width L of the test pattern" or "Spot diameter d<Line width L of the test pattern".

Figure 12A:
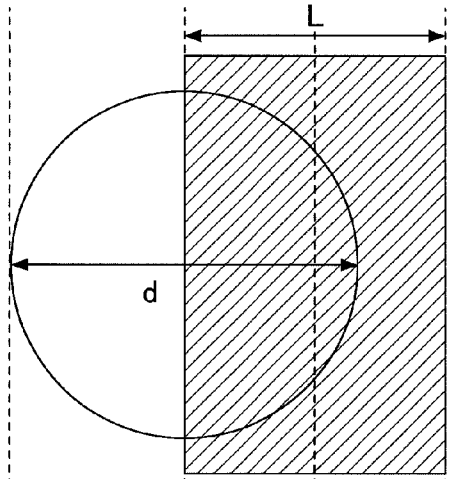
FIGS. 12A, 12B, 12C, and 12D are exemplary diagrams which describe a diameter of the spotlight and a line width of the test pattern.
Figure 12B:
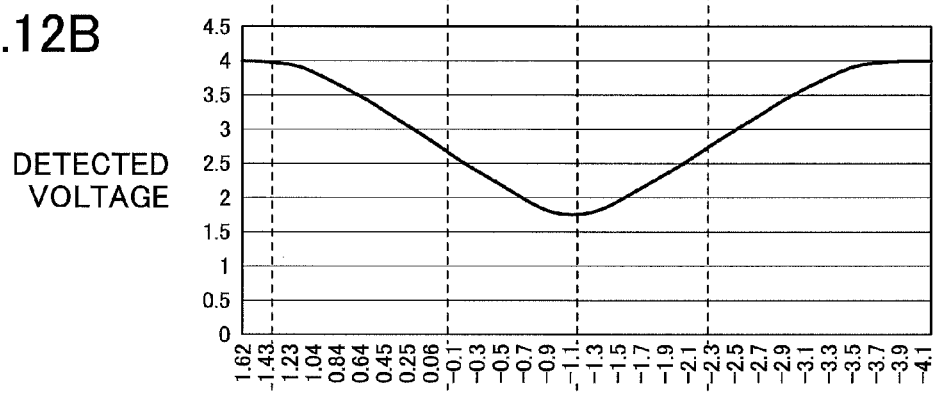
Figure 12C:
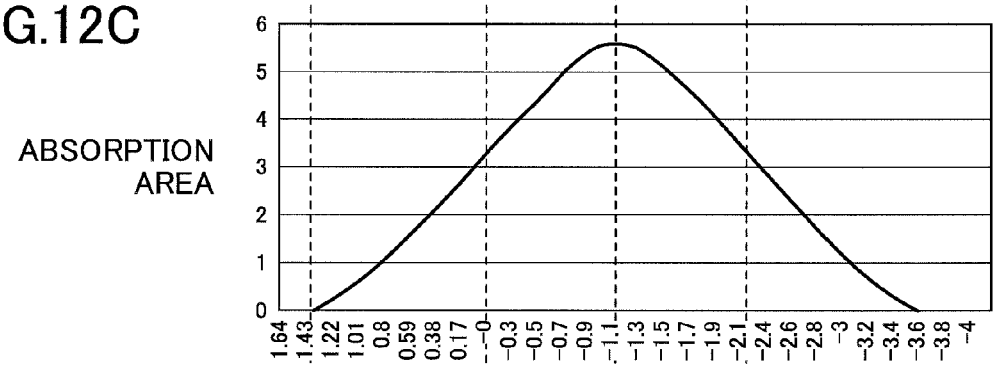

FIG. 12A shows an example of a test pattern and a spotlight which have a relationship that Spotlight diameter d>Line width L of a test pattern. Here, it is assumed that "d/2<L<d". FIG. 12B shows an example of a detected voltage of a light receiving element, FIG. 12C shows an example of an absorption area, and FIG. 12D shows a rate of increase of the absorption area, which is a derivative of the absorption area of FIG. 12C.

Figure 12D:
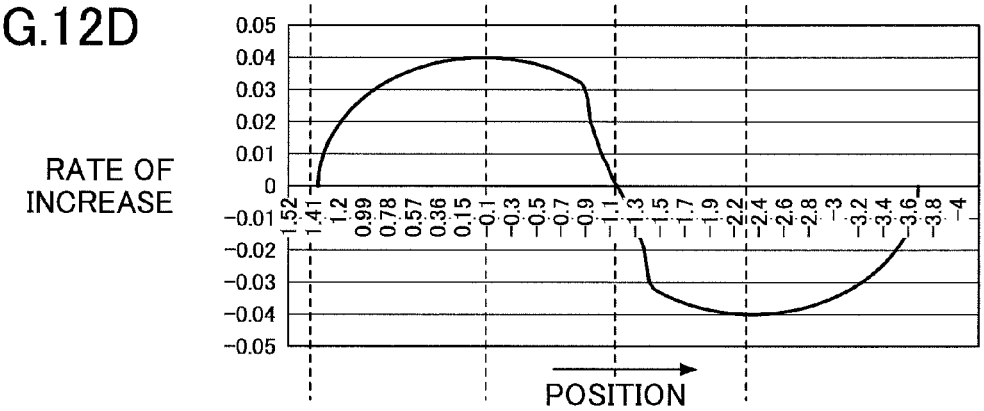

As Spot diameter d>Line width L of test pattern means that the spotlight and the test pattern do not overlap completely, the absorption area turns to a decreasing trend when a right edge of the spotlight gets over the test pattern and the rate of increase rapidly decreases as seen from the rate of increase of the absorption area in FIG. 12D.

However, in the present embodiment, as the intersecting points C1 and C2 may be obtained when detected voltage data in the neighborhood of the point of inflection is obtained, it suffices that the spotlight diameter d is such that d/2<L. In other words, it suffices that the spot diameter d is not extremely large relative to the line width L of the test pattern.

Figure 13A:
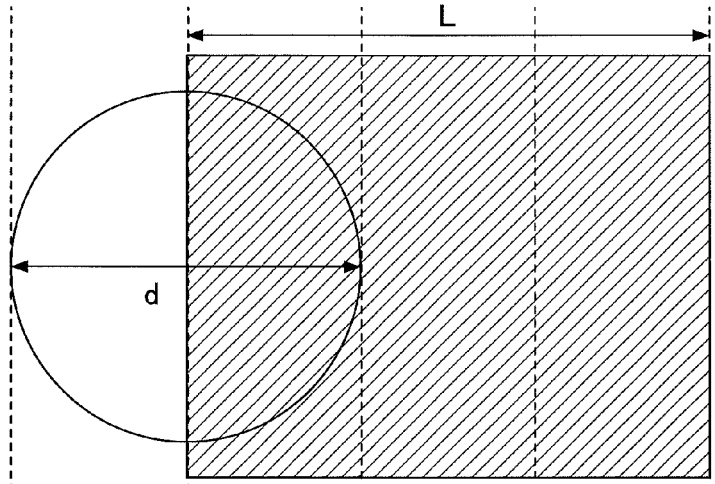
FIGS. 13A, 13B, 13C, and 13D are exemplary diagrams which describe the diameter of the spotlight and the line width of the test pattern.
Figure 13B:
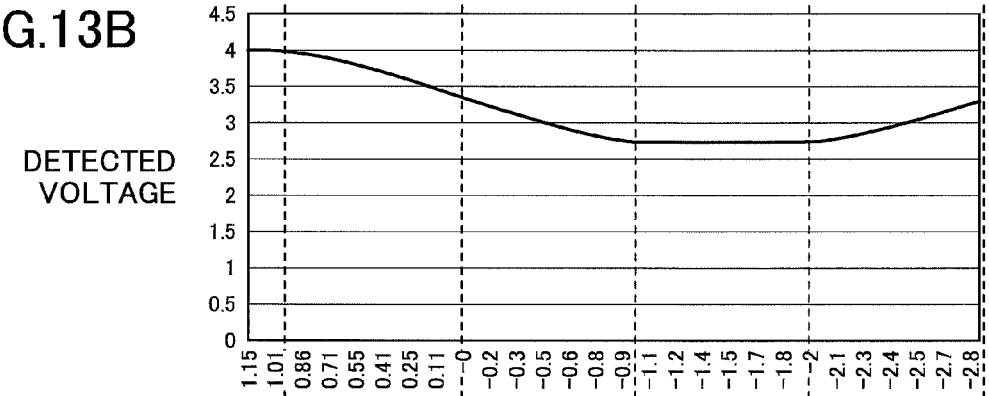

FIG. 13A shows an example of a test pattern and a spotlight which have a relationship that Spotlight diameter d<Line width L of a test pattern. FIG. 13B shows an example of a detected voltage of a light receiving element, FIG. 13C shows an example of an absorption area, and FIG. 13D shows a rate of increase of the absorption area, which is a derivative of the absorption area of FIG. 13C.

Figure 13C:
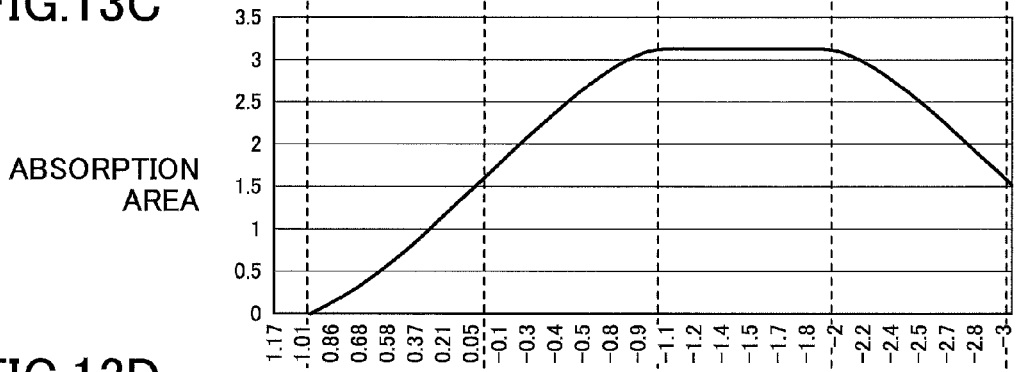
Figure 13D:
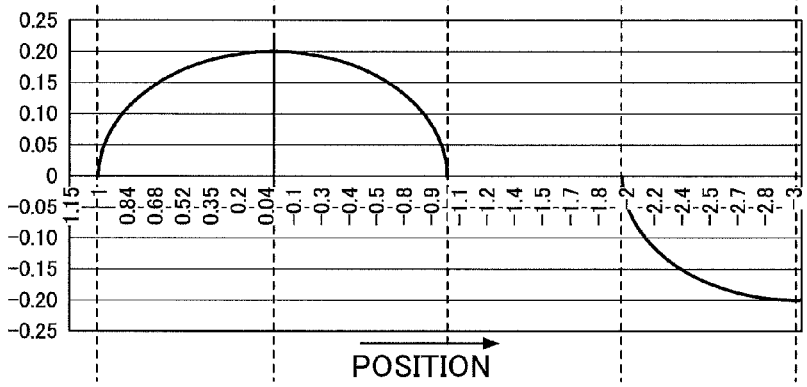

As Spot diameter d<Line width L of test pattern means that the spotlight and the test pattern continue to overlap completely, there occurs an area in which the detected voltage or the absorption area is constant as shown in FIGS. 13B and 13C. Moreover, as shown in FIG. 13D, there occurs an area in which the rate of increase of the absorption area is zero. Thereafter, the absorption area turns to a decreasing trend when a right edge of the spotlight gets over the test pattern, and the rate of increase slowly decreases (the rate of decrease increases).

In such a case, as in FIG. 8, detected voltage data sets in the neighborhood of the point of inflection are obtained sufficiently, making it possible for the ejection timing correction unit 616 to sufficiently determine the intersecting points C1 and C2.

(Case of Line-Type Image Forming Apparatus)

While the serial-type image forming apparatus 100 in FIGS. 3 and 4 is described as an example in the present embodiment, an impacting position offset amount may also be corrected with the same method in the line-type image forming apparatus 100. The line-type image forming apparatus 100 is briefly described.

Figure 14:
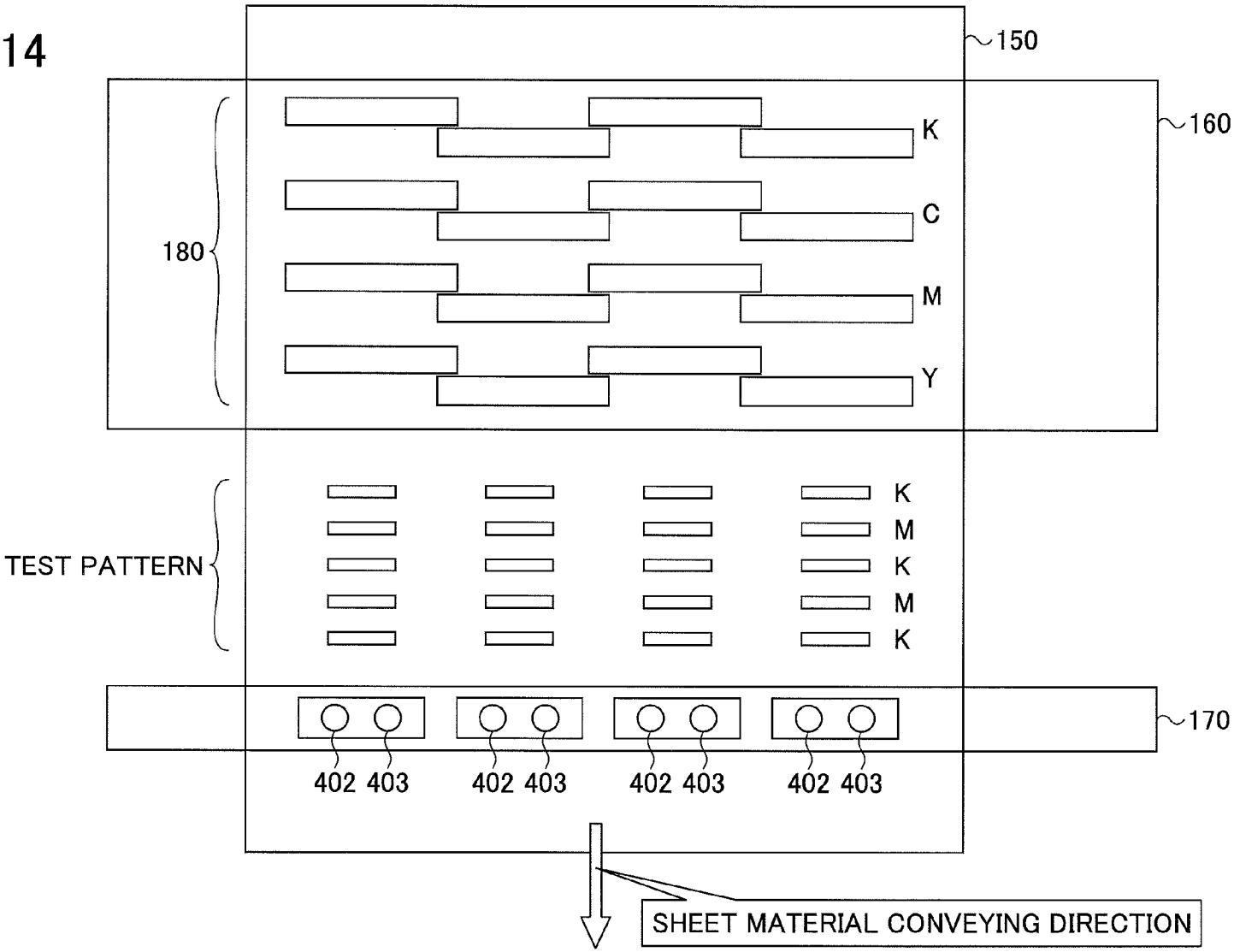
FIG. 14 is an exemplary diagram which schematically describes the test pattern and an arrangement of a head of a line-type image forming apparatus.

FIG. 14 is an exemplary diagram which schematically describes a test pattern and an arrangement of a head of a line-type image forming apparatus 100. A head fixing bracket 160 is fixed such that it is stretched from end to end in the main scanning directions orthogonal to a sheet material conveying direction. At the head fixing bracket 160 is arranged a recording head 180 of ink of KCMY from an upstream side to the whole area in the main scanning directions. The recording head 180 of the four colors is arranged in a staggered fashion such that edges overlap. In this way, liquid droplets are ejected from which a sufficient resolution is obtained even at an edge of the recording head 180, making it possible to suppress an increase in cost without a need to arrange one recording head 180 in the whole area in the main scanning directions. One recording head 180 may be arranged in the whole area in the main scanning directions for each ink color, or an overlapped area in the main scanning directions of the recording head 180 of each color may be elongated.

Downstream of the head fixing bracket 160 is fixed a sensor fixing bracket 170 such that it is stretched from end to end in the main scanning directions orthogonal to the sheet material conveying direction. At the sensor fixing bracket 170, a number of print position offset sensors 30 are arranged, the number of print position offset sensors 30 being equal to the number of heads. In other words, one print position offset sensor 30 is arranged such that a part overlaps one recording head 180 in the main scanning directions. Moreover, one print position offset sensor 30 includes a pair of the light emitting element 402 and the light receiving element 403. The light emitting element 402 and the light receiving element 403 are arranged such that they are nearly parallel to the main scanning direction.

In such an embodiment of the image forming apparatus 100, each line which makes up the test pattern is formed such that a longitudinal direction of the line is parallel to the main scanning direction. When an impacting position offset of a liquid droplet of a different color is corrected with K as a reference, the image forming apparatus 100 forms a K line and an M line, a K line and a C line, and a K line and a Y line while conveying the sheet material 150. Then, the sheet material 150 is conveyed to move positions of the sheet material 150 and the print position offset sensor at a relatively equal speed. Then, as in the serial-type image forming apparatus 100, an edge position of the CMYK test pattern is detected, and a liquid droplet ejection timing is corrected from the position offset amount.

As described above, even in the line-type image forming apparatus 100, a print position offset sensor 30 may be arranged properly to correct an impacting position offset.

(Correction of Drawing Density)

Figure 15:
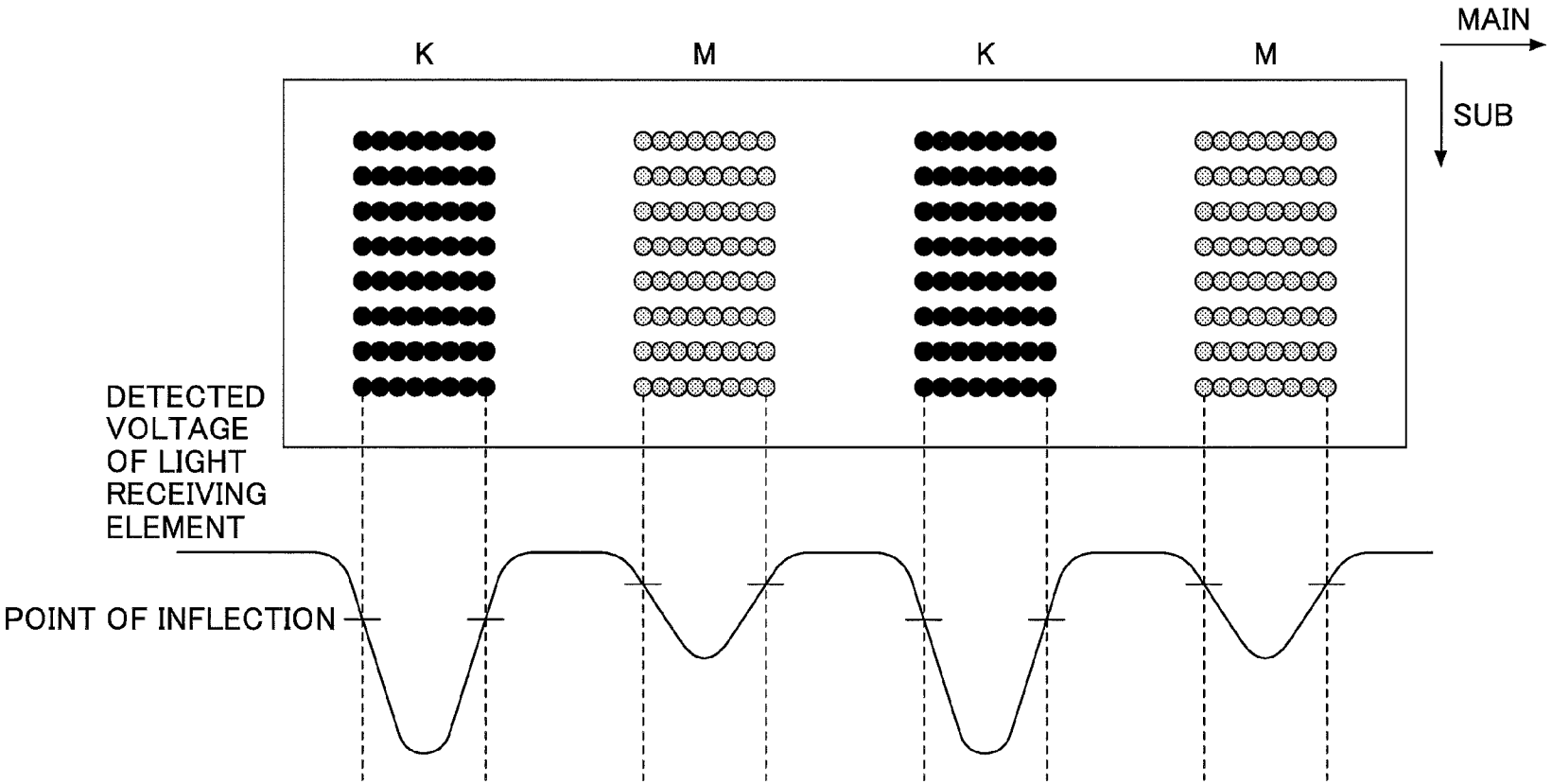
FIG. 15 is an exemplary diagram which schematically describes the test patterns when each ink color is formed with the same drawing density.

FIG. 15 is an exemplary diagram which schematically describes the test patterns when each ink color is formed with the same drawing density. While test patterns of all ink colors which can be ejected by the image forming apparatus are formed as the test patterns, black and magenta are exemplified in FIG. 15. When the same drawing density (for example, main scanning at 600 dpi× sub-scanning at 300 dpi), as the reflectance is low for black, the difference between the local maximum value and the local minimum value of the detected voltage becomes large, so that the detected voltage becomes high. On the other hand, magenta has a high reflectance relative to black, so that the detected voltage for magenta becomes small relative to the detected voltage for black.

Figure 16:
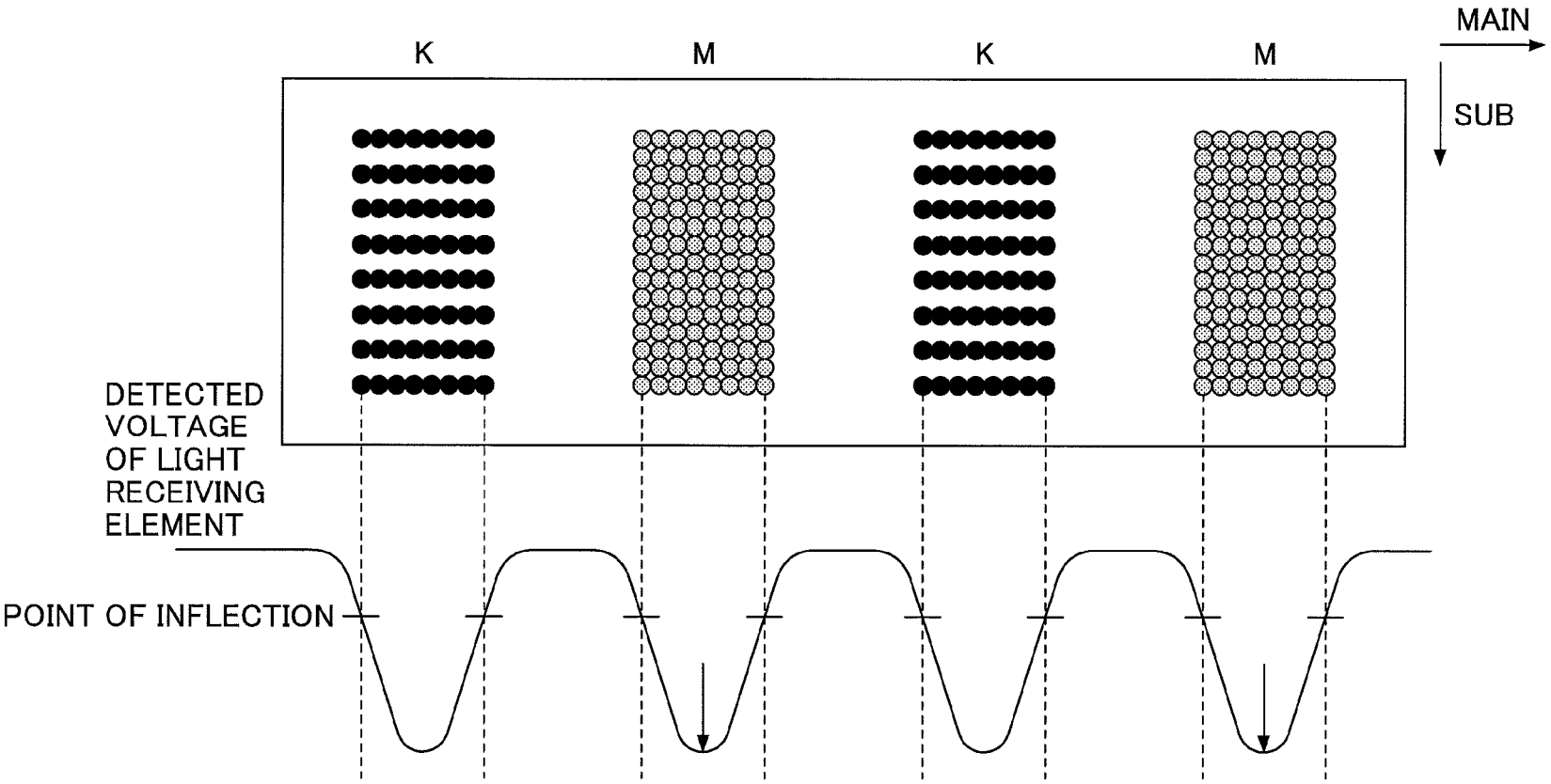
FIG. 16 is an exemplary diagram which schematically describes the test patterns when the drawing density is set to be high only for ink with a high reflectance.

FIG. 16 is an exemplary diagram which schematically describes the test patterns when the drawing density is set to be high only for ink (magenta), with a high reflectance. Magenta has a high reflectance (a low absorption rate) relative to black, so that the drawing density for magenta is greater in FIG. 16 relative to FIG. 15. As shown, the drawing density is set to be high with a resolution of 600 dpi for the sub-scanning direction (the same as the main scanning directions) as an example. In this way, increasing the resolution of the sub-scanning direction leads to relatively easy control.

As the drawing density of magenta is increased and the reflectance decreases, the difference between the local maximum value and the local minimum value of the detected voltage of magenta increases, so that an amplitude of the detected voltage increases relative to FIG. 15. As a result, positions of points of inflection of the detected voltages of black and magenta may be set to be closer, making it possible to suppress a decreased accuracy of the edge position. In other words, the drawing density of magenta may be increased to set the difference between the local minimum values of black and magenta to be less, making it possible to set the positions of the points of inflection to be closer.

As shown in FIG. 16, the same advantageous effects are obtained when decreasing the drawing density of ink with a low reflectance as opposed to increasing the drawing density of ink with a high reflectance.

Figure 17:
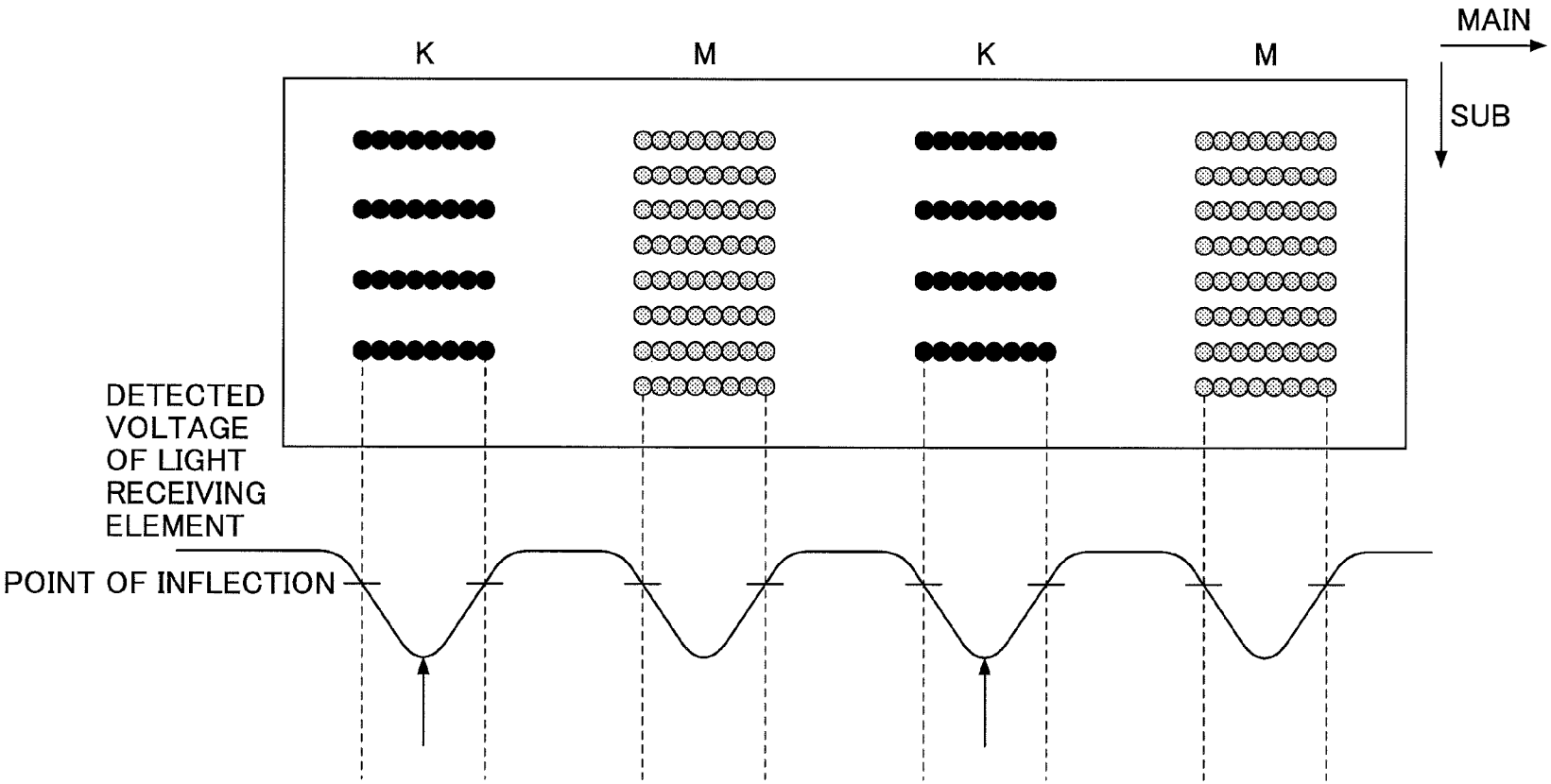
FIG. 17 is an exemplary diagram which schematically describes the test patterns when the drawing density is set to be low only for ink with a low reflectance.

FIG. 17 is an exemplary diagram which schematically describes the test patterns when the drawing density is set to be small only for ink (black) with a small reflectance. Black has a low reflectance (a high absorption rate) relative to magenta, so that the drawing density for black is less in FIG. 17 relative to FIG. 15. As shown, the concentration is set to be low with a resolution of 150 dpi (a half of FIG. 15) for the sub-scanning direction as an example. In this way, decreasing the resolution for the sub-scanning direction leads to relatively easy control.

As the drawing density of magenta decreases and the reflectance increases, the difference between the local maximum value and the local minimum value of the detected voltage of black decreases. As a result, positions of points of inflection of the detected voltages of black and magenta may be set to be closer, making it possible to suppress a decreased accuracy of the edge position. In other words, the drawing density of black may be decreased to set the difference between the local minimum values of black and magenta to be closer, making it possible to set the positions of the points of inflection to be closer. Moreover, in this case, an amount of usage of black ink may be reduced.

While the drawing density is changed by changing the resolution in the sub-scanning direction, the drawing density may also be changed by changing the resolution in the main scanning direction.

Figure 18A:
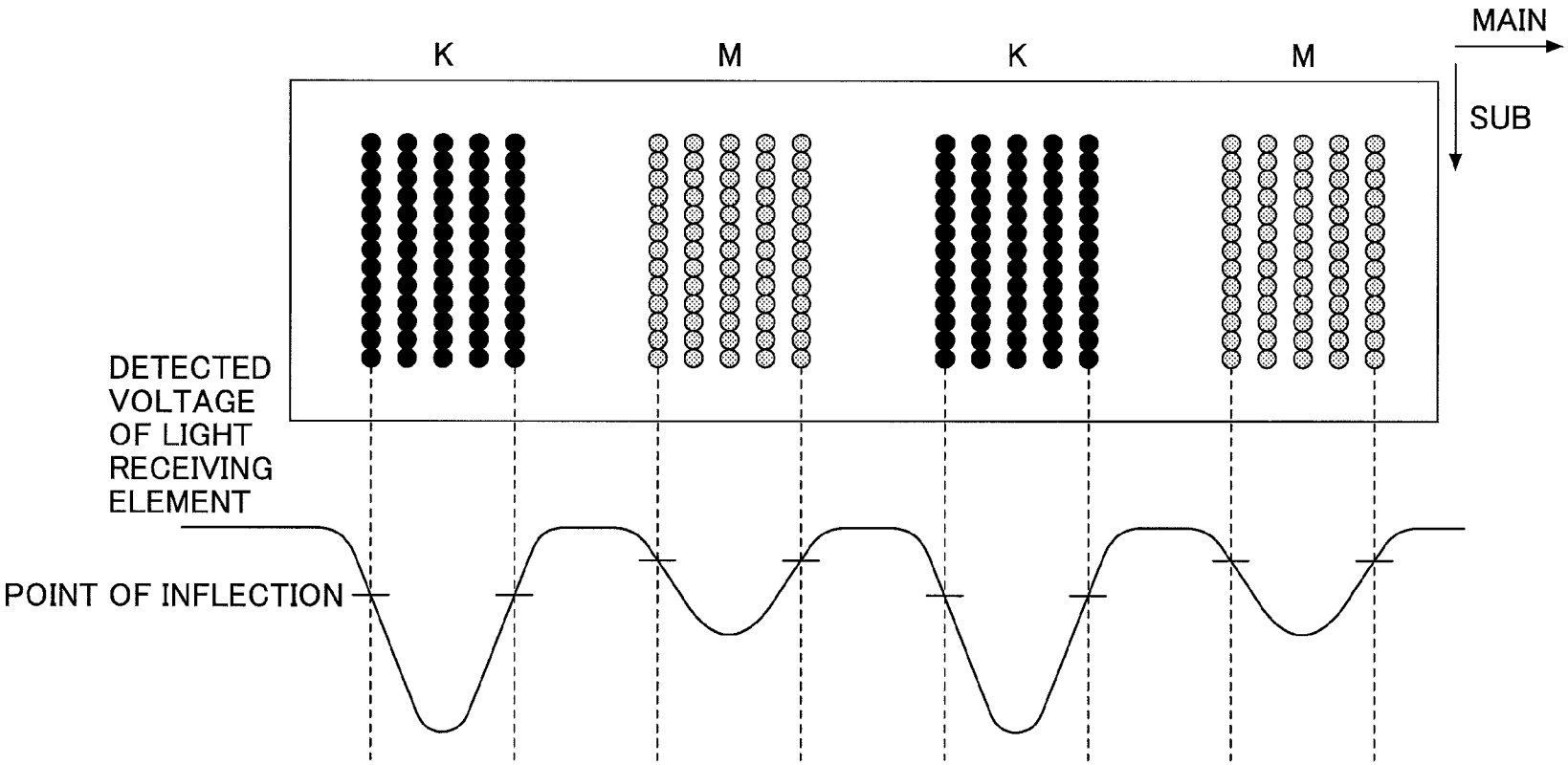
FIGS. 18A and 18B are exemplary diagrams which schematically describe the test patterns when the drawing density is set to be high only for ink with a high reflectance.

FIG. 18A is an exemplary diagram which schematically describes the test patterns when they are formed with the same drawing density for each ink color. While black and magenta are also exemplified here, the ink colors are not limited thereto. The drawing density is the same (main scanning 300× sub-scanning 600 dpi) for black and magenta. As in FIG. 15, since black has a low reflectance, the difference between the local maximum value and the local minimum value of the detected voltage increases, so that an amplitude of the detected voltage increases. On the other hand, magenta has a higher reflectance relative to black, so that the amplitude of the detected voltage is small for magenta relative to black.

Figure 18B:
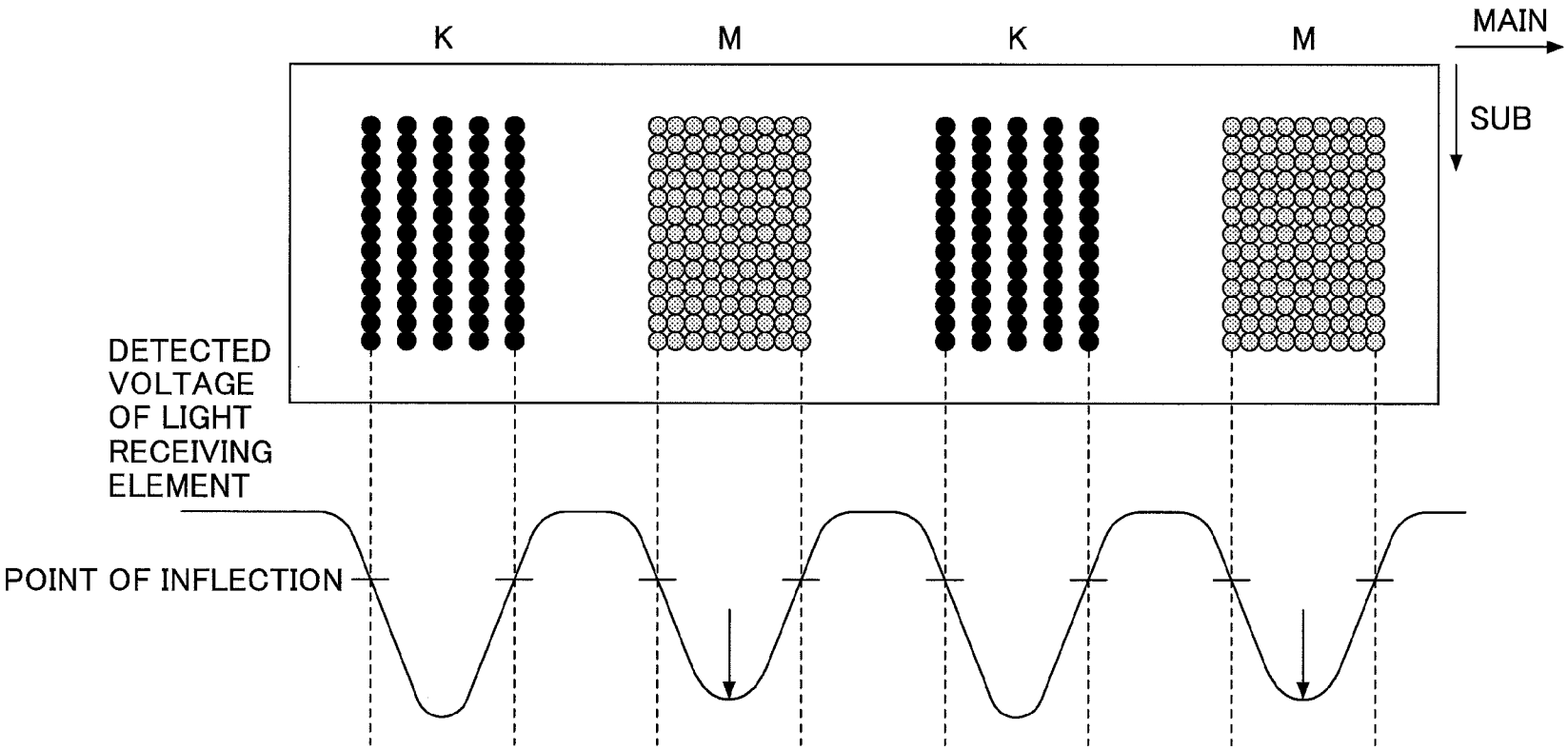

FIG. 18B is an exemplary diagram which schematically describes the test patterns when only the drawing density for ink (magenta), with a high reflectance is made large. The drawing density for magenta is high relative to FIG. 18A. As shown, the concentration is made greater with the resolution in the main scanning direction being set to 600 dpi (the same as the sub-scanning direction). It is relatively easy to increase the resolution in the main scanning direction to the highest resolution range.

As the drawing density for magenta increases and the reflectance decreases, the difference between the local maximum value and the local minimum value of the detected voltage increases, so that an amplitude of the detected voltage increases relative to FIG. 18A. As a result, positions of points of inflection of detected voltages of magenta and black may be made to be closer, making it possible to suppress a decrease in accuracy of an edge position. In other words, the drawing density of magenta is increased to make the difference of local minimum values of black and magenta closer, making it possible to make positions of points of inflection closer.

Moreover, the resolution of both the main scanning direction and the sub-scanning direction may be changed.

Figure 19:
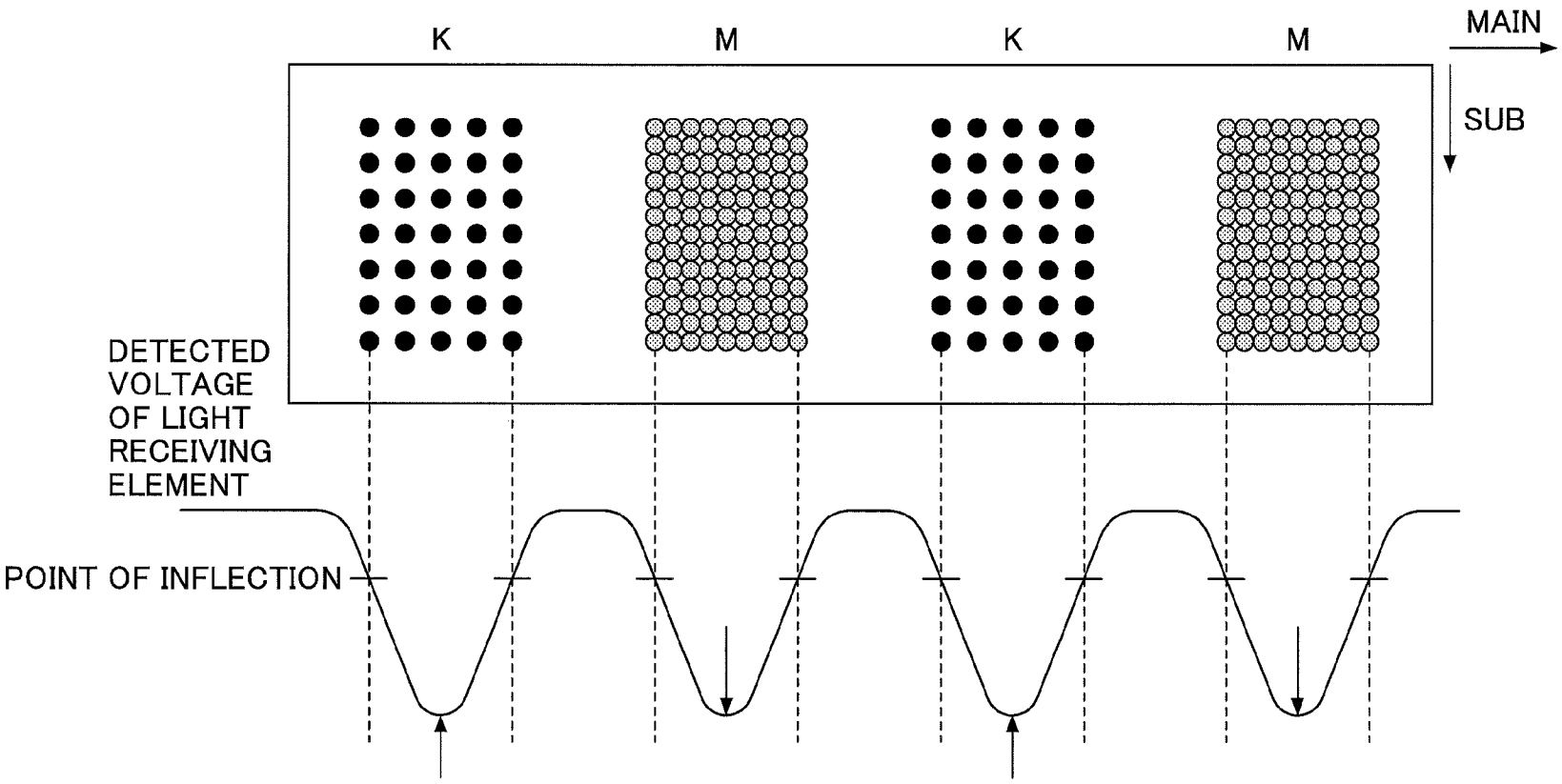
FIG. 19 is an exemplary diagram which schematically describes the test patterns when the drawing density is set to be high for ink with the high reflectance and the drawing density is set to be low for ink with the low reflectance.

FIG. 19 is an exemplary diagram which schematically describes the test patterns when the drawing density for ink (magenta), with a high reflectance is made high and the drawing density for ink (black), with a low reflectance is made low. The drawing density for magenta is higher relative to FIG. 18A, while the drawing density for black is lower relative to FIG. 18A. The resolution for black, with a low reflectance (a high absorbing rate) is 300×300 dpi, while the resolution for magenta, with a high reflectance (a low absorbing rate) is 600×600 dpi.

The increased drawing density for magenta leads to a larger difference between the local maximum value and the local minimum value of the detected voltage of magenta, while the decreased drawing density for black leads to a smaller difference between the local maximum value and the local minimum value of the detected voltage of black. As a result, it may be possible to cause positions of inflection points of the detected voltage of black and the detected voltage of magenta to be closer, making it possible to suppress reducing accuracy of an edge position. In other words, the drawing density for magenta is increased and the drawing density for black is decreased to cause the difference of local minimum values of black and magenta to be smaller, making it possible to cause positions of inflection points to be closer.

Test patterns of each ink color (K, C, M, Y) that are experimentally specified such that points of inflection of test patterns of each color approach one another are stored in the test pattern storage unit 618 as pattern data for test patterns of each color that specify positions of liquid droplets. According to pattern data of the test pattern storage unit 618, any mode of test patterns in FIGS. 16 to 19 is formed onto the sheet material 150. Reflectance also varies with sheet quality, color, etc., so that it is preferable to prepare the respective pattern data sets for each type of sheet material 150 such as plain paper, glossy paper, tracing paper, and various color paper sheets.

Multiple K pattern data sets may be specified in the test pattern storage unit 618 such that the reflectance takes approximately the same value for each of combinations of K and M; K and C; and K and Y when test patterns are formed by a combination of black and the respective colors such as. (It is not necessary to have the same drawing density for the same color.) Moreover, for an ink color with a high reflectance, such as Y, it is easier to align positions of points of inflection when the drawing density for the test pattern is determined in combination with M, with the next highest reflectance, rather than in combination with K.

Next, methods of increasing the drawing density with devised ways of controlling ejection of liquid droplets are described. Here, while magenta is exemplified as an ink color with a high reflectance, the ink color is not limited thereto. There are generally three methods of increasing the drawing density:

a method of forming a test pattern in multiple rounds such that liquid droplets are overlapped at approximately the same position;

a method of forming a test pattern while the ejecting position of liquid droplets is offset by less than a pixel unit in the main scanning direction; and a method of forming a test pattern while the ejecting position of liquid droplets is offset by less than a pixel unit in the sub-scanning direction.

Figure 20A:
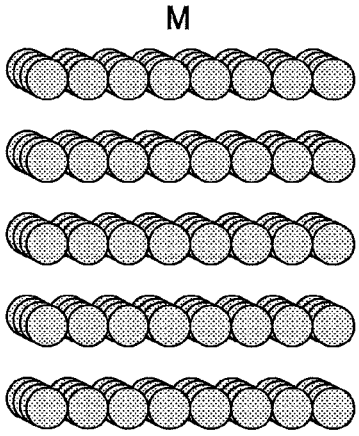
FIGS. 20A, 20B, and 20C are exemplary diagrams which describe the method of increasing the drawing density.

FIG. 20A is an exemplary diagram which schematically describes the test pattern when liquid droplets are overlapped in multiple rounds at approximately the same position. The liquid droplet positions are offset little by little, which depicts that there are multiple liquid droplets. The respective liquid droplets are actually ejected at approximately the same position.

When it is detected by the encoder sensor 42 that the carriage 5 is at a certain predetermined position in the main scanning direction, the head drive controller ejects the liquid droplets. This is repeated a predetermined number of times. Control is easy since the same print operations are merely repeated multiple times. Even when the image forming apparatus ejects the liquid droplets at the same position, a drawing area does not necessarily increase, so that the drawing density does not increase; however, an amount of ink at the ejecting position increases, so that it becomes likely for the ink to absorb the spotlight. In particular, for a color material with a high reflectance such as yellow, repeating ejections at the same position is effective. Moreover, a combined use with the other two methods makes it more likely to obtain a further increased reflectance.

Figure 20B:
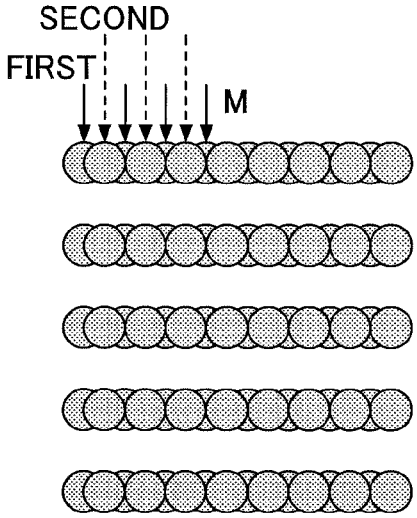

FIG. 20B is an exemplary diagram which schematically describes the test pattern formed while the ejecting position of liquid droplets is offset by less than a pixel unit in the main scanning direction. As shown, the liquid droplets are ejected such that a half of the length of the pixel unit is offset. In other words, the head drive controller, for example, ejects liquid droplets at the highest resolution in a first scanning round in a main scanning direction, and ejects liquid droplets at the same resolution in a second scanning round in the main scanning direction while delaying the ejection timing of the liquid droplet by approximately half of the pixel unit. Such a method makes it possible to effectively fill a blank area even for the sheet material 150 such as glossy paper, with a blank area remaining even with a highest density of pixels. The pixel unit is a distance between liquid droplets at the highest resolution in the main scanning direction that is obtained in one scanning, or time during which the carriage moves the distance.

The delay amount of the ejection timing, which is not limited to a half of the length of pixel unit, is variable according to the range of the delay control amount which is possible for the head drive controller. For example, it may be set to delay ¼ of the pixel unit at a third round of scanning and to delay ¾ of the pixel unit at a fourth round of scanning. Moreover, decreasing the scanning speed of the carriage 5 makes it possible to freely change the ejection position further.

It is difficult to change the ejection timing in the main scanning direction with a line-type image forming apparatus, but it is possible to provide a mechanism which makes a position of a recording head in the main scanning direction variable or a mechanism which moves the sheet material 150 by less than the pixel unit in the sub scanning direction.

Figure 20C:
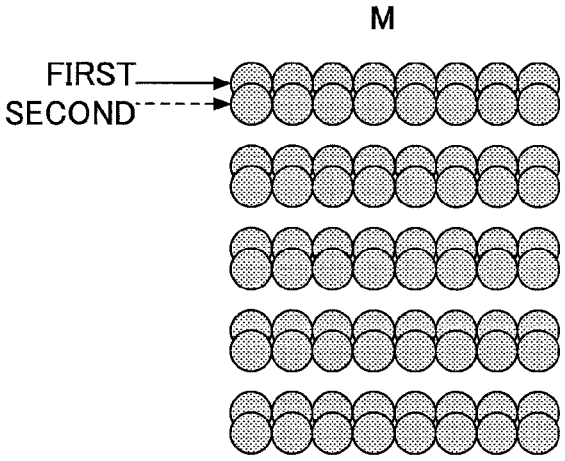

FIG. 20C is an exemplary diagram which schematically describes the test pattern formed while the ejecting position of liquid droplets is offset by less than a pixel unit in the sub-scanning direction. After the head drive controller performs a first scanning round in the main scanning direction, the test pattern printing unit 617 requests the sub-scanning drive unit to perform sheet conveying by less than the pixel unit. The sub-scanning drive unit performs the sheet conveying of the sheet material 150 by less than the pixel unit. At this moment, the head drive controller may perform a second round of scanning in the main scanning direction to offset the ejection position of liquid droplets in the sub-scanning direction by less than the pixel unit. This method also makes it possible to effectively fill a blank area even for the sheet material 150 such as the glossy paper, with a blank area remaining even with the highest density of pixels. The pixel unit in the sub-scanning direction is a distance between nozzles in the sub-scanning direction, or time during which the carriage moves the distance.

Pattern data of test patterns in FIG. 20A to 20C are also stored in the test pattern storage unit 618, and the test pattern printing unit 617 controls the carriage 5, the head drive controller 312, the sub-scanning drive unit 314, etc., according to the pattern data.

Moreover, the drawing density of at least one of K or M may be dynamically changed by the test pattern printing unit 617 performing feedback control such that local minimum values of the detected voltages of K and M, for example, take approximately the same value rather than providing the test pattern storage unit 618 as a static file. This method is effective when sheet quality of the sheet material 150 is undefined.

(Operation Procedure)

Figure 21A:
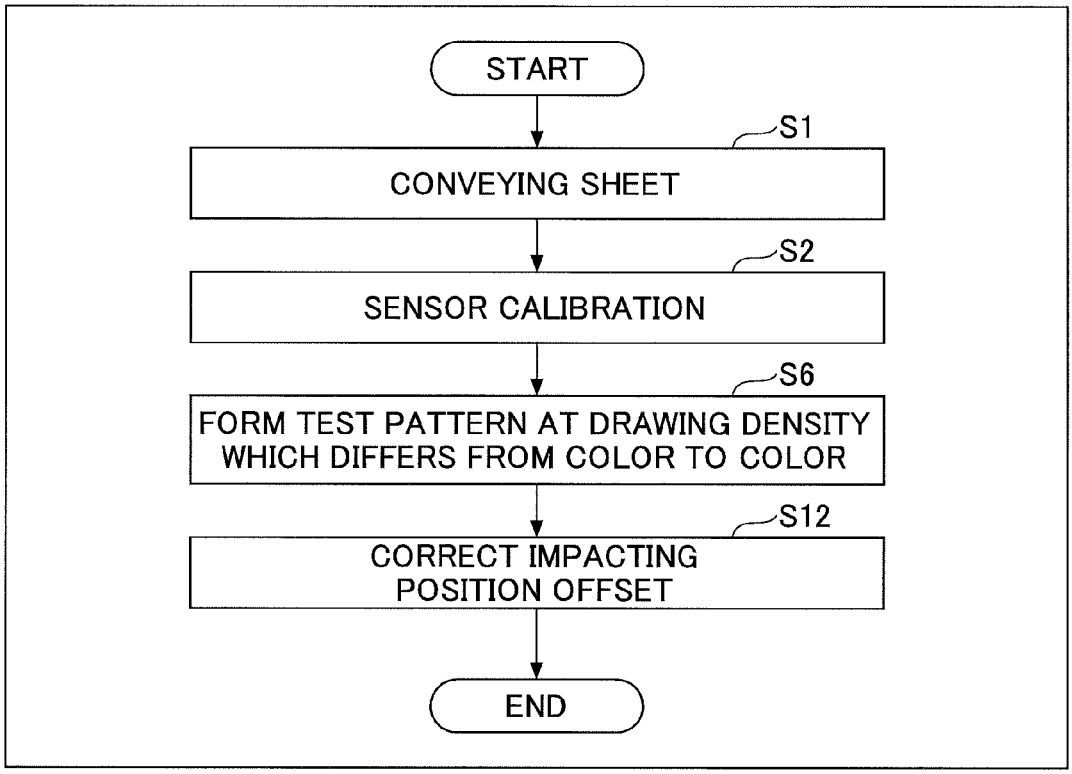
FIGS. 21A and 21B are exemplary flowcharts which describe a procedure for a correction process executing unit to correct a liquid droplet ejection timing.

FIG. 21A is a flowchart which illustrates one example of a procedure in which a correction process executing unit 526 corrects a liquid droplet ejection timing.

First, the CPU 301 instructs the main controller 301 to start an impacting position offset correction. With this instruction, the main controller 310 drives the sub-scanning motor 132 via the sub-scanning drive unit 314 and conveys the sheet material 150 to right under the recording head 21 (S1).

Next, the main controller 310 drives the main scanning motor 27 via the main scanning drive unit 313 to move the carriage 5 over the sheet material 150 and carries out a calibration of the light emitting element 402 and the light receiving element 403 at a specific location on the sheet material 150 (S2).

Figure 21B:
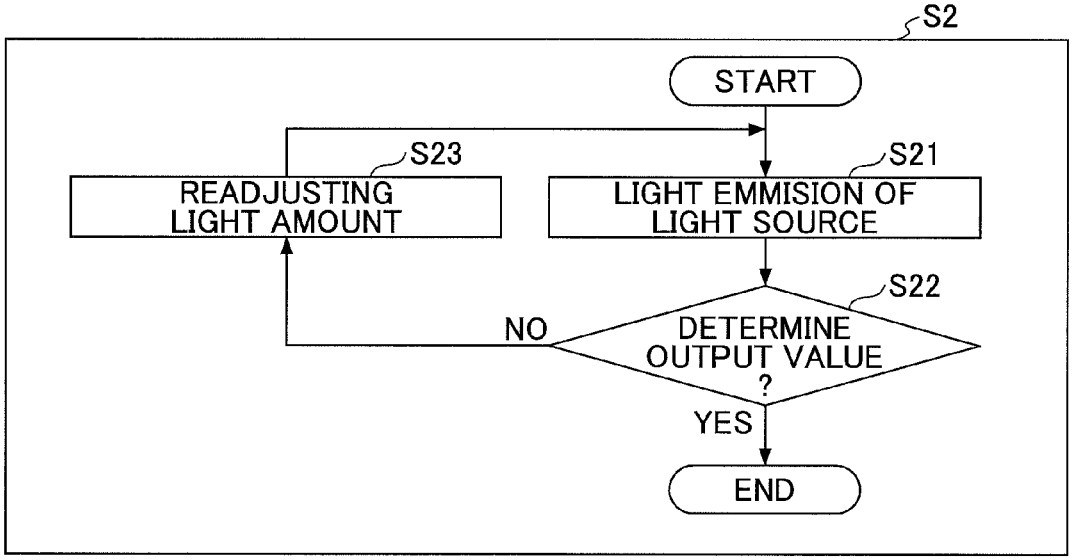

FIG. 21B is an exemplary flowchart which explains a process in S2. A calibration is a process in which a light amount of the light emitting element 402 is adjusted such that a detected voltage of the light emitting element 402 falls within a desired range (more specifically, 4±0.4 V).

A PWM value for driving the light emitting element 402 of the print position offset sensor 30 is set in the light emission controller 511 by the CPU 301, and smoothing is performed at the smoothing circuit 512, after which it is provided to the driving circuit 513, which drives the light emitting element 402 to emit light (S21).

An intensity signal which is detected by the light receiving element 403 of the print position offset sensor 30 is stored in the shared memory 525 and the CPU 301 determines whether it takes a desired voltage value (S22).

If it takes the desired voltage value (Yes in S22), the process of FIG. 21B ends. If it does not take the desired voltage value (No in S22), the CPU 301 changes the PWM value (S23) to readjust the light amount.

Returning to FIG. 21A, in the main controller 310 no sheet conveying is performed with a sub-scanning position of the sheet material 150 as it is, the main scanning controller 313 moves the carriage 5 via the main scanning drive motor 27, and, based on pattern data, the head drive controller 312 drives the recording heads 21-24 to form a test pattern (S6). For example, when the correction process executing unit 526 adjusts the impacting position offset of magenta with black as a reference, a test pattern is formed with alternating black and magenta, which have different drawing densities. The same applies for other colors.

Next, the ejection timing correction unit 616 detects an edge position of the test pattern from the detected voltage data and corrects an impacting position offset of a liquid droplet (S12). In other words, the ejection timing correction unit 616 compares a distance of each line with an optimal distance to calculate an impacting position offset amount, and calculates a correction value of a liquid droplet ejection timing such that an impacting position offset is removed for setting in the head driver controller 312.

As described above, the image forming apparatus according to the present embodiment changes the drawing density such that the reflectance for each of the colors takes approximately the same value, making it possible to cause the positions of points of inflection to be closer and to accurately detect the edge position even for different colors. As a result, the liquid droplet ejection timing may be accurately adjusted.

Embodiment 2

In Embodiment 1, the drawing densities for the different ink colors are varied to cause positions of points of inflection to be close; however, factors which disturb the positions of points of inflection are not limited to the ink color, so that the positions of the points of inflection do not come sufficiently close even when the drawing densities are varied as stored in advance. In such a case, the present embodiment in addition to the Embodiment 1 may be executed to perform an accurate detection.

(Accuracy Decreasing Factor)

As described in conjunction with FIG. 10, for detecting an edge using detected voltage data between an upper limit threshold and a lower limit threshold, the edge cannot be detected unless a point of inflection is included between the upper limit threshold and the lower limit threshold.

Figure 22A:
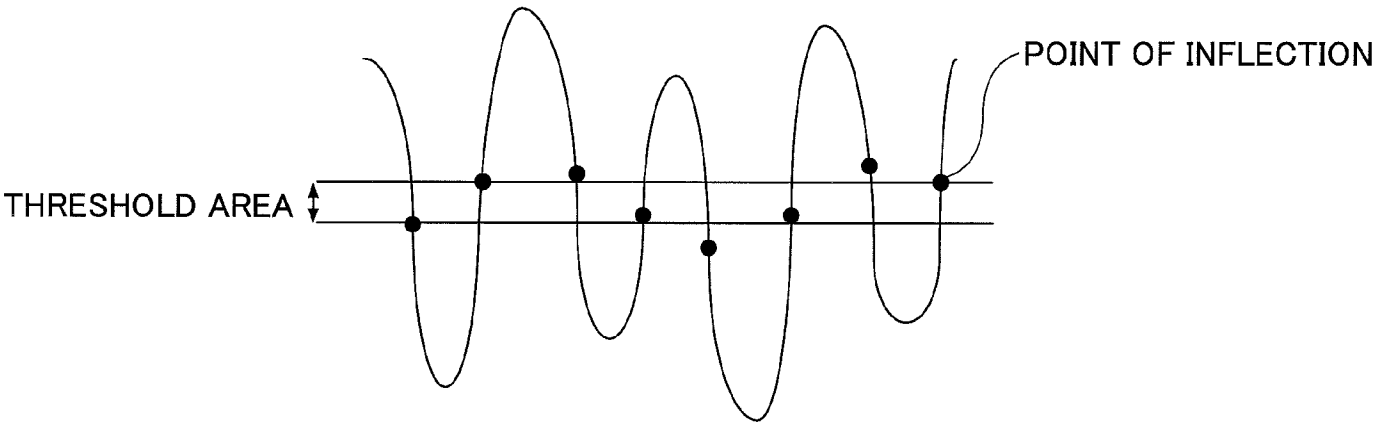
FIGS. 22A and 22B are diagrams which show examples of a detected voltage with an unstable amplitude and a detected voltage after correcting the amplitude.
Figure 22B:
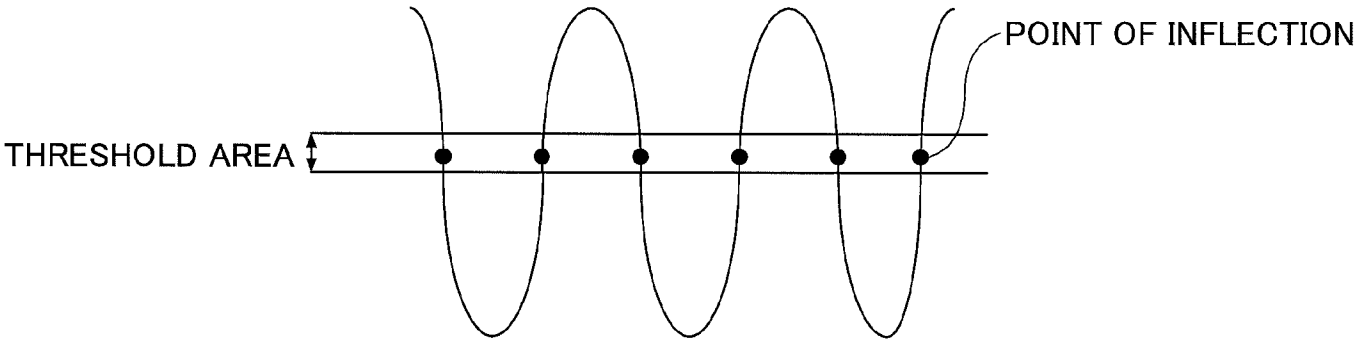

FIG. 22A shows an example of a detected voltage with an unstable amplitude, while FIG. 22B shows an example of a detected voltage after correcting the amplitude. In general the detected voltage as in FIG. 22A is not obtained; however, it is known that, when the print position offset sensor 30 reads a test pattern formed on the sheet material 150 such as tracing paper, with a high transmittance, an amplitude of the detected voltage varies due to amplification, etc., of sensitivity of the light receiving element and transmittance variations of the sheet. As shown, an unstable amplitude causes the point of inflection to be removed from a threshold area. When the correction process executing unit 526 determines intersecting points C1 and C2 with no change to the original threshold area, the intersecting points C1 and C2 are determined from the detected voltage in which no point of inflection is included, so that the edge position is not accurate.

On the other hand, causing local maximum values of the amplitudes to be close to the same level makes it possible to include the points of inflection in the threshold area and cause the points of inflection to be concentrated around a center of the threshold area. Therefore, in the present embodiment, in addition to the change in the drawing density in Embodiment 1, an image forming apparatus is described which makes it possible to correct an amplitude of a detected voltage even with a special sheet material 150 in addition to the changed drawing densities.

The present embodiment is described with tracing paper as an example; however, the same problem arises for a sheet material 150 with a high transmittance. For example, the method of detecting an edge position according to the present embodiment is effective when a sheet is sufficiently thin even for normal paper besides the tracing paper. Therefore, a correction process of the liquid droplet ejecting timing of the present embodiment is not limited to a sheet material 150 having a specific material, type, or thickness. Moreover, the present embodiment may also be applied to normal paper with a sufficient thickness.

Figure 23:
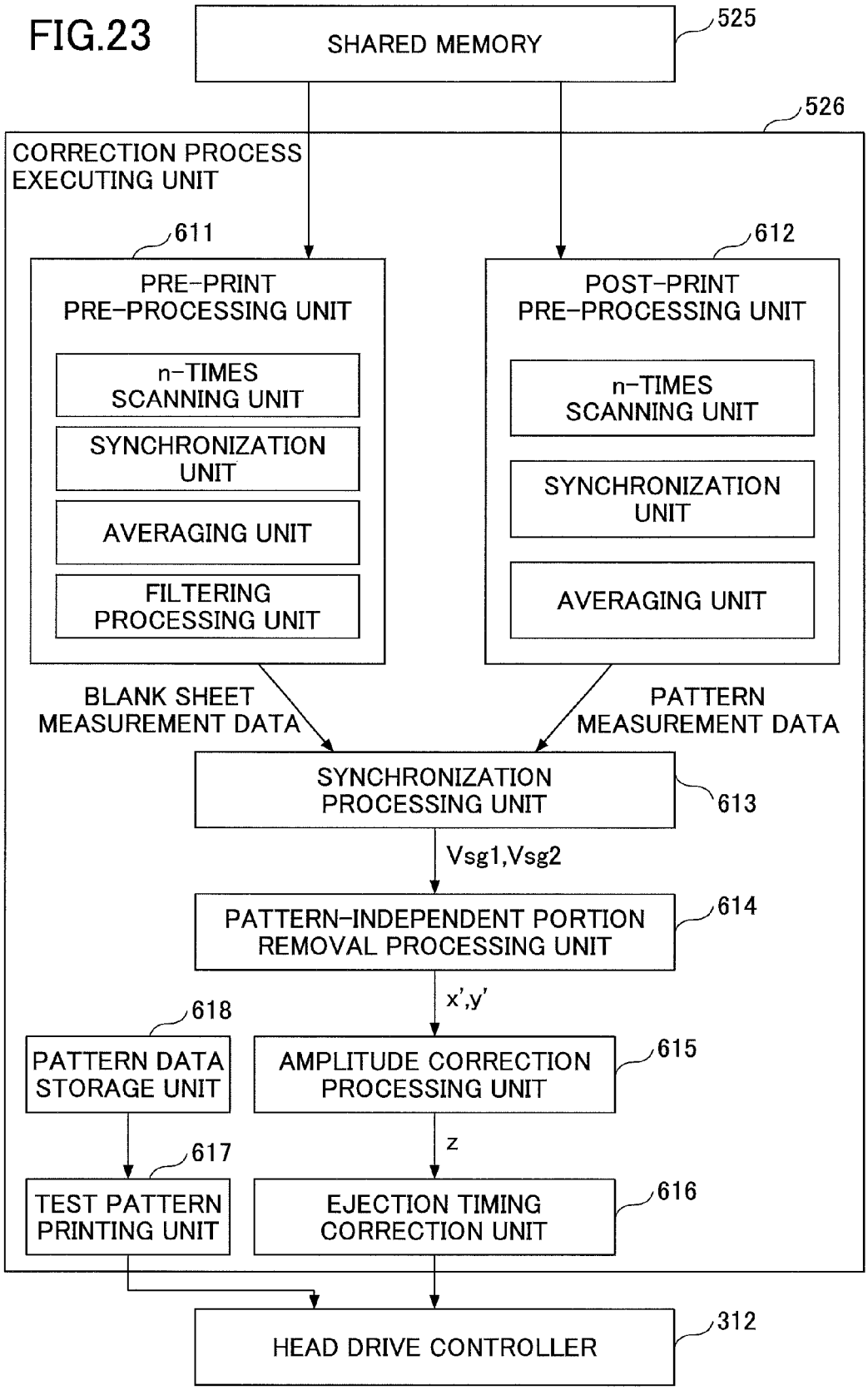
FIG. 23 is an exemplary functional block diagram of a correction process executing unit 526 (Embodiment 2)

FIG. 23 is an exemplary functional block diagram of the correction process executing unit 526 of the present embodiment. Repeated explanations of those elements in FIG. 23 that are the same as FIG. 7 are omitted. The correction process executing unit 526 of the present embodiment includes a pre-print pre-processing unit 611, a post-print pre-processing unit 612, a synchronization processing unit 613, a pattern-independent portion removal unit 614, an amplitude correction processing unit 615, and an ejection timing correction unit 616. The pre-print pre-processing unit 611 applies pre-processing to detected voltage data before the test pattern is formed, while the post-print pre-processing unit 612 applies pre-processing to detected voltage data after the test pattern is formed. The synchronization processing unit 613 synchronizes (aligns) the detected voltage data before the test pattern is formed and the detected voltage data after the test pattern is formed. The pattern-independent portion removal unit 614 subtracts below-described Vp2 from the detected voltage data. The amplitude correction processing unit 615 performs an amplitude correction process to generate a detected voltage z for computing an edge position.

(Signal Correction)

A signal correction of the detected voltage according to the present embodiment is described. The signal correction of the present embodiment includes two correction processes:

Pattern-independent portion removal process; and

Amplitude correction process.

Moreover, pre-processing is needed to perform the signal correction. Thus, the processing procedure is as follows:

(1) Pre-processing;

(2) Signal correction;

(2-1) Pattern-independent portion removal process; and (2-2) Amplitude correction process.

(Pre-Processing)

Below, the pre-processing is described. The pre-processing may be divided into a pre-processing A and a pre-processing B. The pre-processing A includes the following processes on detected voltage data for a blank sheet status (background) before forming a test pattern.

Pre-Processing A (i) N-times scanning (ii) Synchronization process (iii) Averaging (iv) Filtering process The pre-processing B includes the following processes on detected voltage data after forming the test patterns with the drawing density changed for each ink color.

Pre-Processing B (i) N-times scanning (ii) Synchronization process (iii) Averaging (Pre-Processing A)

Pre-Processing A-(i)

Figure 24A:
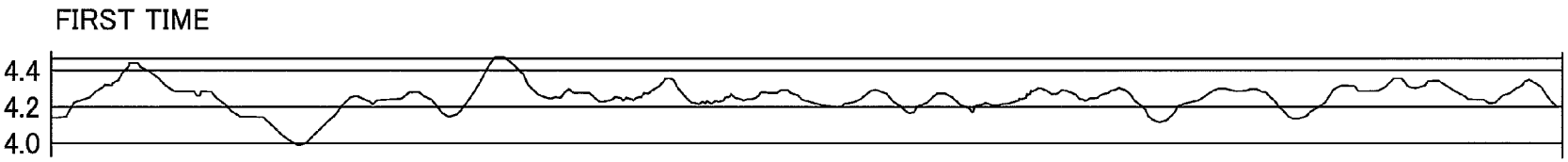
FIGS. 24A and 24B are diagrams illustrating one example of measurement results of n-times scanning.
Figure 24B:
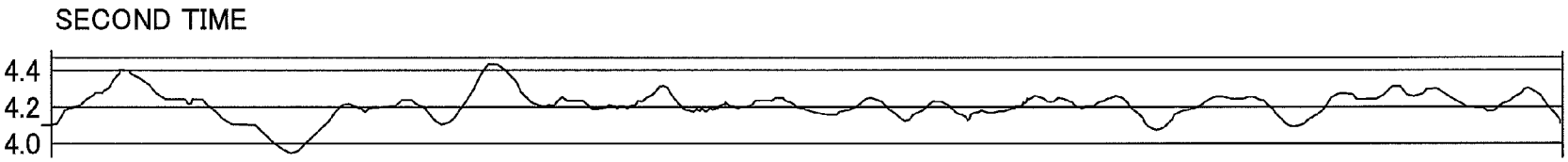

FIGS. 24A and 24B are diagrams illustrating one example of measured results of n-times scanning in A-(i). Before the n-times scanning, an n-times scanning unit performs a sensor calibration for a sheet material (e.g., a plain paper, a tracing paper). The n-times scanning unit requests the CPU 301 that a detected voltage of a reflected light which is detected by a light receiving element and eventually converted by an A/D conversion circuit 523 take a certain constant value. The CPU 301 performs feedback control such that the detected voltage falls within a certain range. For example, when the detected voltage is greater than 4.4 V a light emitting amount of the light emission controller 511 is decreased, while when the detected voltage is less than 4.0 V the light emitting amount of the light emission controller 511 is increased. As shown in FIGS. 24A and 24B, the sensor calibration causes the detected voltage to fall within a 4.0-4.4 V range. The sensor calibration may be performed by PI control or PID control with a target value being set to 4.0-4.4 V. The n-times scanning unit obtains n detected voltage data sets as shown in FIGS. 24A and 24B.

Pre-Processing A-(ii)

Figure 25:
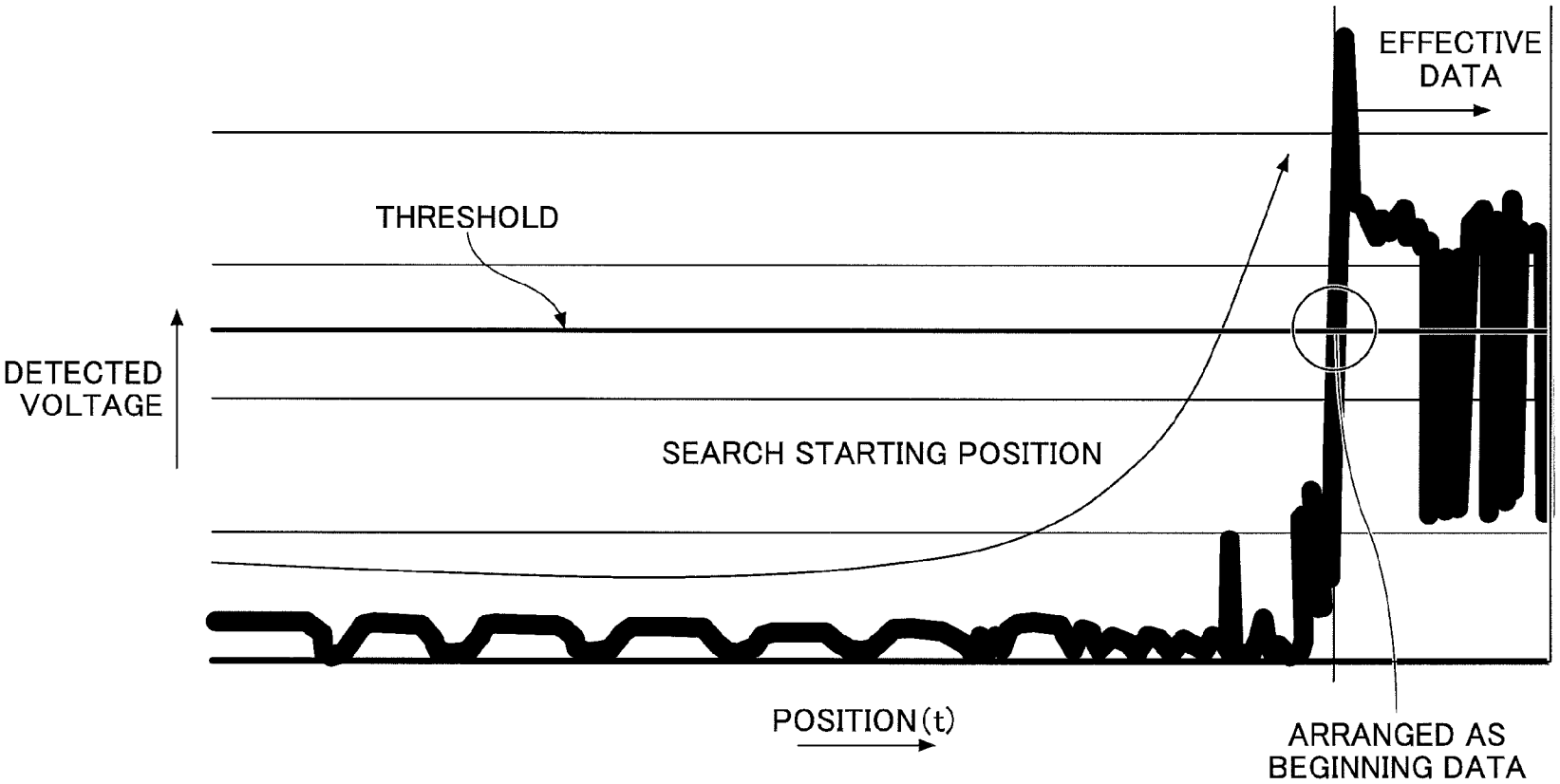
FIG. 25 is an exemplary diagram which describes a synchronization process.

FIG. 25 is an exemplary diagram which describes a synchronization process of A-(ii). An averaging unit calculates an average of n detected voltage data sets which are obtained by the n-times scanning unit. The detected voltage data sets are detected even when what is other than the sheet material 150 is scanned by the spotlight; however, what is needed is only a detected voltage obtained when it scans over the sheet material 150. Therefore, the synchronization unit aligns a start of n detected voltage data sets to a sheet edge of the sheet material 150.

In order to start n detected voltage data sets from the sheet edge, the synchronization unit detects a point at which the detected voltage data first exceeds the threshold value as a sheet edge of the sheet material 150. The detected voltage data sets for averaging are data sets at the time the threshold value is exceeded and beyond. (The detected voltage data set which exceeded the threshold value is handled as a starting first data set.) When a target value for the sensor calibration is set to 4.0 V, the threshold value takes a value of around 3.5-3.9 V, which is somewhat smaller.

In addition to such a synchronization method as described above, position information in the main scanning directions that is detected by the encoder sensor 42 may be collated with the detected voltage data to store the collated result, and the position information may be matched to synchronize n detected voltage data sets.

Pre-Processing A-(iii)

Next, n detected voltage data sets include n detected voltage data sets for each position with a sheet edge of the sheet material 150 as a reference position (a position being zero) in a scanning direction. The position, which is a position of the carriage 5 that is detected by the encoder sensor, corresponds on a one on one basis with a centroid position of the spotlight, so that it is described as the centroid position of the spotlight. In other words, the averaging unit calculates an average of n detected voltage data sets for each centroid position.

Pre-Processing A-(iv)

Figure 26:
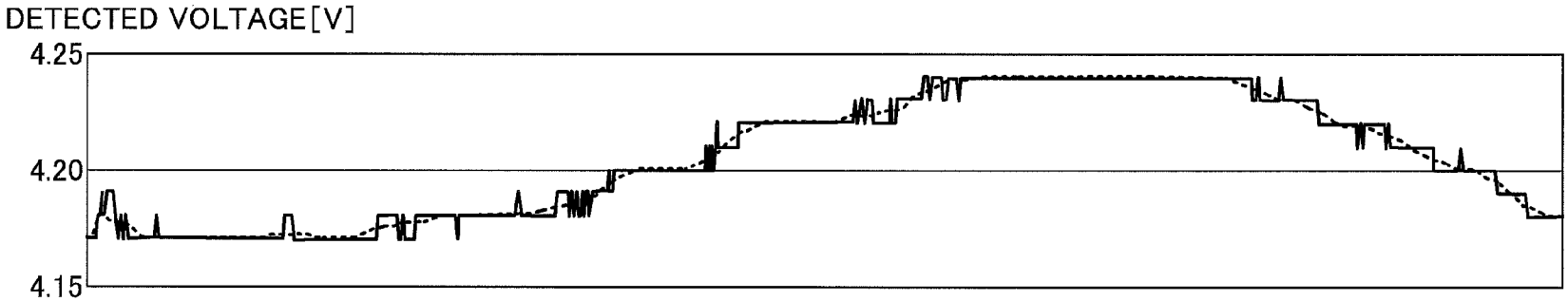
FIG. 26 is an exemplary diagram which describes a filtering process.

FIG. 26 is an exemplary drawing for explaining a filtering process. A filtering processing unit performs filtering processing on an average value of detected voltage data sets for each centroid position that is averaged by the averaging unit. More specifically, m detected voltage data sets (m in total, including a targeted data set and data sets preceding and following the targeted data set), are extracted to calculate an average. In this way, measured noise may be reduced and a mismatch of detected voltage data sets which could not be completely synchronized in the synchronization process may be reduced.

In FIG. 26, a solid line waveform is detected voltage data before the filtering process and a dotted line waveform is detected voltage data after the filtering process. It is seen that the detected voltage data before the filtering process, which shows step-shaped changes as it is impacted by a resolution of the A/D conversion circuit 523, becomes smooth through the filtering process.

(Test Pattern Forming)

The test pattern printing unit 617 forms a test pattern using pattern data of the test pattern storage unit 618 as described in Embodiment 1.

(Pre-Processing B)

Pre-Processing B-(i)

Figure 27A:
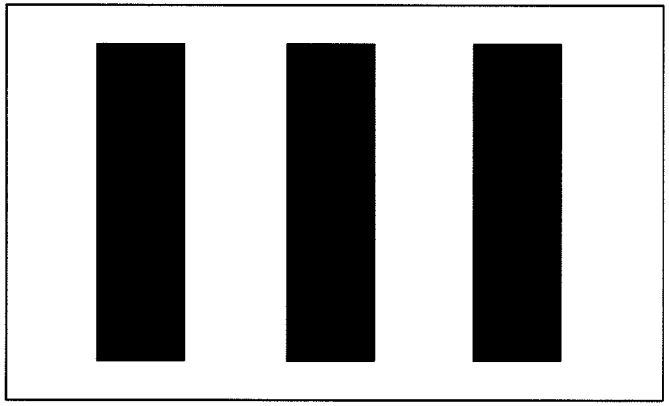
FIGS. 27A and 27B are exemplary diagrams which describe n-times scanning.
Figure 27B:
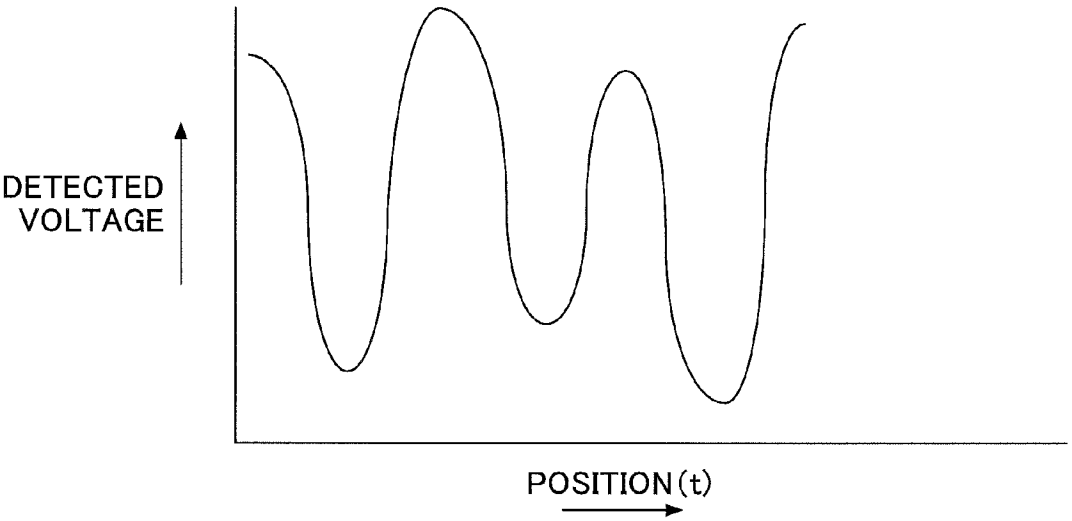

FIGS. 27A and 27B are exemplary diagrams which describe n-times scanning of B-(i). In FIG. 27A, a test pattern is formed on the sheet material 150 on which the n-times scanning of A-(i) has been performed. FIG. 27B shows a waveform of detected voltage data when a reflected light from the sheet material 150 on which a test pattern is formed is received by a light receiving element. The n-times scanning unit obtains such data n times.

Pre-Processing B-(ii)

Figure 28:
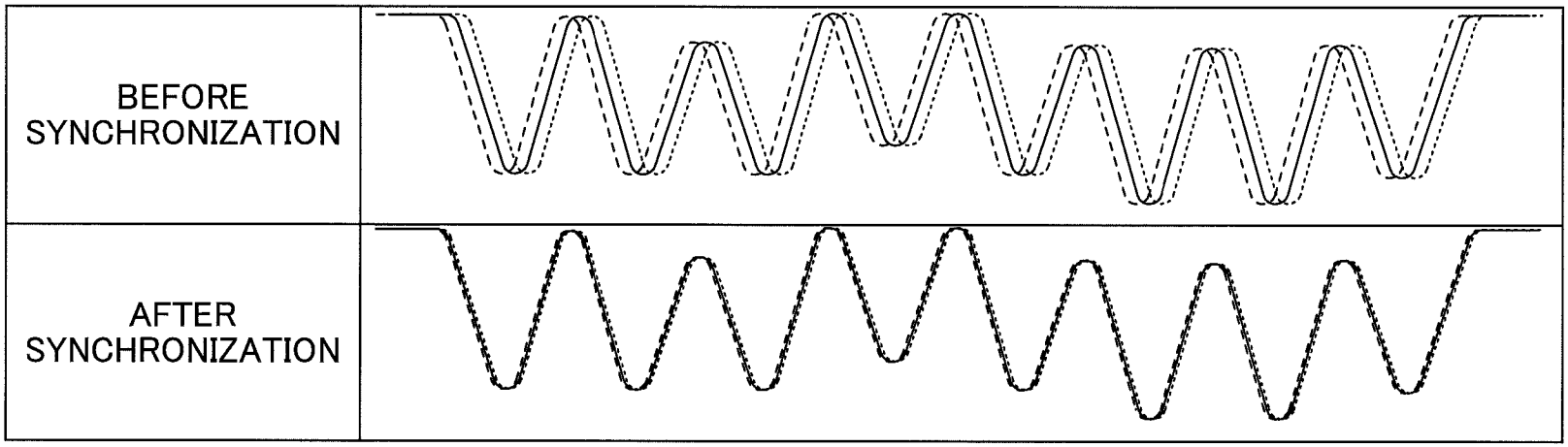
FIG. 28 is an exemplary diagram which describes a synchronization process.

FIG. 28 is an exemplary diagram which explains a synchronization process. The upper section schematically shows detected voltage data before synchronization while the lower section schematically shows detected voltage data after synchronization. Unlike before forming the test data, after forming the test data, local minimum values themselves and local maximum values themselves of n-times detected voltage data may be matched to align the edge positions. There are a number of methods for matching the local maximum values themselves and the local minimum values themselves (although it is difficult to match them perfectly) of waveform data as in FIGS. 21A and 21B.

As in A-(ii), a relatively simple method is to align a start of n detected voltage data sets to a sheet edge of the sheet material 150. If a test pattern is formed at the same position relative to a sheet edge, local maximum values and local minimum values of multiple detected voltage data sets may also be aligned at the same position.

Moreover, as in A-(ii), position information in the main scanning direction that is detected by the encoder sensor 42 may be collated with the detected voltage data to store the collated result, and position information may be matched to synchronize n detected voltage data sets.

Moreover, the synchronization unit may also determine the position of n detected voltage data sets such that an offset of n detected voltage data sets become minimal while staggering positions of n detected voltage data sets.

Pre-Processing B-(iii)

The averaging unit calculates an average of n detected voltage data sets which are synchronized. As n detected voltage data sets exist for each position, the averaging unit calculates an average of the n detected voltage data sets for each centroid position.

Signal Correction Process

The synchronization processing unit 613 performs a synchronization process before the signal correction. The synchronization processing unit 613 aligns a sheet edge of the detected voltage data after a test pattern print to which the pre-processing of B-(i)-(iii) is applied and the detected voltage data before the test pattern print to which the pre-processing of A-(i)-(iv) is applied.

As in A-(ii), the alignment is performed by setting a detected voltage data set which first exceeded the threshold value as a starting first data set. Below, for purposes of explanations, the detected voltage data set before the test pattern print is called blank sheet measurement data Vsg2 and the detected voltage data set after the test pattern print is called pattern measurement data Vsg1.

Below, a signal correction process is described.

(2-1) Pattern-Independent Portion Removal Process

The pattern-independent portion removal process is a process which reduces, from the detected voltage Vsg, a detected voltage portion which does not depend on the test pattern. More specifically, Vp is subtracted from Vsg. This makes it possible to remove a detected voltage which is not caused by the sheet material 150.

Figure 29:
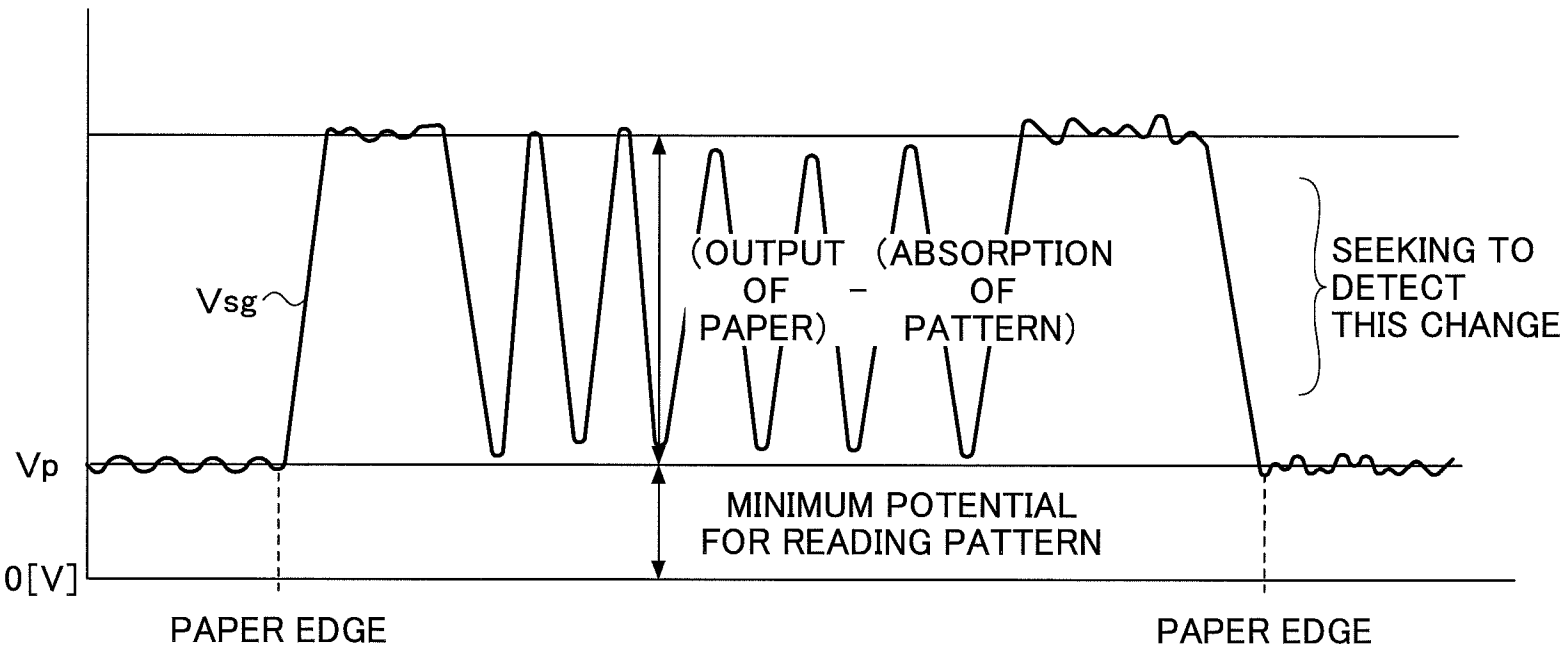
FIG. 29 is an exemplary diagram which describes Vsg and Vp.

FIG. 29 is an exemplary diagram which describes Vsg and Vp. Factors contributing to a detected voltage of a light receiving element are described. Many of lights received by the light receiving element are reflected lights of lights emitted onto a sheet material by a light emitting element, which reflected lights include a portion reflected from the sheet material and a portion reflected from a sheet-shaped member (below-called a platen) beneath the sheet. Moreover, lights such as background radiation and aerial scattered lights as well as the reflected lights are also received by the light receiving element. These are defined below:

Vsg: a detected voltage for all lights received by the light receiving element;

Vp: a detected voltage due to a dark output, the aerial scattered lights, and the reflected lights due to lights not completely absorbed even at a portion on which a test pattern is formed; and Vs: a detected voltage to be detected.

Vsg in FIG. 28 is a waveform of the detected voltage when the test pattern is formed. In the Vsg, at points on which the test pattern is formed, the test pattern absorbs the light, so that the reflected light decreases. However, Vp in FIG. 29 is output even at a portion on which the test pattern is formed. This is the detected voltage Vp, which does not change with the forming of the test pattern.

After the test pattern is formed, the local minimum value of the detected voltage is considered to be die to a pattern-independent portion which is not absorbed by ink, so that, in the present embodiment, a minimum voltage Vp at the time of reading the pattern is set to be a detected voltage due to the pattern-independent portion.

While a monochrome test pattern is exemplified, the present process may be applicable to multi-color test patterns. In such a case, a local minimum value for the test pattern of a color which absorbs a spotlight most becomes Vp. Then, at a test pattern of a different color, while a voltage which is not completely removed remains, the detection accuracy of the position improves even when some remains.

Thus, subtracting Vp, from which of a pattern measurement data Vsg1 and a blank sheet measurement data Vsg2 makes it possible to remove a detected voltage other than what is reflected from ink, may be performed. In this way, a variation of a local minimum value of a waveform output when the light receiving element reads the test pattern is reduced.

The pattern non-independent removal processing unit 614 makes the following calculations:

$$x' = Vsg1 - Vp; \text{ and}$$

$$y' = Vsg2 - Vp.$$

Figure 30A:
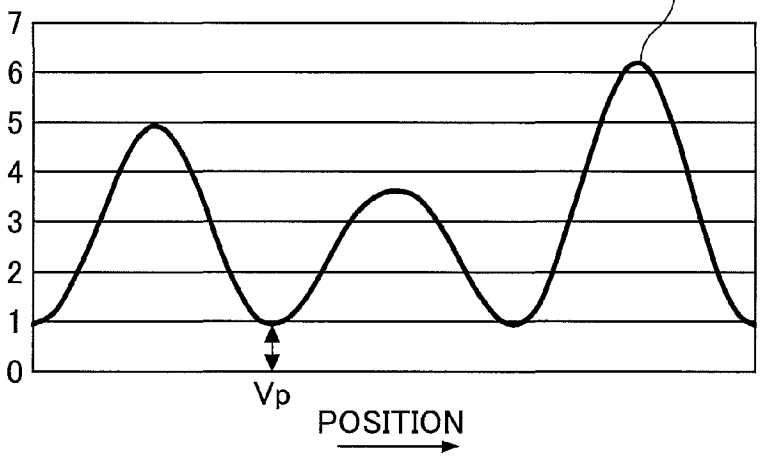
FIGS. 30A, 30B, 30C, and 30D are diagrams which illustrate one example of an output waveform of pattern measurement data and one example of an output waveform of blank sheet measurement data.
Figure 30B:
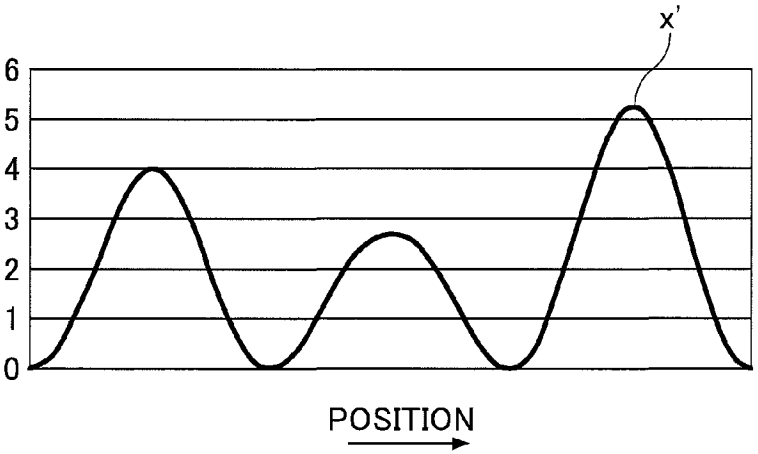

FIG. 30A shows an example of an output waveform of pattern measurement data, while FIG. 30B shows an example of an output waveform, which is pattern measurement data with Vp subtracted. As can be seen by comparing FIGS. 30A and 30B, it is seen that the pattern-independent portion removal process causes pattern measurement data to take a value which is smaller as a whole by approximately one V.

Figure 30C:
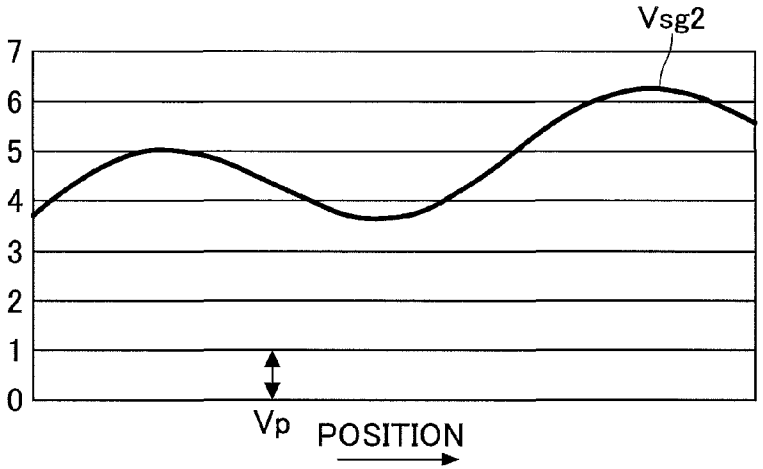
Figure 30D:
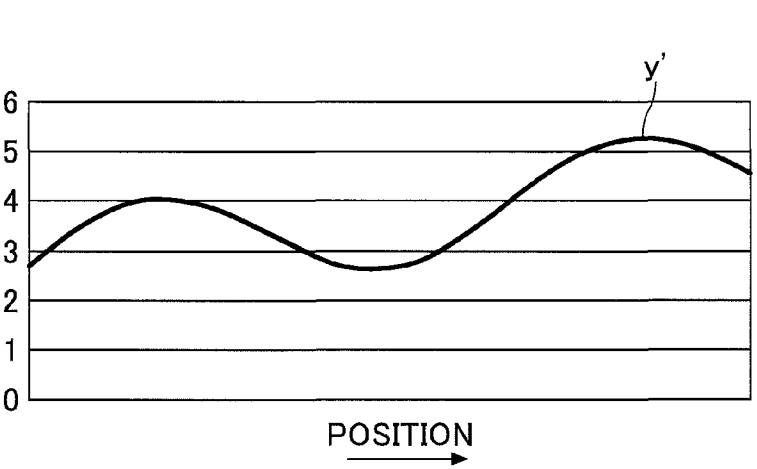

FIG. 30C shows an example of an output waveform of blank sheet measurement data, while FIG. 30D shows an example of an output waveform, which is blank sheet measurement data with Vp subtracted. By comparing FIGS. 30C and 30D, it is seen that the pattern-independent portion removal process causes blank sheet measurement data to take a value which is smaller as a whole by approximately one V.

(2-2) Amplitude Correction Process

As a result of a synchronization process, x' and y' become detected voltage data sets for the same scanning position. Thus, x' and y' become equal when a spotlight scans where there is no test pattern, while x' becomes generally zero when it scans where there is a test pattern. This represents a detected voltage due to reflected lights detected other than lights absorbed by the test pattern with y' as a reference (maximum) at a certain position. In other words, even when a variation caused by transmittance, etc., of the sheet material differs from position to position, at a position where the variation increases the detected voltage (a position where y' is large) x' also increases, whereas at a position where the variation decreases the detected voltage (a position where y' is small) x' also decreases.

In other words, this shows that a variation caused by a position included in x' can be properly corrected with a proportional correction called "x'/y'".

Figure 31A:
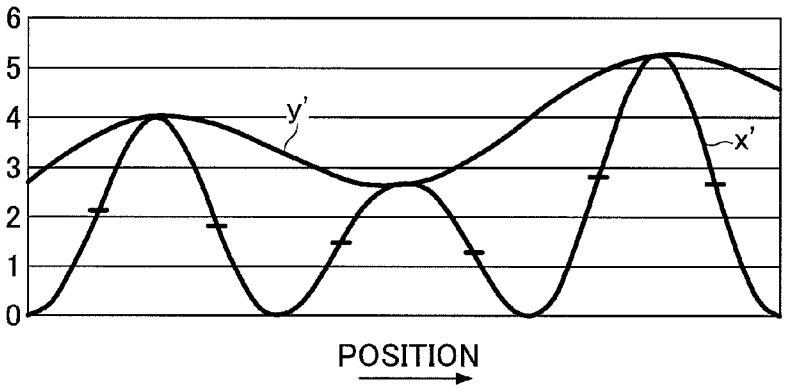
FIGS. 31A and 31B are exemplary diagrams which schematically describe a detected voltage z obtained from x' and y'.
Figure 31B:
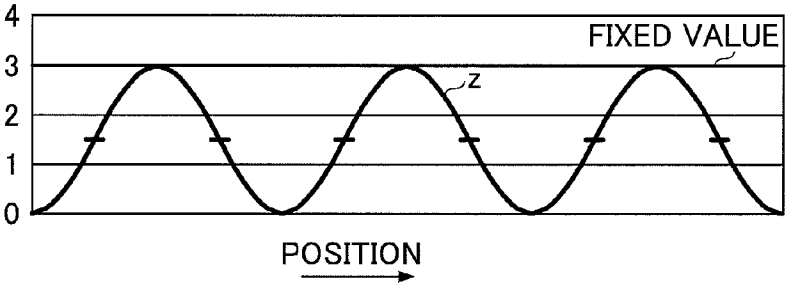

FIGS. 31A and 31B are exemplary diagrams which schematically describe a detected voltage z obtained from x' and y'. In FIG. 31A x' and y' are shown as overlapping into one, while a detected voltage z and a fixed value are shown in FIG. 31B. x'/y' represents, in what ratio x' which includes a variation at a certain position is included with y' as a reference, so that, when an appropriate fixed value is predetermined as an amplitude, "fixed value x (x'/y')" makes it possible to obtain detected voltage data with a constant amplitude. Assuming that the detected voltage is z, the detected voltage z after the amplitude correction process may be represented as $$Z=\text{fixed value } x(x'/y')$$

From the detected voltage z a variation caused by a position of the sheet material 150 is removed, so that the detected voltage data z becomes a detected voltage with a constant amplitude that takes a local minimum value at a test pattern portion and a local maximum value at a plain surface portion are obtained.

Based on the above-described ideas, the amplitude correction processing unit 615 performs the arithmetic operation "Fixed value x (x'/y'). With x' and y' already being determined, the fixed value is determined by subtracting Vp from a maximum value (e.g., 4 V) of a detected voltage obtained by sensor calibration. (Vp is subtracted since Vp is subtracted from both x' and y').

In light of the above, the amplitude correction processing unit 615 may obtain a detected voltage z with a constant amplitude as shown in FIG. 31B. Thereafter, the ejection timing correction unit 616 may determine the intersecting points C1 and C2 as edge positions as described above. The pattern-independent portion removal process and the amplitude correction process make it possible to concentrate points of inflection around a center of a threshold area.

The fixed value may be a median value or an average value of Vsg2 which correlates with a local maximum value, with Vp subtracted. Moreover, the amplitude of the detected voltage is constant no matter how many fixed values there are, making it possible to make changes on an assumption that the threshold area is adjusted.

(Operation Procedure)

Figure 32:
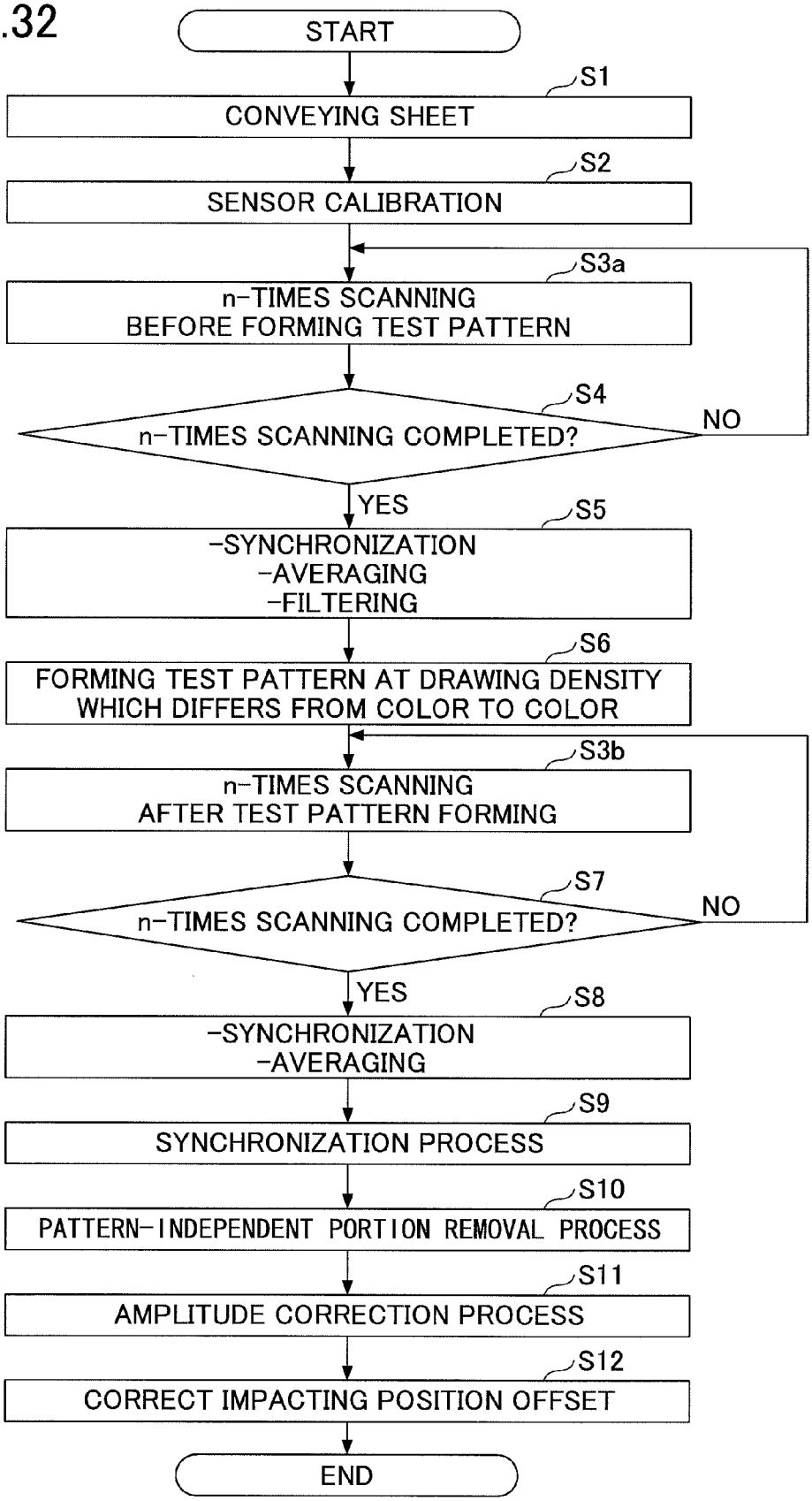
FIG. 32 is a flowchart which illustrates one example of a procedure in which a correction process executing unit performs a signal correction.

FIG. 32 is a flowchart which illustrates one example of a procedure in which the correction process executing unit 526 performs a signal correction.

First, the CPU 301 instructs the main controller 301 to start an impacting position offset correction. With this instruction, the main controller 310 drives the sub-scanning motor 132 via the sub-scanning drive unit 314 and conveys the sheet material 150 to right under the recording head 21 (S1).

Next, the main controller 310 drives the main scanning motor 27 via the main scanning drive unit 313 to move the carriage 5 over the sheet material 150 and carries out calibration of the light emitting element 402 and the light receiving element 403 at a specific location on the sheet material 150 (S2). The process in S2 is the same as in Embodiment 1, so that repeated explanations are omitted.

Next, an n-times scanning unit of the pre-print pre-processing unit 611 moves the carriage 5 to a home position and performs n-times scanning before forming the test pattern and stores n detected voltage data sets in the shared memory 525 (S3*a*).

Figure 33A:
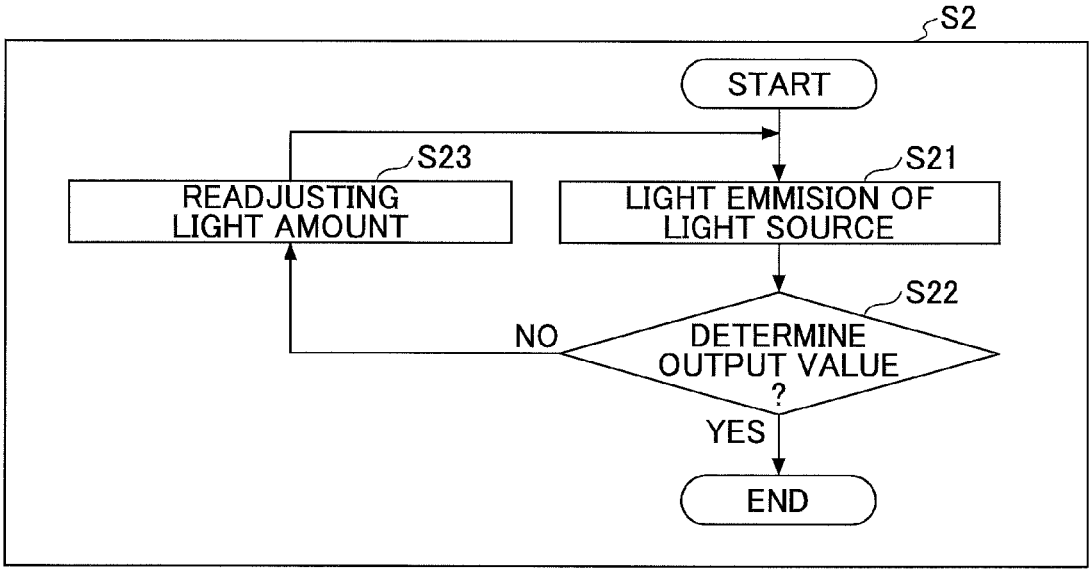
FIGS. 33A, 33B, 33C, and 33D are exemplary flowcharts which describe a process of the correction process executing unit.
Figure 33B:
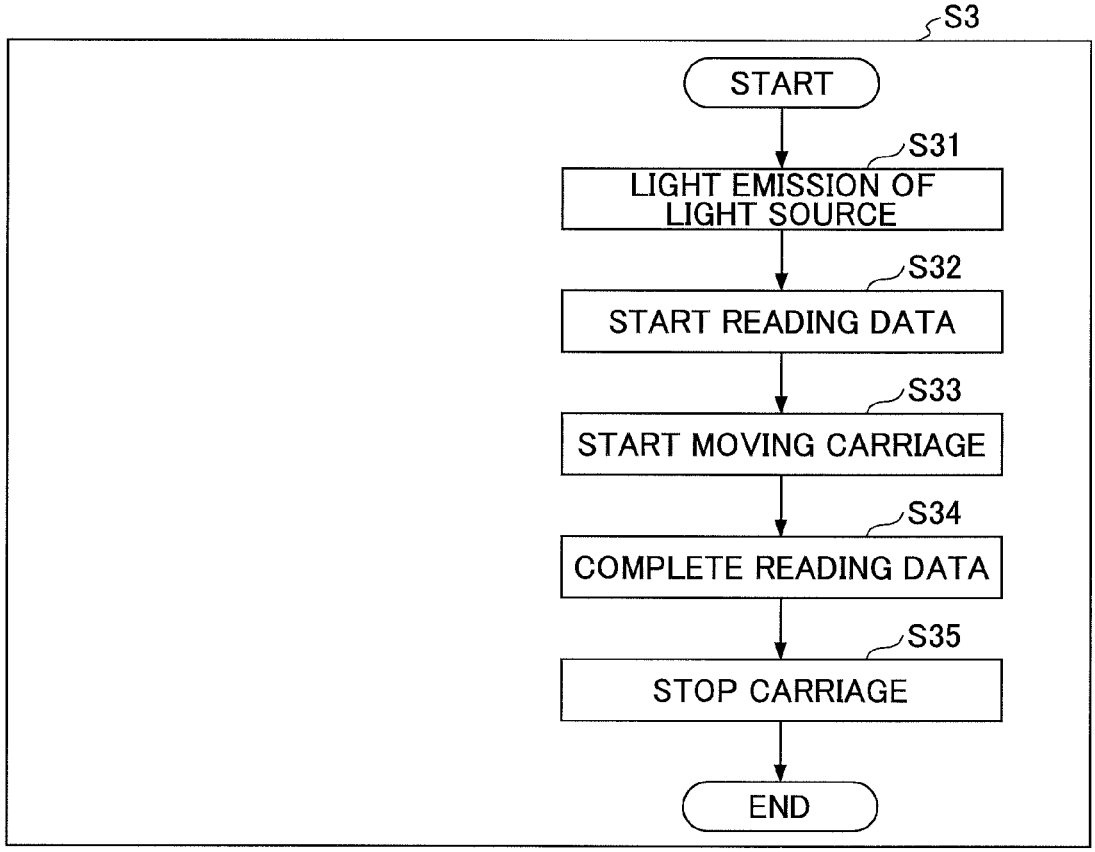

FIG. 33B is an exemplary flowchart which explains a process in S3*a*. First, the CPU 301 turns on a sensor light source (S31).

Next, the photoelectric conversion circuit 521, etc., starts taking in the detected voltage data (S32). When the taking in is started, the main scanning drive unit 313 moves the carriage 5 with the main scanning drive motor 27 (S33). In other words, the photoelectric conversion circuit 521, etc., takes in the detected voltage data while the carriage 5 moves. The data is sampled at 20 kHz (a 50 μs interval), for example.

When the carriage 5 arrives at an edge of the image forming apparatus, the photoelectric conversion circuit 521, etc., completes taking in the detected voltage data (S34). The main controller 310 accumulates a series of detected voltage data sets in the shared memory 525. The main controller 310 stops the carriage 5 at the home position (S35).

The CPU 301 determines, for a predetermined number of times, whether reading of the detected voltage data has been completed n times, and, if yes, the process proceeds to the following process S5, and, if no, the process of reading the detected voltage data in S3 is performed again (S4).

Figure 33C:
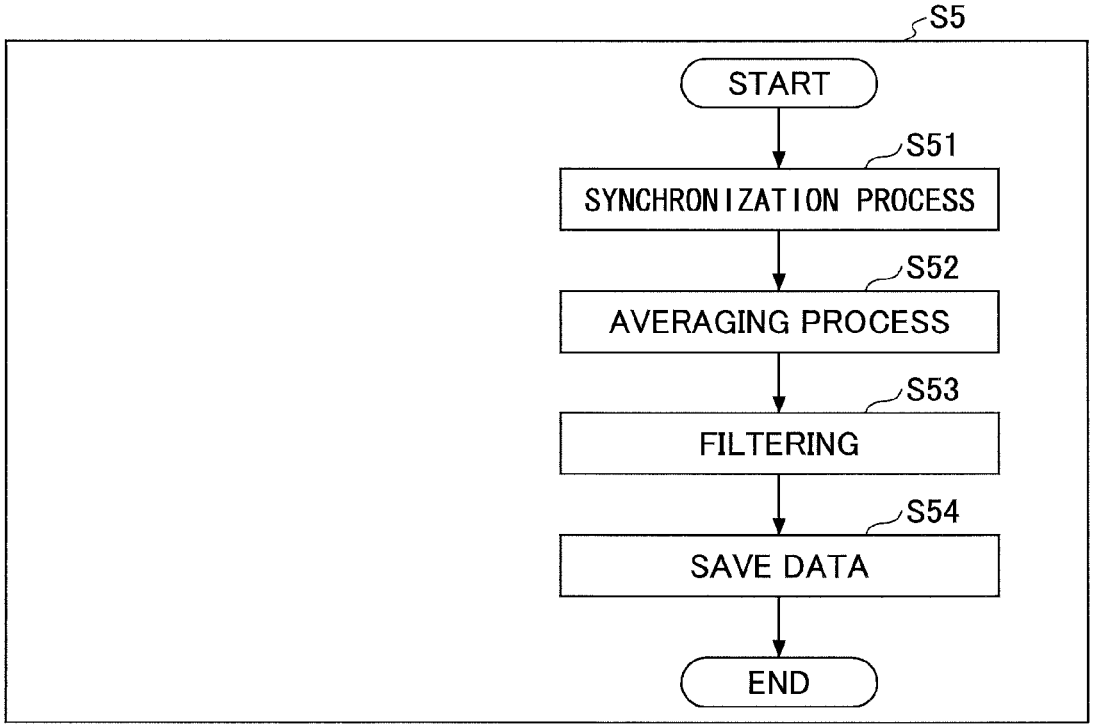

Next, the pre-print pre-processing unit 611 reads the detected voltage data, before test pattern forming, that are accumulated in the shared memory 525 and reads a predetermined number of times to execute the pre-processing and saves the data in the RAM 303 (S5). What is in the pre-processing in S5, which is shown in FIG. 33C, has already been explained, so that a repeated explanation is omitted.

Next, in the main controller 310 no sheet conveying is performed with a sub-scanning position of the sheet material 150 as it is, the main scanning controller 313 moves the carriage 5 via the main scanning drive motor 27, and the head drive controller 312 drives the recording heads 21-24 using pattern data to form a test pattern for adjusting an impacting position offset. (S6)

Next, an n-times scanning unit of the post-print pre-processing unit 612 moves the carriage 5 to a home position and performs n-times scanning after forming the test pattern and stores n detected voltage data sets in the shared memory 525 (S3*b*).

The CPU 301 determines, for a predetermined number of times, whether reading of the detected voltage data has been completed n times, and, if yes, the process proceeds to the following process S8, and, if no, the process of reading the pattern data in S3 is performed again (S7).

Figure 33D:
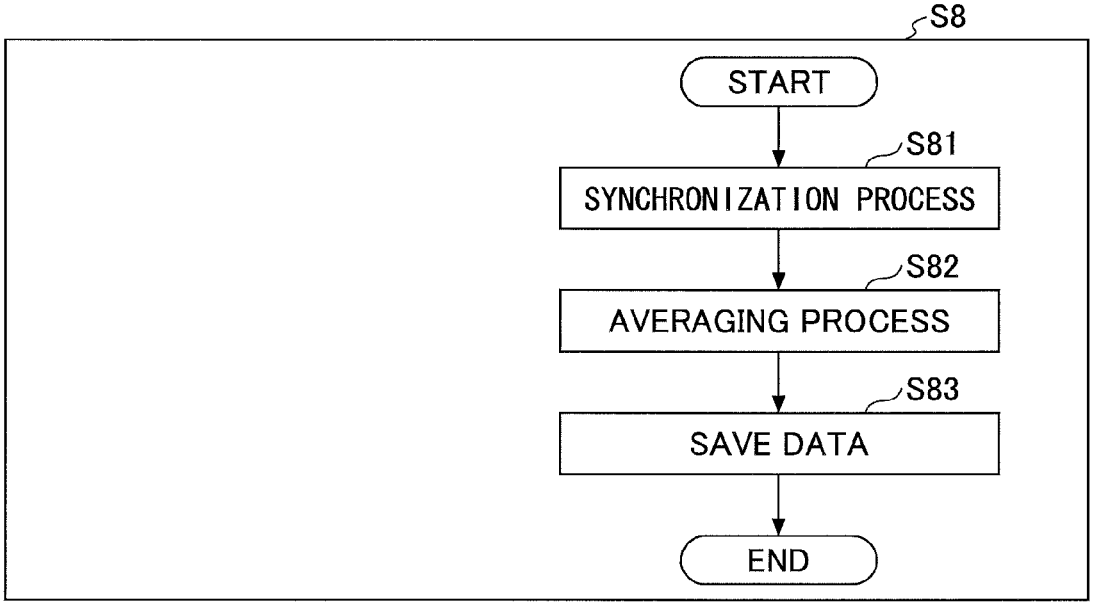

Next, the post-print pre-processing unit 612 reads the detected voltage data sets that are accumulated in the shared memory 525 and reads a predetermined number of times to carry out the pre-processing and saves the data in the RAM 303 (S8). What is in the pre-processing in S8, which is shown in FIG. 33D, has already been explained, so that a repeated explanation is omitted.

Next, the synchronization processing unit 613 reads, from the RAM 303, pattern measurement data and blank sheet measurement data to which the pre-processing is applied to perform position alignment by a synchronization process (S9).

Next, the pattern-independent portion removal processing unit 614 determines Vp from a local minimum value of the pattern measurement data and subtracts Vp from the blank sheet measurement data and the pattern measurement data, respectively (S10).

Next, using Equation "z=fixed value x (x'/y')", the amplitude correction processing unit 615 performs an amplitude correction process and generates a detected voltage z (S11). In this way, detected voltage data sets with all points of inflection falling within a threshold area have been obtained.

The ejection timing correction unit 616 detects an edge position with the detected voltage z, and corrects an impacting position offset of liquid droplets (S12). In other words, the ejection timing correction unit 616 compares a distance between each line with an optimal distance to calculate an impacting position offset amount, and calculates a correction value of a liquid droplet ejection timing such that an impacting position offset is removed, and sets the calculated correction value in the head drive controller 312.

As described above, the image forming apparatus 100 according to the present embodiment may change the drawing density of test patterns for each ink color, and further perform, even for a sheet material 150 with a high transmittance, a correction on an amplitude of a detected voltage such that it becomes almost constant to cause a position of a point of inflection to fall within a threshold area, making it possible to accurately determine an edge position and accurately determine an impacting position offset of liquid droplets.

Embodiment 3

In the present embodiment, a pattern-independent portion removal process and an amplitude correction process are described for an image forming system embodied by a server, not an image forming apparatus.

Figure 34:
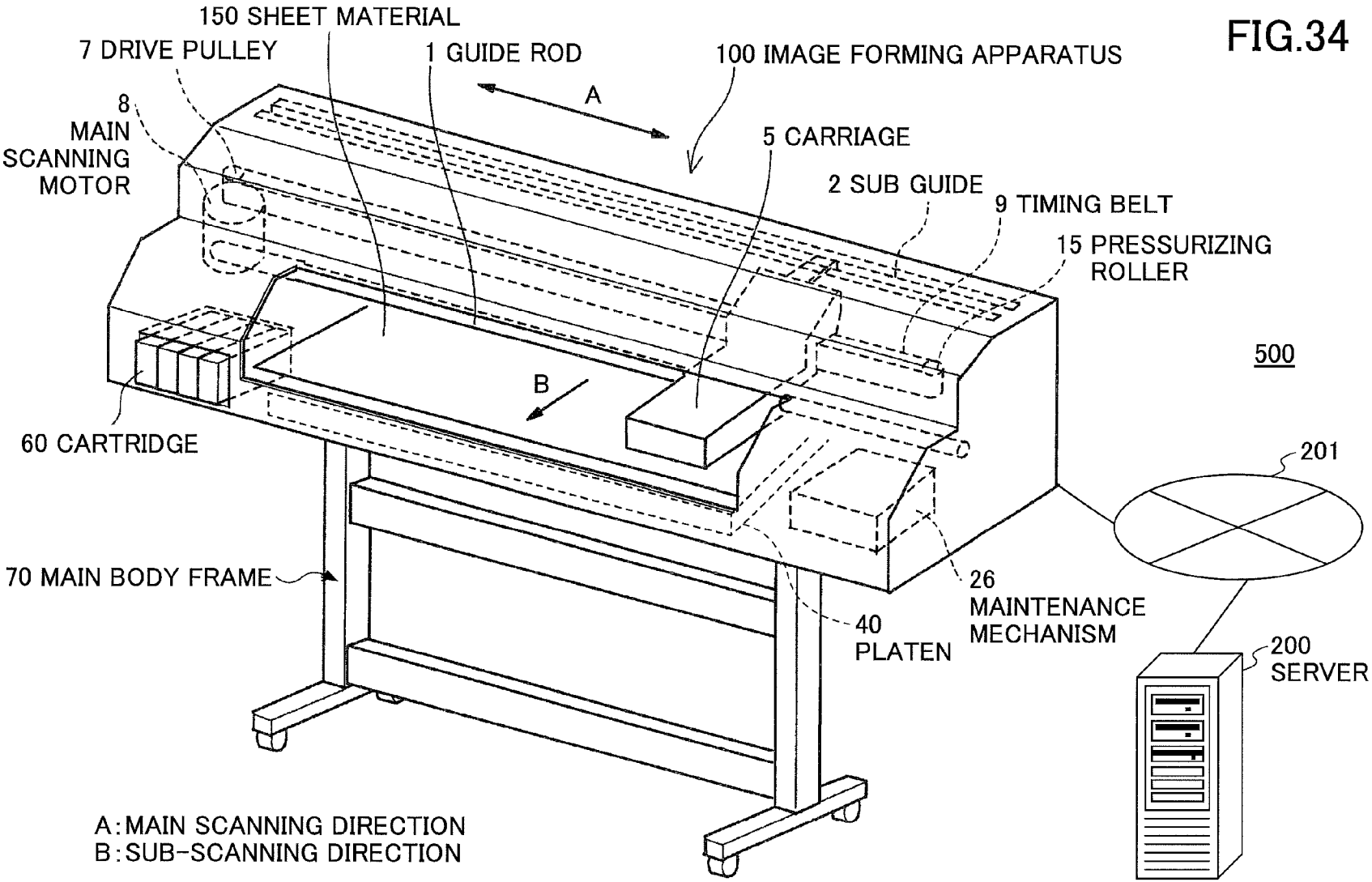
FIG. 34 is an exemplary diagram which schematically describes an image forming system which includes the image forming apparatus and a server.

FIG. 34 is an exemplary diagram which schematically describes an image forming system 500 which has an image forming apparatus 100 and a server 200. In FIG. 34, the same letters are given to the same elements as FIG. 3, so that a repeated explanation is omitted. The image forming apparatus and the server 200 are connected via a network 201, which includes an in-house LAN; a WAN which connects the LANs; or the Internet, or a combination thereof.

In the image forming system 500 as in FIG. 34, the image forming apparatus 100 forms a test pattern and scans the test pattern by a print position offset sensor, and the server 200 calculates the correction value of the liquid droplet ejection timing. Therefore, a processing burden of the image forming apparatus 100 may be reduced and functions of calculating a correction value of a liquid droplet ejection timing may be concentrated in the server 200.

Figure 35:
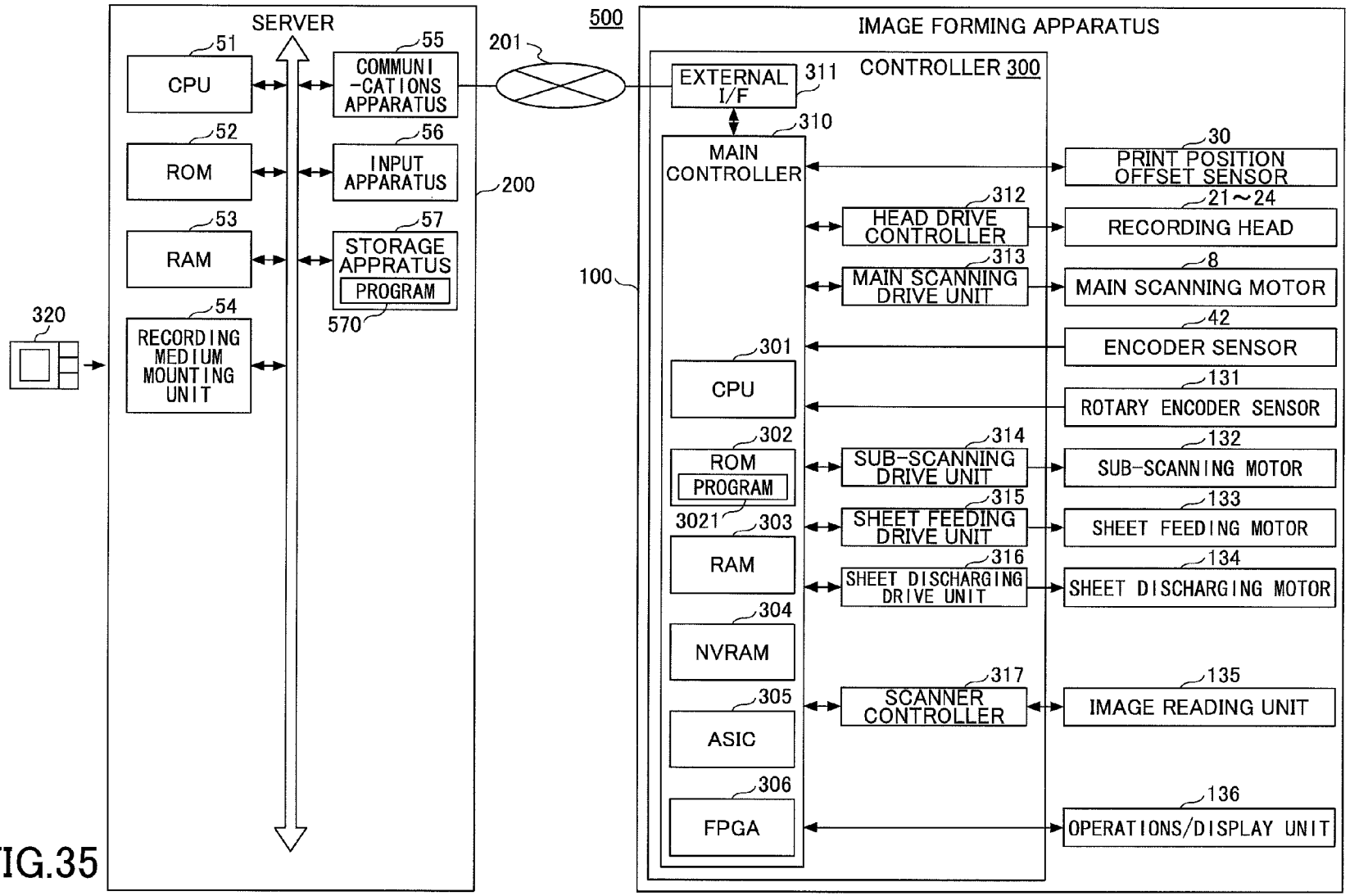
FIG. 35 is a diagram illustrating an example of a hardware configuration of the server and the image forming apparatus.

FIG. 35 is a diagram illustrating an example of a hardware configuration of the server 200 and the image forming apparatus 100. The server 200 includes a CPU 51, a ROM 52, a RAM 53, a recording medium mounting unit 54, a communications apparatus 55, an input apparatus 56, and a storage apparatus 57. The CPU 51 reads an OS (Operating System) and a program 570 from the storage apparatus 57 to execute the program with the RAM 53 as a working memory. The program 570 performs a process of calculating a correction value of a liquid droplet ejection timing.

The RAM 53 becomes a working memory (a main storage memory) which temporarily stores necessary data, while a BIOS with initializing data, a bootstrap loader, etc., is stored in the ROM 52. The storage medium mounting unit 54 is an interface in which is mounted a portable storage medium 320.

The communications apparatus 55, which is called a LAN card or an Ethernet card, connects to the network 201 to communicate with an external I/F 311 of the image forming apparatus 100. A domain name or an IP address of the server 200 is registered in the image forming apparatus 100.

The input apparatus 56 is a user interface which accepts various operating instructions of the user, such as a keyboard, mouse, etc. It may also be arranged for a touch panel or a voice input apparatus to be the input apparatus.

The storage apparatus 57 is a non-volatile memory such as a HDD (Hard Disk Drive), a flash memory, etc., storing an OS, a program, etc. The program 570 is distributed in a form recorded in the storage medium 320, or in a manner such that it is downloaded from the server 200 (not shown).

Figure 36:
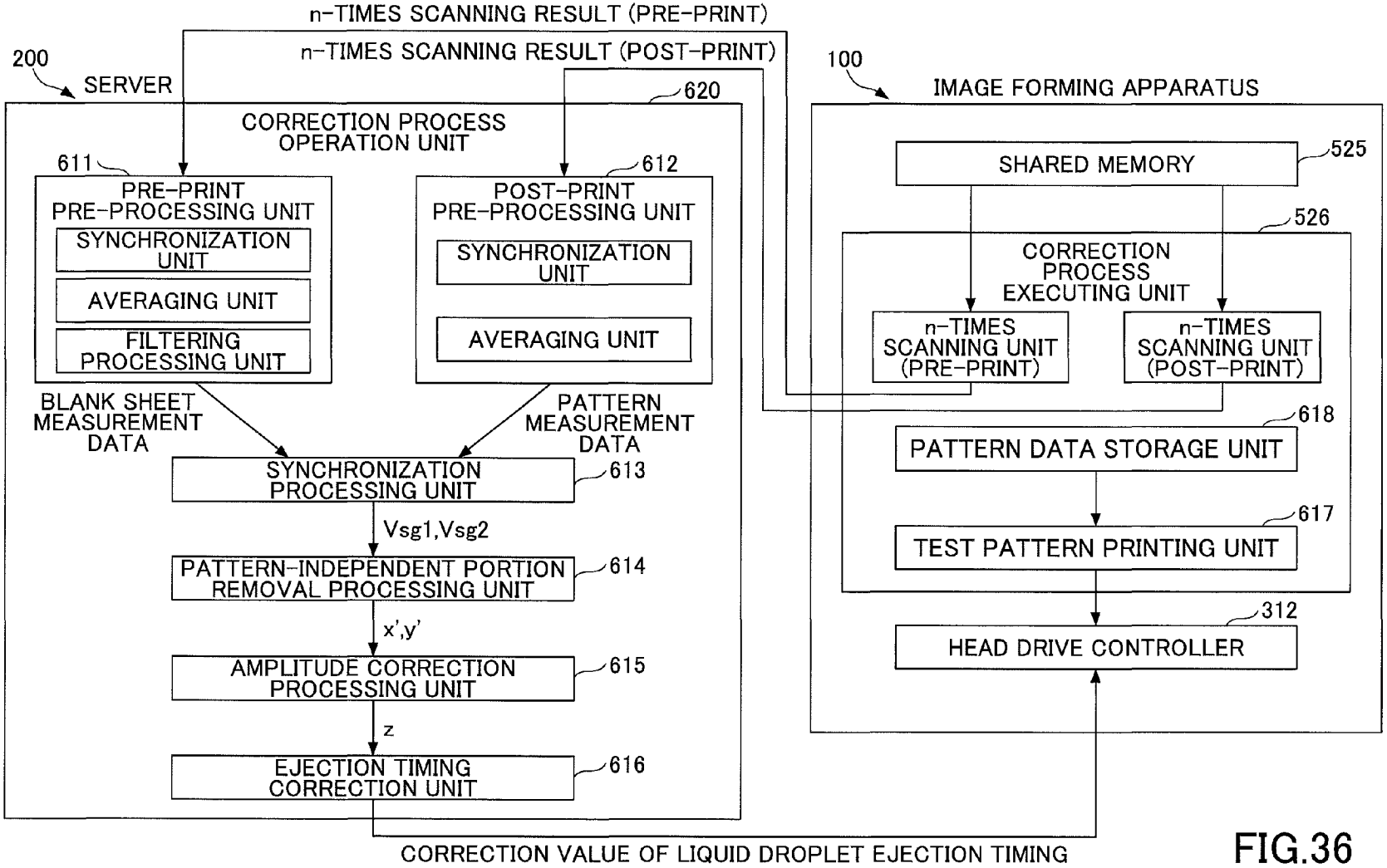
FIG. 36 is an exemplary functional block diagram of the image forming system.

FIG. 36 is an exemplary functional block diagram of the image forming system 500. The correction process executing unit 526 of the image forming apparatus 100 retains only the pre-print and post-print n-times scanning unit, the test pattern storage unit 618, and the test pattern printing unit 617, while the server side includes the other functions. A function at the server side is called a correction process operating unit 620. The test pattern storage unit 618 may be located in the server 200 or another server (not shown), or the image forming apparatus 100 may download test patterns from the server 200.

The correction process operating unit 620 includes, for a pre-print process, synchronization, averaging, and filtering units, and, for a post-print process, synchronization and averaging units, a synchronization process unit 613, a pattern-independent portion removal process unit 614, an amplitude correction process unit 615, and an ejection timing correction unit 616. A function of each block is the same as Embodiment 1, so that a repeated explanation is omitted.

In the image forming system 500, an n-times scanning unit on the image forming apparatus side transmits, to the server 200, n pre-print and post-print data sets. The correction process operating unit 620 on the server side performs a pattern-independent portion removal process and an amplitude correction process to calculate a correction value of a liquid droplet ejection timing. The server 200 transmits the correction value of the liquid droplet ejection timing to the image forming apparatus 100, so that the head drive controller 312 may change the ejection timing.

Figure 37:
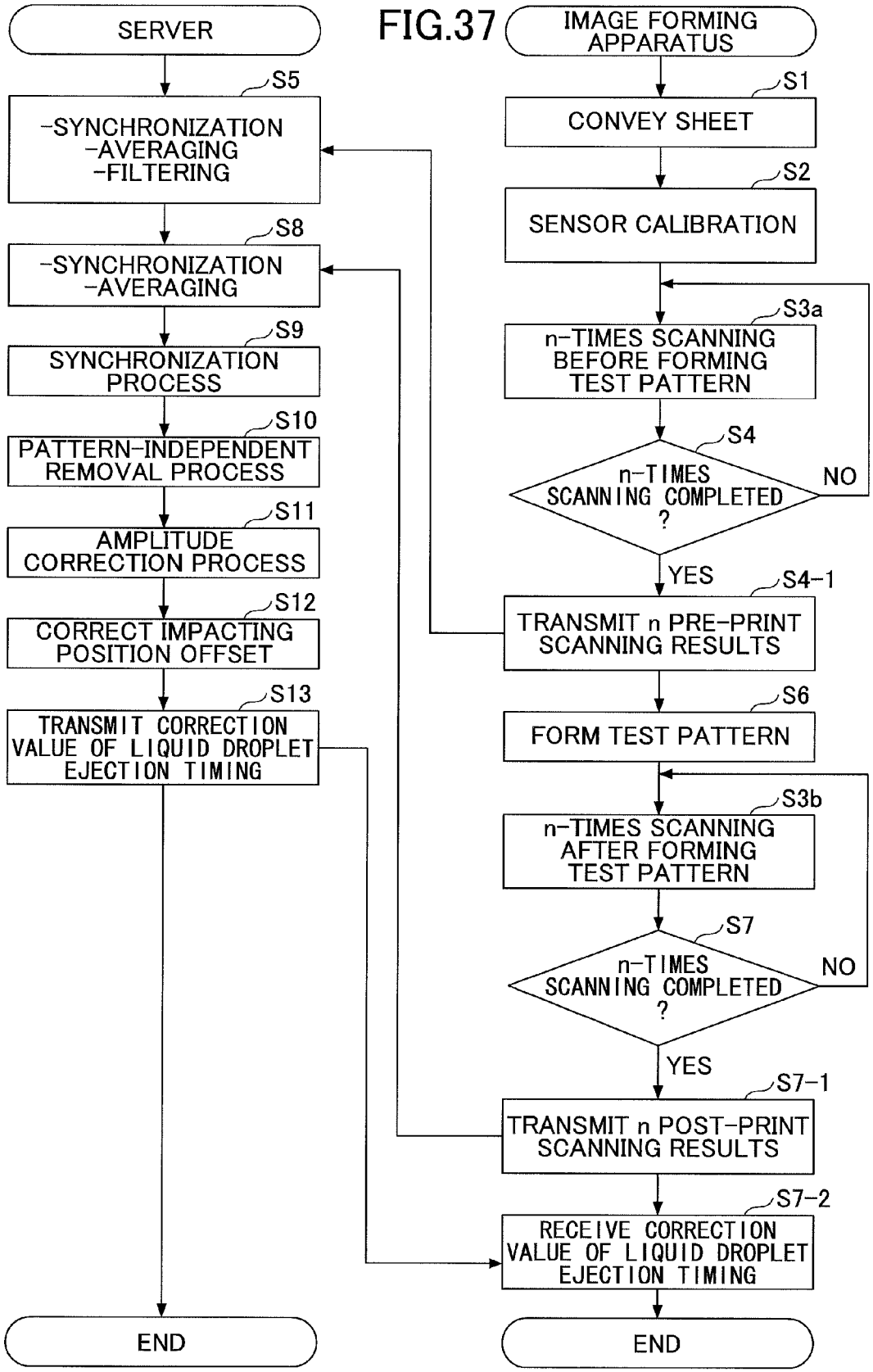
FIG. 37 is a flowchart which shows an operating procedure of the image forming system.

FIG. 37 is a flowchart which shows an operational procedure of the image forming system 500. As shown, S5 and S8-S11 in FIG. 32 are performed by the server 200, while a process required for the other pre-print and post-print n-times scanning is performed by the image forming apparatus 100.

Moreover, the image forming apparatus 100 and the server 200 communicate, so that the image forming apparatus 100 newly performs a process which transmits n pre-print scanning results in step S4-1 and a process which transmits n post-print scanning results in step S7-1. Moreover, the image forming apparatus 100 newly performs a process which receives a correction value of the liquid droplet ejection timing in Step S7-2.

In the meantime, after S12, the server 200 newly performs a process of transmitting a correction value of the liquid droplet ejection timing to the image forming apparatus 100 in S13.

In this way, with only changes where the process is performed, the image forming system 500 may suppress an impact received from a characteristic of a sheet material as in Embodiment 1, to accurately correct the liquid droplet ejection timing.

The present application is based on Japanese Priority Applications No. 2011-054443 filed on Mar. 11, 2011, and No. 2011-276401 filed on Dec. 16, 2011, the entire contents of which are hereby incorporated by reference.

The invention claimed is:

1. An image forming apparatus which reads a test pattern formed onto a recording medium to adjust an ejection timing of liquid droplets, the test pattern including multiple lines, the image forming apparatus comprising:

a reading unit including a light emitting unit which irradiates a light onto the recording medium, and a light receiving unit which receives a reflected light from the recording medium;

a pattern data storage unit which stores pattern data of the test pattern, wherein a drawing density is adjusted for each of colors of the liquid droplets such that a difference between local minimum values of the reflected lights reflected by at least two of the colors of the test pattern becomes small relative to when the drawing density is the same for each of the colors of the liquid droplets;

an image forming unit which reads the pattern data to form the at least two colors of the test pattern onto the recording medium, each of the colors of the test pattern having a different drawing density;

a relative movement unit which relatively moves the recording medium or the reading unit at a constant speed;

an intensity data obtaining unit which obtains intensity data on the reflected light which is received by the light receiving unit from a scanning position of the light while the light moves over the test pattern; and a position detecting unit which applies a line position determining operation on the intensity data and detects the line position.

2. The image forming apparatus as claimed in claim 1, wherein the image forming unit causes the drawing density of the test pattern of the liquid droplets with a high reflectance of the light of the two colors of the liquid droplets to be greater than the drawing density of the test pattern of the liquid droplets with a low reflectance of the light of the two colors of the liquid droplets.

3. The image forming apparatus as claimed in claim 2, wherein the image forming unit changes a resolution of the liquid droplets in a sub-scanning direction to change the drawing density of the test pattern.

4. The image forming apparatus as claimed in claim 3, wherein the image forming unit ejects the liquid droplets in a main scanning direction, after which it ejects the liquid droplets in the main scanning direction onto the recording medium which is conveyed in the sub-scanning direction by a distance which is shorter than a distance between the liquid droplets at the highest resolution in the sub-scanning direction.

5. The image forming apparatus as claimed in claim 2, wherein the image forming unit changes a resolution of the liquid droplets in a main scanning direction to change the drawing density of the test pattern.

6. The image forming apparatus as claimed in claim 5, wherein the image forming unit ejects the liquid droplets at a highest resolution in the main scanning direction, after which it again ejects the liquid droplets at the highest resolution, offsetting a position in the main scanning direction by a distance which is shorter than a distance between the liquid droplets at the highest resolution while leaving a position in a sub-scanning direction the same.

7. The image forming apparatus as claimed in claim 2, wherein the image forming unit forms the test pattern in which the liquid droplets are ejected in multiple rounds at approximately the same position.

8. The image forming apparatus as claimed in claim 1, wherein the image forming unit causes the drawing density of the test pattern of the liquid droplets with a low reflectance of the light of the two colors of the liquid droplets to be less than the drawing density of the test pattern of the liquid droplets with a high reflectance of the light of the two colors of the liquid droplets.

9. The image forming apparatus as claimed in claim 1, wherein the position detecting unit applies the line position determining operation on the intensity data which falls between an upper-limit threshold and a lower-limit threshold which are predetermined.

10. The image forming apparatus as claimed in claim 1, further comprising:

a second intensity data obtaining unit which obtains second intensity data on the reflected light which is received by the light receiving unit from a scanning position of the light before the test pattern is formed;

a first intensity data obtaining unit which obtains first intensity data on the reflected light which is received by the light receiving unit when the light moves over the test pattern at generally the same scanning position as the scanning position after the test pattern is formed;

a subtracting processing unit which subtracts from each of the first intensity data and the second intensity data a value which is approximately the same as a local minimum value of the first intensity data; and a signal correction unit which calculates a proportion of the subtracted first intensity data relative to the subtracted second intensity data to align local maximum values of the first intensity data such that they are generally uniform.

11. A method of detecting a pattern position in an image forming apparatus which reads a test pattern formed onto a recording medium to adjust an ejection timing of liquid droplets, the test pattern including multiple lines, the image forming apparatus including a reading unit including a light emitting unit which irradiates a light onto the recording medium and a light receiving unit which receives a reflected light from the recording medium, and a pattern data storage unit which stores pattern data of the test pattern, wherein a drawing density is adjusted for each of colors of the liquid droplets such that a difference between local minimum values of the reflected lights reflected by at least two of the colors of the test pattern becomes small relative to when the drawing density is the same for each of the colors of the liquid droplets, the method comprising the steps of:

by an image forming unit, reading the pattern data to form the at least two colors of the test pattern onto the recording medium, each of the colors having a different drawing density;

relatively moving, by a relative movement unit, the recording medium or the reading unit at a constant speed;

obtaining, by an intensity data obtaining unit, intensity data on the reflected light which is received by the light receiving unit from a scanning position of the light while the light moves over the test pattern; and by a position detecting unit, applying a line position determining operation on the intensity data included between an upper limit and a lower limit which are predetermined, and detecting the line position.

12. An image forming system which reads a test pattern formed onto a recording medium to adjust an ejection timing of liquid droplets, the test pattern including multiple lines, the image forming system comprising:

an image forming apparatus including a reading unit including a light emitting unit which irradiates a light onto the recording medium, and a light receiving unit which receives a reflected light from the recording medium;

an image forming unit which forms at least two of colors of the test pattern with different drawing densities onto the recording medium;

a relative movement unit which relatively moves the recording medium or the reading unit at a constant speed;

an intensity data obtaining unit which obtains intensity data on the reflected light which is received by the light receiving unit from a scanning position of the light while the light moves over the test pattern;

a pattern data storage unit which stores pattern data of the test pattern, wherein a drawing density is adjusted for each of the colors of the liquid droplets such that a difference between local minimum values of the reflected lights reflected by the at least two of the colors of the test pattern becomes small relative to when the drawing density is the same for each of the colors of the liquid droplets; and a position detecting unit which applies a line position determining operation on the intensity data and detects the line position, wherein, based on the test pattern stored in the pattern data storage unit, the image forming unit forms a test pattern.

* * * * *